US010086344B2

(12) United States Patent
Ishida et al.

(10) Patent No.: US 10,086,344 B2
(45) Date of Patent: Oct. 2, 2018

(54) TANK APPARATUS, A SYSTEM FOR DISPERSING BY CIRCULATING A MIXTURE, AND A METHOD FOR DISPERSING BY CIRCULATING A MIXTURE

(75) Inventors: Yuu Ishida, Toyokawa (JP); Yutaka Hagata, Toyokawa (JP); Masaya Hotta, Toyokawa (JP); Katsuaki Odagi, Toyokawa (JP)

(73) Assignee: SINTOKOGIO, LTD., Aichi (JP)

( * ) Notice: Subject to any disclaimer, the term of this patent is extended or adjusted under 35 U.S.C. 154(b) by 426 days.

(21) Appl. No.: 13/985,135

(22) PCT Filed: Dec. 8, 2011

(86) PCT No.: PCT/JP2011/078386
§ 371 (c)(1),
(2), (4) Date: Aug. 13, 2013

(87) PCT Pub. No.: WO2012/111218
PCT Pub. Date: Aug. 23, 2012

(65) Prior Publication Data

US 2013/0315030 A1 Nov. 28, 2013

(30) Foreign Application Priority Data

Feb. 17, 2011 (JP) ..... 2011-032382

(51) Int. Cl.
*B01F 15/00* (2006.01)
*B01F 15/02* (2006.01)
(Continued)

(52) U.S. Cl.
CPC ..... *B01F 15/0251* (2013.01); *B01F 3/1221* (2013.01); *B01F 3/1271* (2013.01);
(Continued)

(58) Field of Classification Search
CPC .. B29B 7/7461; B01F 15/0251; B01F 3/1221; B01F 3/1271; B01F 5/10;
(Continued)

(56) References Cited

U.S. PATENT DOCUMENTS 4,174,906 A * 11/1979 Richard ..... B22C 5/0418 241/30
4,460,277 A * 7/1984 Schulz ..... B29B 7/7461 366/76.3
(Continued)

FOREIGN PATENT DOCUMENTS

FR 2 326 384 A1 4/1977
JP 50-106488 9/1975
(Continued)

OTHER PUBLICATIONS

English-language International Search Report from Japanese Patent Office for International Application No. PCT/JP2011/078386, dated Jan. 24, 2012.
(Continued)

*Primary Examiner* — Anshu Bhatia
(74) *Attorney, Agent, or Firm* — Finnegan, Henderson, Farabow, Garrett & Dunner, LLP

(57) ABSTRACT

A tank apparatus and a system for dispersing by circulating a mixture that prevents powdery additives from adhering to an inner face of a tank from scattering in the tank, from drifting on the surface of a liquid, and from agglutinating, are presented. The tank apparatus that stores a raw material that is slurry or liquid and supplies powdery additives to the raw material to mix them with the raw material comprises a tank for storing the raw material and a screw-type device for supplying powdery additives that is integral with the tank and supplies the powdery additives to the raw material in the tank, wherein a tip of a part for supplying powdery additives
(Continued)

of the screw-type device for supplying powdery additives is inserted into the mixture in the tank.

6 Claims, 27 Drawing Sheets

(51) Int. Cl.

| | |
|---|---|
| ***B01F 3/12*** | (2006.01) |
| ***B01F 5/10*** | (2006.01) |
| ***B01F 7/00*** | (2006.01) |
| ***B01F 7/18*** | (2006.01) |
| ***B01F 7/22*** | (2006.01) |
| ***B01F 15/06*** | (2006.01) |
| ***B65D 88/68*** | (2006.01) |

(52) U.S. Cl.
CPC ..... *B01F 5/10* (2013.01); *B01F 5/104* (2013.01); *B01F 5/106* (2013.01); *B01F 7/00166* (2013.01); *B01F 7/00583* (2013.01); *B01F 7/00708* (2013.01); *B01F 7/00766* (2013.01); *B01F 7/00791* (2013.01); *B01F 7/00866* (2013.01); *B01F 7/00975* (2013.01); *B01F 7/18* (2013.01); *B01F 7/22* (2013.01); *B01F 15/068* (2013.01); *B65D 88/68* (2013.01)

(58) Field of Classification Search
CPC ..... B01F 5/104; B01F 5/106; B01F 7/00166; B01F 7/00583; B01F 7/00708; B01F 7/00766; B01F 7/00791; B01F 7/00866; B01F 7/00975; B01F 7/18; B01F 7/22; B01F 15/068; B65D 88/06
USPC ..... 366/76.3, 156.1
See application file for complete search history.

(56) References Cited

U.S. PATENT DOCUMENTS

| | | | | |
|---|---|---|---|---|
| 5,308,562 | A * | 5/1994 | Wohlfahrt-Laymann | B29B 7/7461 159/2.2 |
| 5,527,108 | A * | 6/1996 | Miller | B01F 7/0065 366/157.3 |
| 2004/0234677 | A1* | 11/2004 | Sato | B01F 7/00208 427/11 |
| 2006/0228439 | A1* | 10/2006 | James | B01F 3/1271 425/542 |
| 2010/0044908 | A1* | 2/2010 | Ishibashi | B01D 63/02 366/241 |

FOREIGN PATENT DOCUMENTS

| | | |
|---|---|---|
| JP | S51 139163 A | 12/1976 |
| JP | S60 71336 | 5/1985 |
| JP | 62-151936 | 9/1987 |
| JP | S 62-151936 | 9/1987 |
| JP | 3-119425 | 12/1991 |
| JP | H07 328407 A | 12/1995 |
| JP | 9-276674 | 10/1997 |
| JP | 10-15369 | 1/1998 |
| JP | 2001-55588 | 2/2001 |
| JP | 2002-45670 | 2/2002 |
| JP | 2002-361299 | 12/2002 |
| JP | 2003-181254 | 7/2003 |
| JP | 2007-29822 | 2/2007 |
| JP | 2007-117886 | 5/2007 |
| JP | 2008-238005 | 10/2008 |

OTHER PUBLICATIONS

JP Office Action for JP Application No. 2012-557788 dated Nov. 11, 2014.
Extended European Search Report for corresponding EP Application No. 11858615.5 dated Jan. 3, 2018.

* cited by examiner

TANK APPARATUS, A SYSTEM FOR DISPERSING BY CIRCULATING A MIXTURE, AND A METHOD FOR DISPERSING BY CIRCULATING A MIXTURE

TECHNICAL FIELD

The present invention relates to an apparatus comprising a tank, a feeder, etc., (hereafter, "a tank apparatus") that supplies to, and disperses powdery additives in, a raw material that is slurry or liquid, a system for dispersing by circulating a mixture that uses the tank apparatus, and a method for supplying to, and dispersing powdery additives in, a raw material that is slurry or liquid.

BACKGROUND ART

Conventionally, a vibratory feeder, a screw feeder, a table feeder, a rotary feeder, etc., are used for a device for supplying powdery additives to raw liquid materials. For example, as disclosed in Japanese Patent Laid-open Publication No. 2001-55588, such a device is located on a tank that stores raw liquid material and has an agitator so that the supplied powdery additives and the raw liquid materials are dispersed by the agitator.

However, since the powdery additives that are discharged from the device to the tank freely fall to the surface of the liquid by means of gravity, they scatter in the tank while they fall, to then adhere on the inner face of the tank. This is a problem. When the powdery additives fall to the surface of the liquid, droplets spread so that the powdery additives or raw liquid materials adhere to the inner face of the tank. Thus problems arise where the ratio of the blend of a product (a mixture of the raw liquid materials and the powdery additives) varies and where removing fixed objects becomes difficult after the raw liquid materials and the powdery additives that adhere to the inner face dry and become hard on the face.

Further, if the powdery additives are fine powder, they may drift on the surface of the liquid without mixing with the liquid, or may agglutinate. Thus problems arise where no dispersion can be achieved or a piping or a discharging port is clogged. A countermeasure may be to generate a flow in the liquid to encourage dispersion of the powdery additives in the liquid. But this countermeasure is unusable for a liquid that has a high viscosity. Further, if the viscosity is high, it is also a problem that a long time is needed to expel air from the mixture after the dispersing process. For powdery additives that contain much air, since the bulk density of them is low, the rate for supplying them cannot be increased. This is also a problem.

DISCLOSURE OF INVENTION

The object of the present invention is to provide a tank apparatus, a system for dispersing by circulating a mixture, and a method for dispersing by circulating a mixture, to prevent a powdery material from adhering to the inner surface of the tank and from scattering in a space in the tank. Thus drifting of the powdery additiveson the surface of the liquid and agglutination of the powdery additives can be avoided, to thereby achieve an appropriate and efficient dispersion.

The tank apparatus of the present invention stores a raw material that is slurry or liquid and supplies powdery additives to the raw material to mix them with the raw material.

The tank apparatus comprises a tank for storing the raw material and a screw-type device for supplying the powdery additives that is integral with the tank and supplies the powdery additives to the raw material in the tank. The tip of a portion for supplying the powdery additives of the screw-type device for supplying the powdery additives is inserted into the mixture in the tank.

The system for dispersing by circulating the mixture of the present invention comprises the tank apparatus, a continuous dispersing device for dispersing the mixture, wherein the outlet of the continuous dispersing device is connected to the tank apparatus, a pump for circulating the mixture, and a piping for connecting in series the dispersing device, the tank apparatus, and the pump for circulation. The mixture is circulated to be dispersed in the system.

The method for dispersing of the present invention is to store a raw material that is slurry or liquid in a tank of a tank apparatus and to supply powdery additives to be mixed with the raw material for dispersion. The additives are supplied to the raw material in the tank to be dispersed while the tip of the portion for supplying the powdery additives of the screw-type device for supplying the powdery additives that is integral with the tank is inserted into the mixture in the tank.

By the present invention, an appropriate and efficient dispersion can be achieved, since the powdery additives are prevented from adhering to the inner face of the tank, from scattering in the tank, from drifting on the surface of the liquid, and from agglutinating.

The basic Japanese patent application, No. 2011-032382, filed Feb. 17, 2011, is hereby incorporated by reference in its entirety in the present application.

The present invention will become more fully understood from the detailed description given below. However, the detailed description and the specific embodiments are only illustrations of desired embodiments of the present invention, and so are given only for an explanation. Various possible changes and modifications will be apparent to those of ordinary skill in the art on the basis of the detailed description.

The applicant has no intention to dedicate to the public any disclosed embodiment. Among the disclosed changes and modifications, those which may not literally fall within the scope of the present claims constitute, therefore, a part of the present invention in the sense of the doctrine of equivalents.

The use of the articles "a," "an," and "the" and similar referents in the specification and claims are to be construed to cover both the singular and the plural, unless otherwise indicated herein or clearly contradicted by the context. The use of any and all examples, or exemplary language (e.g., "such as") provided herein is intended merely to better illuminate the invention, and so does not limit the scope of the invention, unless otherwise stated.

BEST MODE FOR CARRYING OUT THE INVENTION

Below, with reference to the drawings, the shear-type dispersing device that is used for the system for dispersing by circulating the mixture of the present invention is described. The shear-type dispersing device, which is discussed below, disperses a slurry mixture ("dispersing solids and a liquid" or "making slurry") by circulating the mixture, or disperses a liquid mixture ("dispersing one liquid and another liquid" or "emulsifying") by circulating the mixture. Incidentally, the term "dispersing" denotes to disperse substances in the mixture, i.e., mixing substances in the mixture so that they are substances uniformly mixed.

Figure 1:
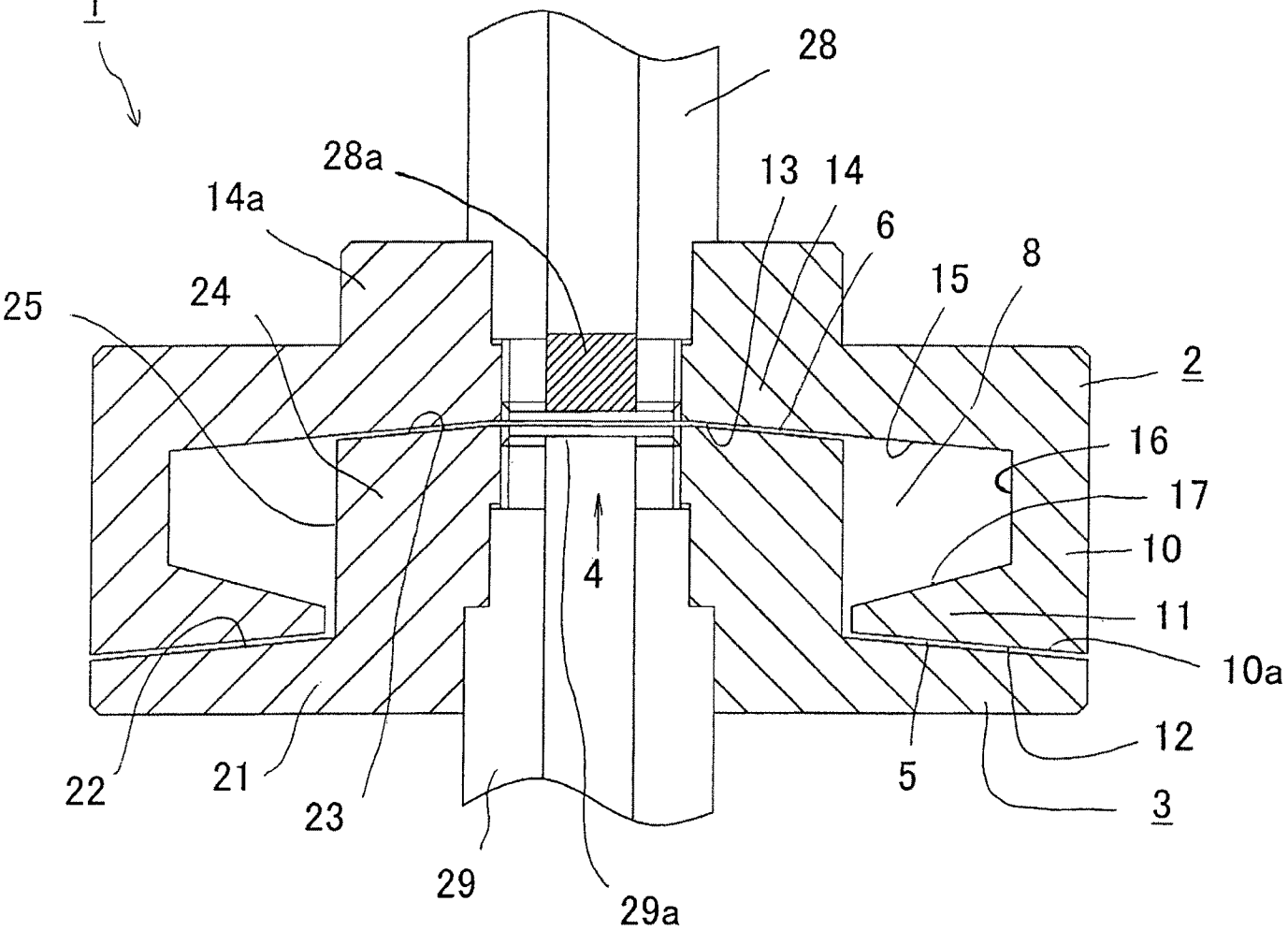
FIG. 1 is a schematic and sectional illustration of the shear-type dispersing device (which acts by imparting shearing energy to the mixture) that is used for the system for dispersing by circulating the mixture of the present invention.

The shear-type dispersing device (hereafter, "dispersing device") as shown in FIG. 1 is discussed. The dispersing device 1 comprises a rotor 2 and a stator 3 that is a member that faces the rotor 2. By having the slurry or liquid mixture 4 pass toward the outer circumference between the rotor 2 and the member (the stator 3) that faces the rotor by centrifugal force, the mixture 4 is dispersed.

The dispersing device 1 comprises a first gap 5 and a second gap 6, which are a plurality of gaps, and a buffer 8. The plurality of the gaps (the first and second gaps 5, 6) are formed between the rotor 2 and stator 3 so as to lead the mixture 4 that is supplied to the center of the shaft toward the outer circumference. In other words, the plurality of the gaps are formed between the faces of the rotor and the member that faces the rotor and radially lead the mixture from the center to the outer circumference. The first gap 5 is located near the outer circumference and the second gap 6 is located near the center of rotation. The plurality of the gaps are formed at different positions in the axial direction so as to form the buffer 8, etc. They are located on respective faces of the rotor 2 and the stator 3, which faces face each other. The buffer 8 is configured to connect the gap (the first gap 5) that is located nearest the outer circumference to the gap (the second gap 6) that is located at the inner-circumferential side of it, so as to store the mixture 4. The wall 10 that forms the buffer 8 at the outer-circumferential side is provided in the rotor 2.

The wall 10, which forms the buffer 8 that is located near the outer circumference in the rotor 2, has an overhang 11 at an end portion 10*a* that faces the member (the stator 3) that faces the rotor 2, which overhang extends toward the center of rotation. The rotor 2 has flat faces 12, 13 for forming the gaps so as to form the first and second gaps 5, 6, respectively. Specifically, the rotor 2 has a rotor body 14, which is integral with a rotating shaft 28, and the wall 10, which is provided to stand from the outer circumference of the rotor body 14 toward the stator 3. The rotor body 14 is shaped to be a circular plate. It has a portion 14*a* to be fixed to the rotating shaft 28. For example, screws are formed on the inner surface of the rotor body 14 and the outer surface of the rotating shaft 28 to be tied together. The face 13 for forming the gap, which face forms the second gap 6, is provided at the inner-circumferential side on the face of the rotor body 14, which faces the stator 3. The outer-circumferential side of the face for forming the gap 13 constitutes a face 15 for forming the buffer that is an upper face of the buffer 8. The face 15 for forming the buffer is, in this figure, provided on the same plane as the face 13 for forming the gap. The inner side of the wall 10 acts as a face 16 for forming the buffer that constitutes the outer-circumferential face of the buffer 8. The overhang 11, which is connected to the wall 10, has a face 12 for forming the first gap 5 on the side that faces the stator 3. It has, on the opposite side, a face 17 for forming the buffer that is the bottom face of the buffer 8.

The stator 3 has flat faces 22, 23 for forming the gap to form the first and second gaps 5, 6, respectively. Specifically, the stator 3 is integral with a shaft-like member 29. It comprises a circular stator body 21 and a vertical wall 24 that stands toward the rotor 2 at the inner circumference of the stator body 21. Screws are formed on the inner surface of the vertical wall 24 and the outer surface of the shaft-like member 29 to be fixed. A face 23 for forming the gap that forms the second gap 6 is provided on the face of the vertical wall 24 that faces the rotor 2. The outer-circumferential side of the vertical wall 24 acts as the face 25 for forming the buffer, which is an inner face of the buffer 8. A face 22 for forming the gap that forms the first gap 5 is provided on the face of the outer circumferential portion of the stator body 21, which face faces the rotor 2.

The plurality of the gaps have the relationship where the gap that is located at the outer-circumferential side is smaller than the gap that is located at the inner-circumferential side. That is, the faces 12, 13, 22, 23 for forming the gap are formed so that the clearance at the first gap 5 is smaller that of the second gap 6. The respective clearances of the first and second gaps 5, 6 are 2 mm or less (0.01-2.00 mm). They are formed between the rotor 2 and the stator 3.

The rotor 2 and the member (the stator 3) that faces the rotor 2 are positioned to be aligned with the rotating shaft of the rotor 2 in the vertical direction. The member (the stator 3) that faces the rotor 2 is located under the rotor 2. The dispersing device 1 can improve the yield ratio in the dispersing process, since the mixture that is left in the apparatus (especially the buffer 8) after the process can be discharged without disassembling the apparatus.

The member that faces the rotor 2 (the stator 3) is formed so that the parts that form the first and second gaps 5,6 incline downwardly as they become close to the outer circumference. In the similar way, the rotor 2 is formed so that the parts that form the first and second gaps 5,6 incline downwardly as they become close to the outer circumference. That is, the faces 12, 13, 22, 23 for forming the gap and the first and second gaps 5, 6 are inclined downwardly as they become close to the outer circumference. The upper face of the overhang 11 is inclined downwardly as it becomes close to the center. The dispersing device 1 can improve the yield ratio in the dispersing process, since the mixture that is left in the apparatus after the process ends can be discharged without disassembling the apparatus. It is especially useful when the mixture is a slurry that has a high viscosity.

The shaft-like member 29 of the stator 3 is equipped with a port 29*a* for supplying the mixture 4. Specifically, the shaft-like member 29 is shaped as a cylinder (a pipe-shape) so that the mixture 4 is supplied through its inner space. The rotating shaft 28 of the rotor 2 is shaped as a cylinder, and the occlusion 28*a* is formed at the end of the rotating shaft 28. The structure of the rotor and stator is not limited to it. A port for supplying the mixture 4 should be provided at either the rotor 2 or the member that faces the rotor 2 (the stator 3), or both. By providing the ports for supplying the mixture to both the rotor and the stator, different kinds of materials may be supplied to be mixed by, and dispersed in, the apparatus. However, if a slurry mixture that has a high concentration of solids (hereafter, "a high concentration") is to be processed, and if the durability of a sealing member is low, the structure where the mixture is supplied from the port 29*a* that is provided at the center of the stator 3, as in FIG. 1, is advantageous. That is, to supply the mixture 4 through the port 29*a*, a piping for supplying the mixture, such as a hose, is connected to the shaft-like member 29. If the port for supplying is provided to the rotor, a joint (a rotary joint) must be connected to the piping for supplying the mixture. It is highly possible that the sealing member for connecting the joint may deteriorate if the slurry mixture has a high concentration. If the sealing function were lost, a leakage would occur. By providing the port 29*a* to the stator 3, no rotary joint is needed. Thus the problem of a leakage being generated is advantageously prevented.

The dispersing process that is carried out by the dispersing device 1 is now described. First, in the mixture that has been supplied from the port 29*a* an agglutinated substance of coarse particles is crushed when they pass through the second gap 6. The mixture that has passed through the second gap 6 flows into the buffer 8 and accumulates there by being pressed against the wall 10 by centrifugal force. Particles in the mixture in the buffer 8 that are coarse and have a great mass are rasped as they are selectively pressed by centrifugal force against the wall 10 of the face 16 for forming the buffer, since the wall 10, which is a part of the rotor 2, rotates. Thus the agglutinated substance is dissolved and dispersed. Small particles are introduced to the first gap 5 while they are transported by the flow that is discharged from the buffer 8. Since the clearance of the first gap 5 is smaller than that of the second gap 6, they are further dissolved, to become smaller.

In the buffer 8 the dispersion of the particles can be efficiently controlled by adjusting the speed that the rotor 2 rotates so as to change the centrifugal force, or by adjusting the flow of the mixture into it. For example, to suppress dispersing, the speed of the rotor 2 is decreased to reduce the centrifugal force and shearing force. Alternatively, by increasing the flow of the mixture into the device 1, the mixture flows from the second gap 6 to the buffer 8 at a high speed and a large amount. Thus it violently mixes with the mixture that has accumulated there so that the duration when the mixture remains in the buffer 8 is shortened. Thus coarse particles are suppressed to move by centrifugal force to the outer circumference wall (the wall 10) of the buffer 8. Shortening the duration when the mixture remains in the buffer 8 causes the duration when the particles receive shearing energy become short, to thereby have an effect to suppress the dispersion. On the contrary, to promote the dispersion the speed of the rotor 2 is increased to strengthen the centrifugal force and shearing force. Alternatively, by decreasing the flow of the mixture to be supplied to the device 1 (the discharge of the pump), the flow into the device 1 is reduced so as to increase the centrifugal force or increase the time that the particles receive shearing energy.

The dispersing device 1 achieves a local dispersion by a shearing force that is generated when the mixture 4 passes through the first gap 5 and the second gap 6 and a dispersion where the mixture 4 becomes uniform while it accumulates in the buffer 8. In addition, the dispersing device 1 achieves the dispersion by rasping the mixture 4. The mixture 4 is pressed against the wall 10 of the rotor 2 at the outer-circumferential side of the buffer 8 by the centrifugal force that is generated in the mixture 4 that has accumulated in the buffer 8. The buffer 8 is connected to the first gap 5, which is located at the outer-circumferential side of the dispersing device 1. As can be seen, the dispersing device 1 achieves an efficient and proper dispersion.

Figure 2:
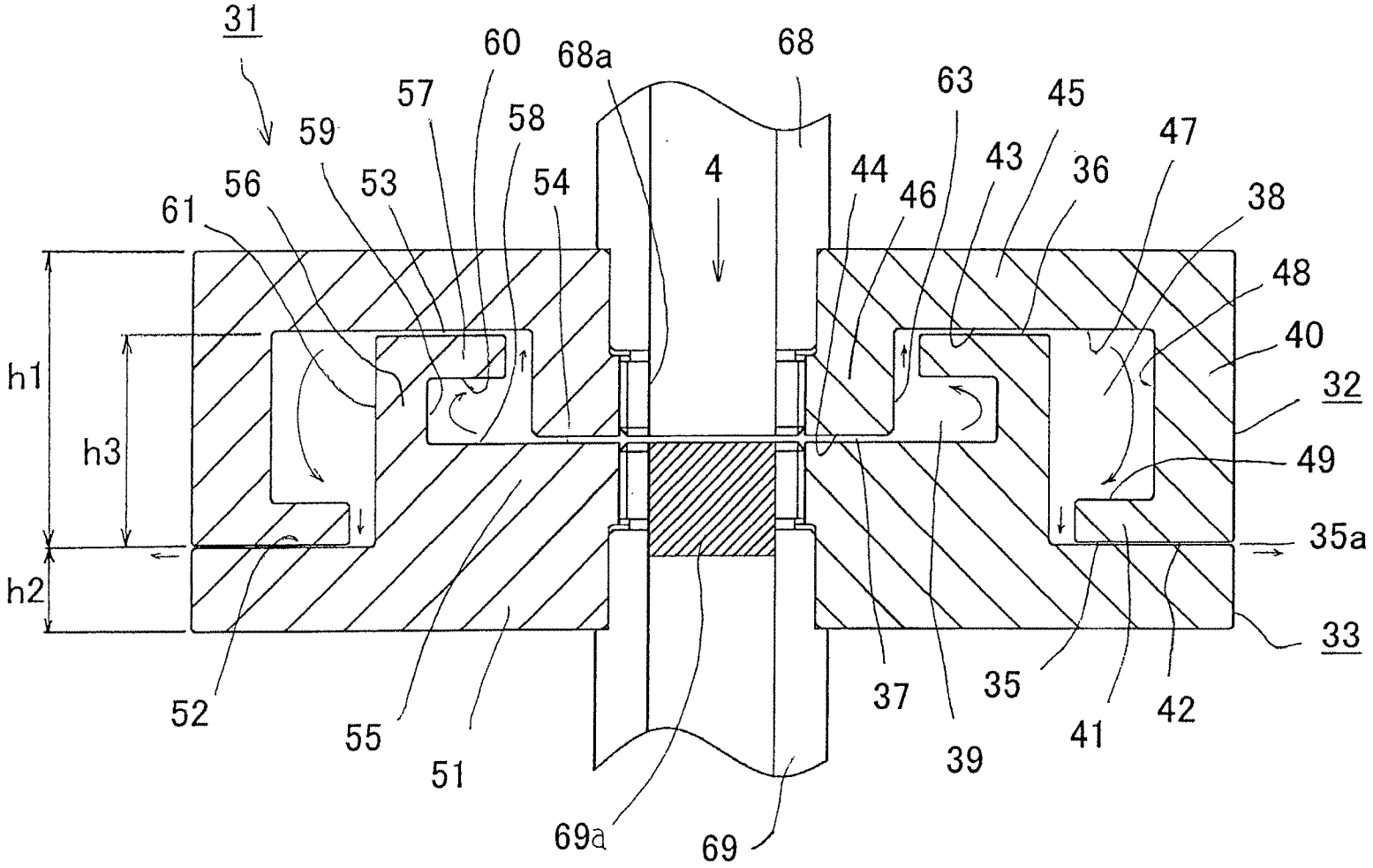
FIG. 2 is a schematic and sectional illustration of another embodiment of the shear-type dispersing device.
Figure 3:
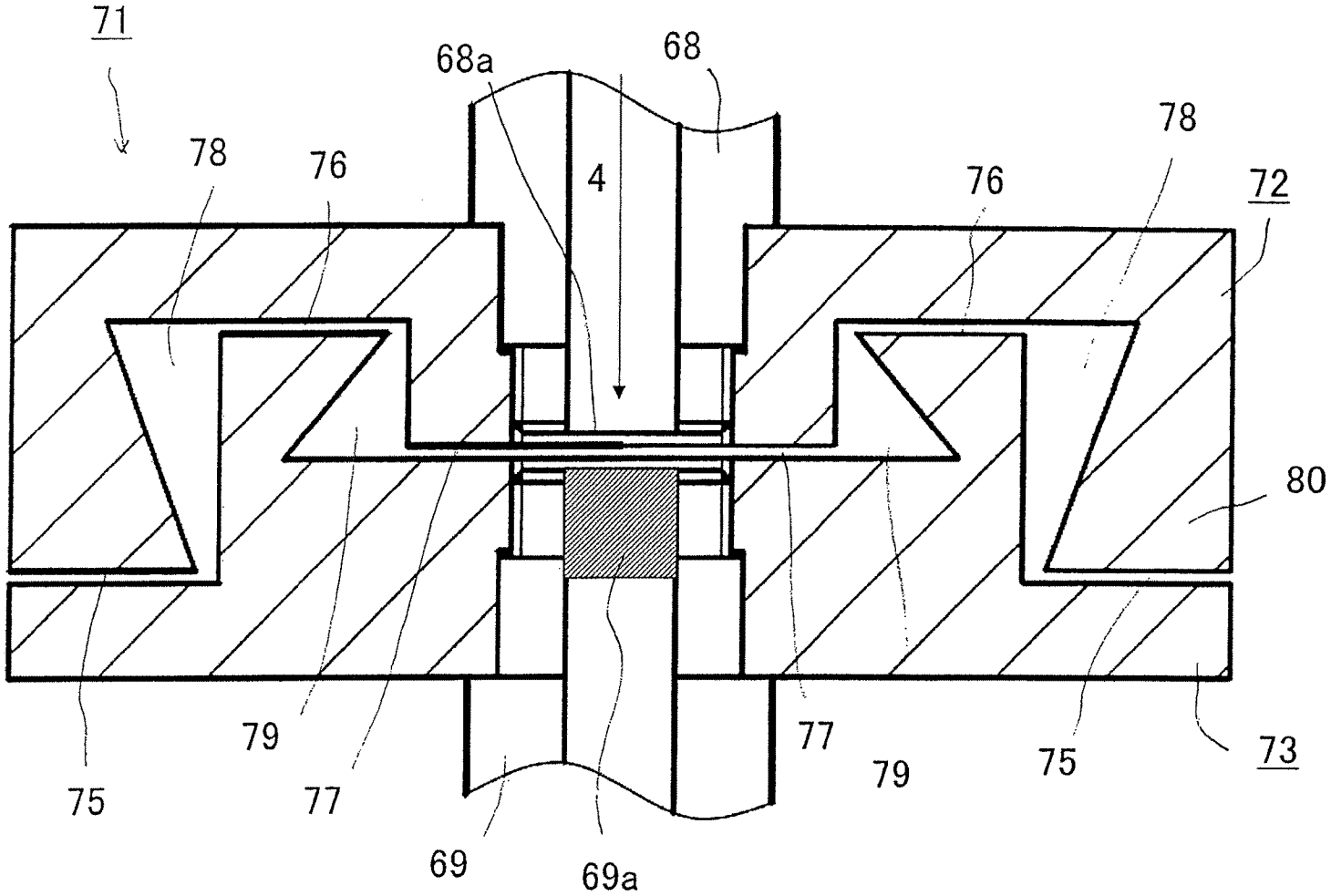
FIG. 3 is a schematic and sectional illustration of another embodiment of the shear-type dispersing device.

Further, the dispersing device 1 as shown in FIG. 1 does not have a buffer to store the materials when the rotor stops rotating. The buffer is provided to the dispersing devices as shown in FIGS. 2 and 3, which are discussed below. Further, since slopes for causing the mixture to flow downwardly out of the device by gravity are provided in the first and second gaps 5, 6, the material can be discharged from the device 1 when the process is completed, so as to increase the yield ratio.

Figure 6:
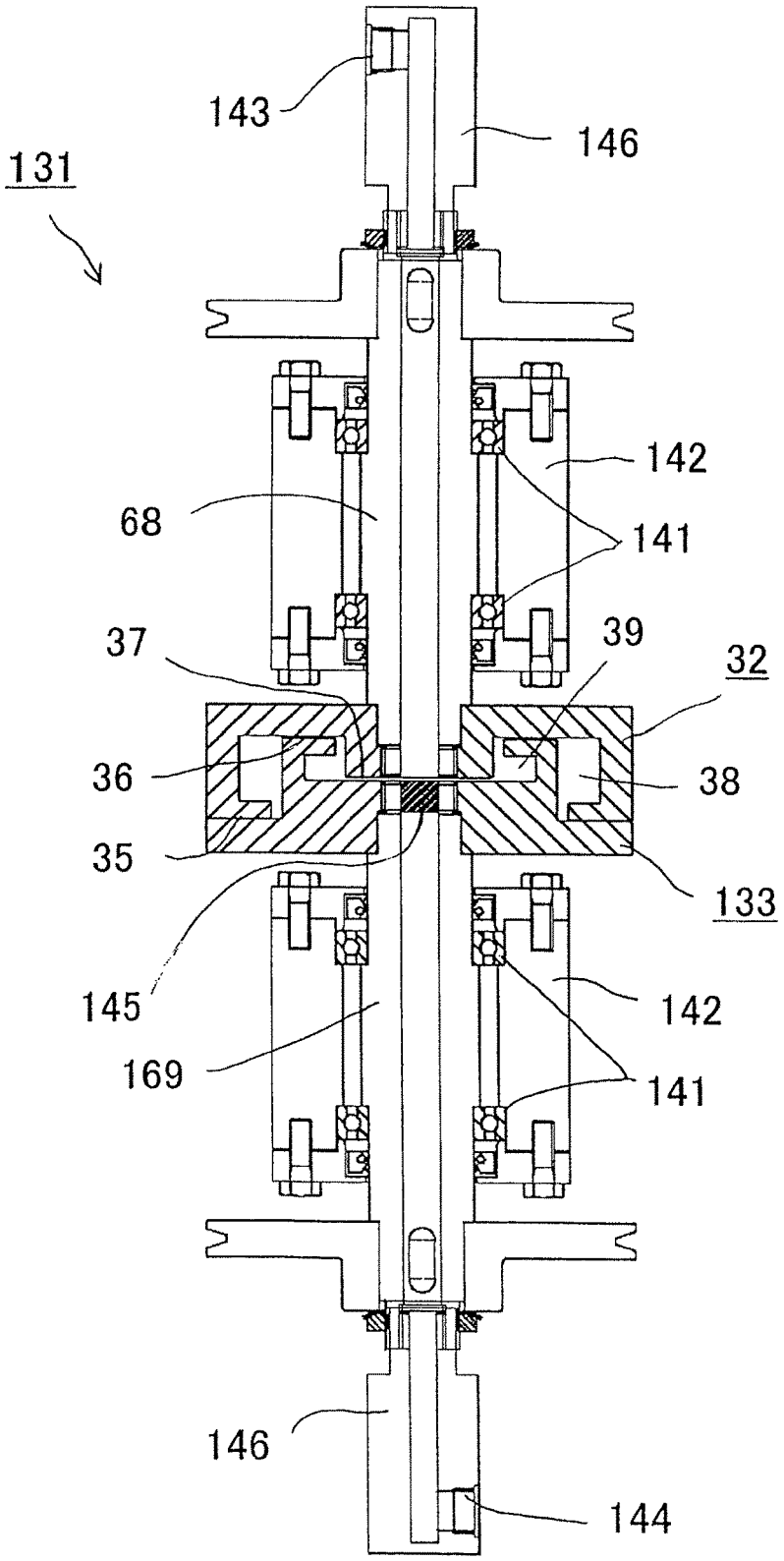
FIG. 6 is a sectional illustration of a specific structure of the shear-type dispersing device as in FIG. 2, wherein the stator is replaced by a rotor.
Figure 7:
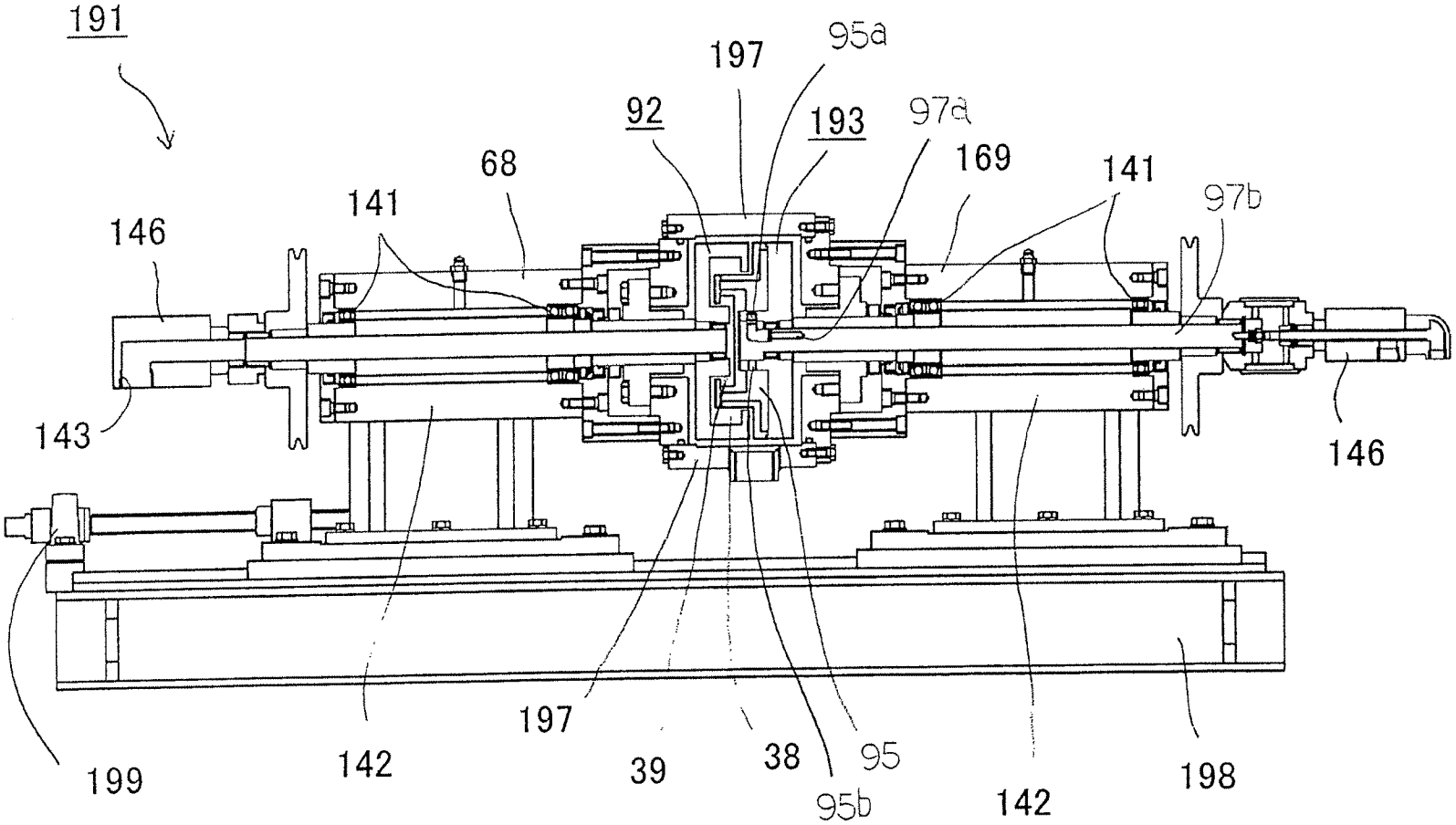
FIG. 7 is a sectional illustration of a specific structure of the shear-type dispersing device as in FIG. 5, wherein the stator is replaced by a rotor, and wherein the rotating shaft is horizontally disposed.

The dispersing device 1 as shown in FIG. 1 has the following advantageous effects. To supply the mixture through the inside of the hollow shaft that rotates, a joint connecting a fixed part to a rotating shaft, as shown in FIGS. 6 and 7, which is discussed below, is needed. The joint may be a rotary joint. By this structure, mixing multiple kinds of raw liquid materials and dispersing them do not cause problems. However, mixing a raw liquid material and a solid material (powdery additives) and dispersing them may cause a problem for the durability of the seal in the rotary joint. In this case, the hollow shaft to which the materials are supplied is preferably a stator, which is not rotated. Incidentally, no centrifugal force is generated in the stator. If the buffer is formed in the stator, that is, the wall at the outer-circumferential side of the buffer is formed in the stator, the dispersion in the buffer is achieved. Thus, in the dispersing device 1 as shown in FIG. 1 the buffer 8 is formed in the rotor 2. That is, the wall 10 of the outer-circumferential side that forms the buffer 8 is formed in the rotor 2. The port 29*a* for supplying the mixture is formed in the stator 3, which is a lower part. Thus, the various advantageous effects that are discussed above can be achieved.

The rotating shaft of the rotor 2 is described as being vertical. However, the configuration is not limited to this. The rotor 2 and the member that faces the rotor 2 (the stator 3) may be configured so as to dispose the rotor 2 and the rotating shaft horizontally. By horizontally disposing them, the device can be installed in a place where the device that has the vertical shaft cannot be installed. However, the device that has the vertical shaft as shown in FIG. 1 is preferable in view of the yield ratio, since the mixture after being dispersed is discharged, as discussed above.

The combination of the rotor 2 and the stator 3 is discussed above. However, a pair of rotors may be used. That is, the member that faces the rotor 2 has a rotating shaft that is aligned with the rotating shaft of the rotor 2 and rotates in a direction opposite to that of the rotation of the rotor 2. That member is called a second rotor. Since the pair of rotors rotate in opposite directions, a greater shearing force can be generated at the gap by the rotation of both faces. However, for a mixture that is a slurry having a high concentration, the combination of the rotor 2 and the stator 3 is advantageous, since no adverse effect to the seal of the rotary joint is predicted, as discussed above.

The configuration of the rotor land the member that faces the rotor 2 (the stator 3) is not limited to that as in FIG. 1. The configuration where two gaps and one buffer are formed is discussed above. However, by adding one buffer, the configuration where three gaps and two buffers are formed may be used, as in FIG. 2 that is discussed below.

Next, the shear-type dispersing device 31 (hereafter, "dispersing device") as shown in FIG. 2 is discussed. The dispersing device 31 comprises a rotor 32 and a stator 33 that is a member that faces the rotor 32. By having the slurry or liquid mixture 4 pass toward the outer circumference between the rotor 32 and the member that faces the rotor 32 (the stator 33) by centrifugal force, the mixture 4 is dispersed.

The dispersing device 31 comprises a first gap 35, a second gap 36, and a third gap 37, which are a plurality of gaps, and a first buffer 38 and a second buffer 39. The plurality of the gaps (the first, second, and third gaps 35, 36, 37) are formed between the rotor 32 and stator 33 so as to lead the mixture 4 toward the outer circumference. The first gap 35 is located near the outer circumference and the third gap 37 is located near the center of rotation. The second gap 36 is located between them. The first buffer 38 is configured to connect the gap (the first gap 35) that is located nearest the outer circumference to the gap (the second gap 36) that is located at the inner-circumferential side of it, so as to store the mixture 4. The wall 40 that forms the first buffer 38 at the outer-circumferential side is provided in the rotor 32.

In the dispersing device 31 as shown in FIG. 2 the second buffer 39 is formed. The second buffer 39 is configured to connect a gap (the second gap 36) that is located at the inner-circumferential side of the gap (the first gap 35) that is located nearest the outer circumference to a gap (the third gap 37) that is located near the inner circumference. It stores the mixture 4. The second buffer 39 has a function to enhance the uniformity of the mixture so that the dispersion is improved. Further, in the dispersing device 31 the member that faces the rotor 32 (the stator 33) may be replaced by a rotor. In this case a synergetic effect caused by the second buffer 39 can be achieved. That is, if the stator 33, which is the member that faces the rotor 32, is configured to rotate as a "rotor," the second buffer 39 has a dispersing function to improve the dispersion. Like the buffer 8 and buffer 38, which are discussed above, the mixture is pressed against the wall and subject to shearing in the second buffer 39.

The wall 40 that is the outer-circumferential side to form the first buffer 38, which is formed in the rotor 32, has an overhang 41 that extends from the end of the member that faces the rotor 32 (the stator 33) toward the center of rotation. The rotor 32 has flat faces 42, 43, 44 for forming the gaps 35, 36, 37. Specifically, the rotor 32 has a rotor body 45, which is a circular plate and integral with a rotating shaft 68. It also has the wall 40, which is provided to stand from the outer circumference of the rotor body 45 toward the stator 33. It also has a vertical wall 46, which stands from the inner circumference toward the stator 33. The outer circumference of the vertical wall 46 acts as a face 63 for forming the buffer that forms an inner face of the second buffer 39. On the face of the vertical wall 46 that faces the stator 33 a face 44 for forming the gap is formed. On the face of the rotor body 45 that faces the stator 33 a face 43 for forming the gap is formed. The face 43 for forming the gap near the outer circumference forms the face 47 for forming the buffer, which is the upper face of the first buffer 38. The inner face of the wall 40 acts as the face 48 for forming the buffer, which is the outer circumferential face of the first buffer 38. On the face of the overhang 41 that faces the stator 33 a face 42 for forming the gap, which forms the first gap 35, is formed. The overhang 41 is provided to be connected to the wall 40. On the opposite face (the upper face in FIG. 2) of the overhang 41 the face 49 for forming the buffer, which is the bottom face of the first buffer 38, is formed.

The stator 33 has flat faces 52, 53, 54 for forming the first, second, and third gaps 35, 36, 37, respectively. Specifically, the stator 33 has a stator body 51, which is integral with a shaft-like member 69, and a vertical tier 55, which stands toward the rotor 32 and is provided to stand from the inner circumference of the rotor body 51 toward the rotor 32, and a wall 56, which stands toward the rotor 32 at the outer-circumference of the vertical tier 55. The stator body 51 is shaped as a circular plate. The wall 56 is a wall that forms the outer-circumferential side of the second buffer 39. The wall 56 has an overhang 57, which extends from the end near the rotor 32 to the center of rotation. On the inner face of the vertical tier 55 a face 54 for forming the gap is formed. The face at the outer-circumferential side of the face 54 for forming the gap is the face 58 for forming the buffer, which is the bottom face of the second buffer 39. The inner face of the wall 56 acts as the face 59 for forming the buffer, which is the outer circumferential face of the second buffer 39. On the face of the overhang 57 that faces the rotor 32 a face 53 for forming the gap is formed. On the opposite face (the lower face in FIG. 2) of the overhang 57 a face 60 for forming the buffer, which is the upper face of the second buffer 39, is formed. The outer circumferential face of the wall 56 acts as the face 61 for forming the buffer, which is the inner face of the first buffer 38. On the face of the stator 51 near the outer circumference a face 52 for forming the gap is formed. That face of the stator 51 faces the rotor 32. The overhangs 41, 57, which are formed in the rotor 32 and the stator 33, function to enlarge the gaps (the first and second gaps 35, 36) so as to have the mixture that is in the buffers flow around them, to thereby increase the local shearing process. The overhang 11 as in FIG. 1 has the same function.

For the plurality of gaps, the gap that is located near the outer-circumference has a smaller clearance than the gap that is located near the inner-circumference does. That is, the respective faces 42, 43, 44, 52, 53, 54 for forming the gap are formed so that the first gap 35 has a smaller clearance than the second gap 36 does, and the second gap 36 has a smaller clearance than the third gap 37 does. The respective first, second, and third gaps 35, 36, 37 have clearances that are 2 mm or less. They are formed between the rotor 32 and the stator 33. The advantageous effects obtained by this configuration are below discussed. They may have the same clearance. Even in such a configuration, the present invention achieves advantageous effects besides the effects obtained by that configuration.

For example, in the dispersing device 31 that has the rotor 32 and stator 33 that have 200 mm diameter and the heights h1, h2, h3 are, as shown in the figure, 55 mm, 16 mm, and 39.5 mm, respectively, the first, second, and third gaps 35, 36, 37, have 0.5 mm, 1.0 mm, and 1.5 mm clearances, respectively. The clearances gradually become smaller as they become closer to the outer circumference. The speed of the rotation can be adjusted to between 0-3,600 rpm by means of an inverter control. The inverter control may be arbitrarily replaced by a control that uses an electric motor, a pulley, gears, etc.

In FIG. 2 the flow of the mixture is depicted by arrows. For the sake of simplicity only one flow is shown. However, actually flows similar to it are generated in every space that is formed by the rotor 32 and the stator 33. While the rotor 32 is rotated the mixture is supplied to the rotating shaft 68 from the port 143 (see FIG. 6) of the rotary joint by means of gravity, a pump, etc. Then the mixture 4 passes through the third gap 37, the second buffer 39, the second gap 36, the first buffer 38, and the first gap 35, in this order, along the direction of the centrifugal force. It is discharged from a discharging port 35*a* for the mixture that is located at the outer circumferences of the rotor 32 and the stator 33. The discharging port 35*a* for the mixture is located at the outer-circumferential end of the first gap 35. In this way the first, second and third gaps 35, 36, 37 and the first and second buffers 38, 39 are formed between the rotor and the member that faces the rotor. The first, second and third gaps 35, 36, 37 are multiple gaps that lead the mixture in the direction toward the outer circumference. The first and second buffers 38, 39 connect the gap that is located at the outermost position to the gap that is located at the innermost position. They cause the mixture to be accumulated in them. These gaps and these buffers have the function to disperse the mixture by local shearing and by making the mixture uniform, respectively. In other words, a space is formed between the rotor and the member that faces the rotor so that the mixture flows through it from the center of rotation to the outer circumference. This space has alternately small clearances (i.e., the gaps) that are 2 mm or less and large spaces (i.e., the buffers) that are larger than the clearances. The small spaces enable local shearing and the large spaces enable an accumulation and enable the mixture to be made uniform. The flow of the mixture and the functions of the gaps and buffers in FIG. 1 and FIGS. 3 to 7, which are discussed below, are the same as in the above discussion.

The rotor 32 and the member that faces the rotor (the stator 33) are arranged so that the rotating shaft of the rotor 32 is vertical. The member that faces the rotor (the stator 33) is disposed at the lower side. In the dispersing device 31 the mixture that remains in the first buffer 38 that has a large volume can be discharged after the completion of the dispersing process without disassembling the device. Thus the yield ratio in the dispersing process can be improved.

In the member that faces the rotor (the stator 33) the portions for forming the first, second, and third gaps 35, 36, 37 are formed to be horizontal. However, they may be formed to incline downwardly as they become close to the outer circumference as shown in FIG. 1. If they are formed to incline as in FIG. 1, the mixture after being processed can be discharged and the yield ratio can be improved.

The port 68*a* for supplying the mixture 4 is provided in the rotating shaft 68 of the rotor 32. Specifically, the rotating shaft 68 is shaped as a cylinder. The mixture 4 is supplied through the inside of it. The shaft-like member 69 of the stator 33 is shaped as a cylinder. An occlusion 69*a* is formed at its end. However, the configuration is not limited to this. A port for supplying the mixture 4 from the center of rotation (of the rotor 32) must be provided at either the rotor 32 or the member that faces the rotor (the stator 33) or both of them. However, if the durability of the sealing member is low for a slurry mixture that has a high concentration of solids, etc., the port for supplying the mixture is advantageously provided at the center of the stator 33 as discussed with reference to FIG. 1.

The dispersing process that uses the dispersing device 31 is now described. The mixture is supplied from the port 68*a*. Agglutinated substances, which are coarse particles, are crushed while they pass the third gap 37, which is the first stage of the gaps. The mixture that has passed through the third gap 37 flows into the second buffer 39, which is the first stage of the buffers. It is pressed against the wall 56 by centrifugal force and accumulates in it. Next, the mixture passes through the second gap 36, which is the second stage of the gaps. During this time, agglutinated substances are crushed. Since the clearance of the second gap 36 is smaller than that of the third gap 37, they are crushed, to become smaller particles. The mixture that has passed through the second gap 36 flows into the first buffer 38, which is the second stage of the buffers. It is pressed against the wall 40 by centrifugal force and accumulates in it. Coarse particles in the mixture that accumulates in the first buffer 38 are selectively pressed by centrifugal force against the face 48 for forming the buffer of the wall 40. They are rasped by the rotating wall 40, which is a part of the rotor 32, so that agglutinated substances are crushed and dispersed. Fine particles are transported by the flow that is discharged from the first buffer 38 to be introduced to the third gap 35, which is the third stage of the gaps. Since the clearance of the first gap 35 is smaller than that of the second gap 36, they are further dissolved, to become smaller.

In the buffers dispersing the particles can be efficiently controlled by adjusting the speed of the rotor 32 so as to change the centrifugal force, or by adjusting the flow of the mixture into the buffers. For example, to suppress dispersing, the speed of the rotor 32 is decreased to reduce the centrifugal force and shearing force. Alternatively, by increasing the flow of the mixture into the device 31, the mixture flows from the third gap 37 to the second buffer 39 or from the second gap 36 to the first buffer 38 at a high speed and in a large amount. Thus it violently mixes with the mixture that has accumulated in the buffer 38 or the buffer 39 so that the time that the mixture remains there is shortened. Thus the movement of coarse particles by centrifugal force to the outer circumference walls (the walls 40, 56) of the buffers 38, 39 is suppressed. Shortening the time that the mixture remains in the buffers causes the time that the particles receive shearing energy to become short, to thereby have an effect in suppressing the dispersion. In contrast, to promote the dispersion the speed of the rotor 32 is increased to strengthen the centrifugal force and shearing force. Alternatively, by decreasing the flow of the mixture to be supplied to the device 31 (the discharge of the pump), the flow into the device 31 is reduced so as to increase the centrifugal force or increase the time that the particles receive shearing energy.

The dispersing device 31 achieves a local dispersion by a shearing force that is generated when the mixture 4 passes through the first, second, and third gaps 35, 36, 37 and a dispersion where the mixture 4 becomes uniform while it accumulates in the buffers 38, 39. In addition, the dispersing device 31 achieves the dispersion by rasping the mixture 4. The mixture 4 is pressed against the wall 40 of the rotor 32 at the outer-circumferential side of the first buffer 38 by centrifugal force that is generated in the mixture 4 that accumulates in the buffer 38. The buffer 38 is connected to the first gap 35, which is located at the outer-circumferential side of the dispersing device 31. As can be seen, the dispersing device 31 achieves an efficient and proper dispersion.

Since the dispersing device 31 has three gaps and two buffers, it achieves a further efficient dispersion in respect to the dispersion by local shearing and dispersion by making the mixture uniform.

The rotating shaft of the rotor 32 is described as being vertical. However, the configuration is not limited to this. The rotor 32 and the member that faces the rotor (the stator 33) may be configured so as to dispose the rotor 32 and the rotating shaft horizontally.

The combination of the rotor 32 and the stator 33 is discussed above. However, a pair of rotors may be used. That is, the member that faces the rotor 32 has a rotating shaft that is aligned with the rotating shaft of the rotor 32 and rotates in an opposite direction to the rotation of the rotor 32. That member is called a second rotor. If the configuration as shown in FIG. 2 is changed to that having the pair of rotors, then, since the pair of rotors rotate in opposite directions, a greater shearing force can be generated at the gap by the relative rotation. Further, since the wall 56 that forms the outer face of the second buffer 39 is rotated, the mixture is pressed against the wall so that agglutinated substances are crushed and dispersed there. Thus a further efficient and proper dispersion can be achieved.

The shapes of the buffers are not limited to the rectangles as shown in FIG. 2. For example, the outer face may incline as shown in FIG. 3. In this case, the shape becomes simpler and manufacturing them becomes easier.

Next, the shear-type dispersing device (hereafter, "dispersing device") 71 as shown in FIG. 3 is discussed. The dispersing device 71 comprises a rotor 72 and a stator 73 that is a member that faces the rotor 72. By having the slurry or liquid mixture 4 pass between the rotor 72 and the member (the stator 73) that faces the rotor by centrifugal force and toward the outer circumference, the mixture 4 is dispersed.

The dispersing device 71 comprises a first gap 75, a second gap 76, and a third gap 77, which are a plurality of gaps, and a first buffer 78 and a second buffer 79. The plurality of gaps (the first, second, and third gaps 75, 76, 77) are formed between the rotor 72 and stator 73 so as to lead the mixture 4 toward the outer circumference. The first gap 75 is located near the outer circumference and the third gap 77 is located near the center of rotation. The second gap 76 is located between them. The first buffer 78 is configured to connect the gap (the first gap 75) that is located nearest the outer circumference to the gap (the second gap 76) that is located at the inner-circumferential side of it, so as to store the mixture 4. The wall 80 that forms the first buffer 78 at the outer-circumferential side is provided in the rotor 72.

In the dispersing device 71 as shown in FIG. 3 the second buffer 79 is formed. The second buffer 79 is configured to connect a gap (the second gap 76) that is located at the inner-circumferential side of the gap (the first gap 75) that is located nearest the outer circumference and a gap (the third gap 77) that is located near the inner circumference. It stores the mixture 4. The second buffer 79 has a function to enhance the uniformity of the mixture so that the dispersion is improved. Further, in the dispersing device 71 the member that faces the rotor 72 (the stator 74) may be replaced by a rotor. In this case the synergetic effect caused by the outer face of the second buffer 79 that rotates can be achieved, since the mixture is pressed against the wall and rasped in the second buffer 39 so that the agglutinated substances are crushed and dispersed.

For the plurality of gaps, the gap that is located near the outer-circumference has a smaller clearance than the gap that is located near the inner-circumference does. That is, the respective faces for forming the gaps are formed so that the first gap 75 has a smaller clearance than the second gap 76 does, and the second gap 76 has a smaller clearance than the third gap 77 does. The respective first, second, and third gaps 75, 76, 77 have a clearance that is 2 mm or less. They are formed between the rotor 72 and the stator 73. The dispersing process by using the dispersing device 71 is similar to that by using the dispersing device 61 as shown in FIG. 2. Thus its description is omitted.

The dispersing device 71 achieves a local dispersion by a shearing force that is generated when the mixture 4 passes through the first, second, and third gaps 75, 76, 77 and a dispersion where the mixture 4 becomes uniform while it accumulates in the buffers 78, 79. In addition, the dispersing device 71 is able to dissolve and disperse the agglutinated substances by rasping the mixture 4. The mixture 4 is pressed against the wall 80 of the rotor 72 at the outer-circumferential side of the first buffer 78 by centrifugal force that is generated in the mixture 4 that accumulates in the buffer 78. The buffer 78 is connected to the first gap 55, which is located at the outer-circumferential side of the dispersing device 71. As can be seen, the dispersing device 71 achieves an efficient and proper dispersion.

The configurations as in FIGS. 1, 2, and 3 have three or two gaps that generate shearing forces and two buffers or one buffer. However, the configuration is not limited to them. The number of gaps and the number of buffers may be arbitrarily chosen based on the raw material to be processed or the intended degree of dispersion.

In the dispersing devices 1, 31, and 71 as shown in FIGS. 1, 2, and 3, respectively, a portion for flowing the refrigerant liquid that cools the mixture that flows between the rotor and the member that faces the rotor may be provided to either the rotor or the member that faces the rotor or both of them. The mixture produces heat because a great shearing force is applied to it while it passes through the pair of rotors or the rotor and stator, or it is rasped with the inner face of the buffers when it accumulates in the buffers. That heating would cause a problem for a mixture that is transformed when it is heated. The portion for flowing the refrigerant liquid is provided, that is, jacket-type structures are made in the rotor and stator, to have the refrigerant liquid pass through the jacket. The refrigerant liquid is supplied from inside the hollow shaft or a piping that is separately installed. Thus the heat that is produced can be cooled.

Figure 4:
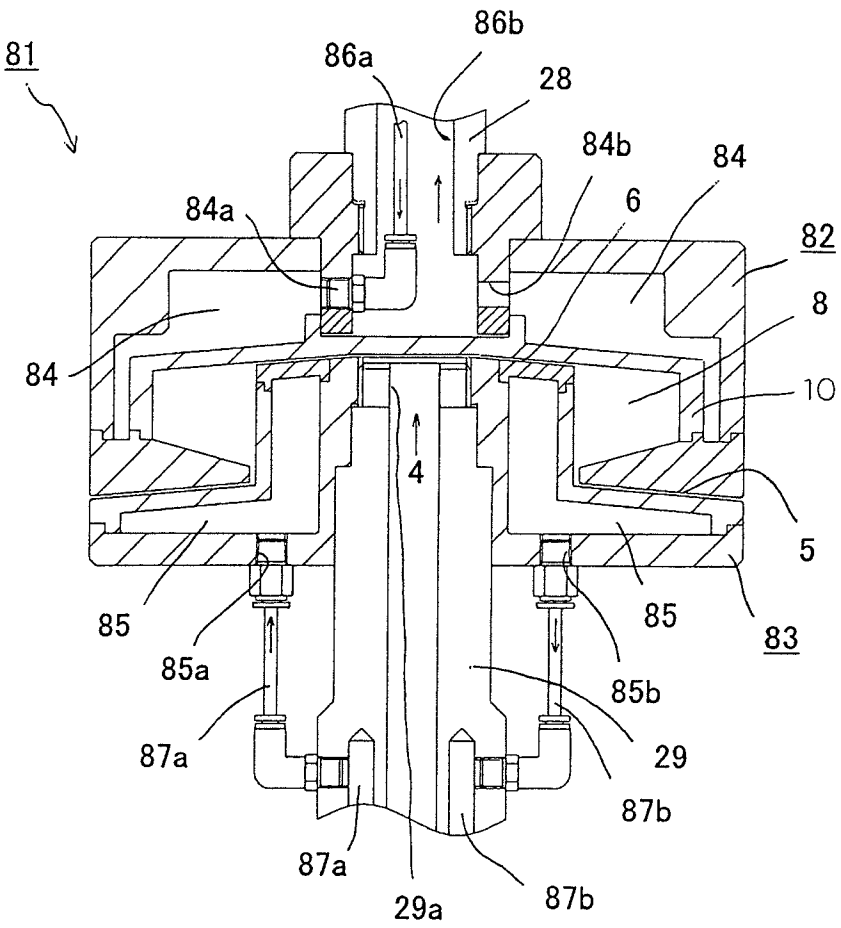
FIG. 4 is a schematic and sectional illustration of a variation of the shear-type dispersing device as in FIG. 1.
Figure 5:
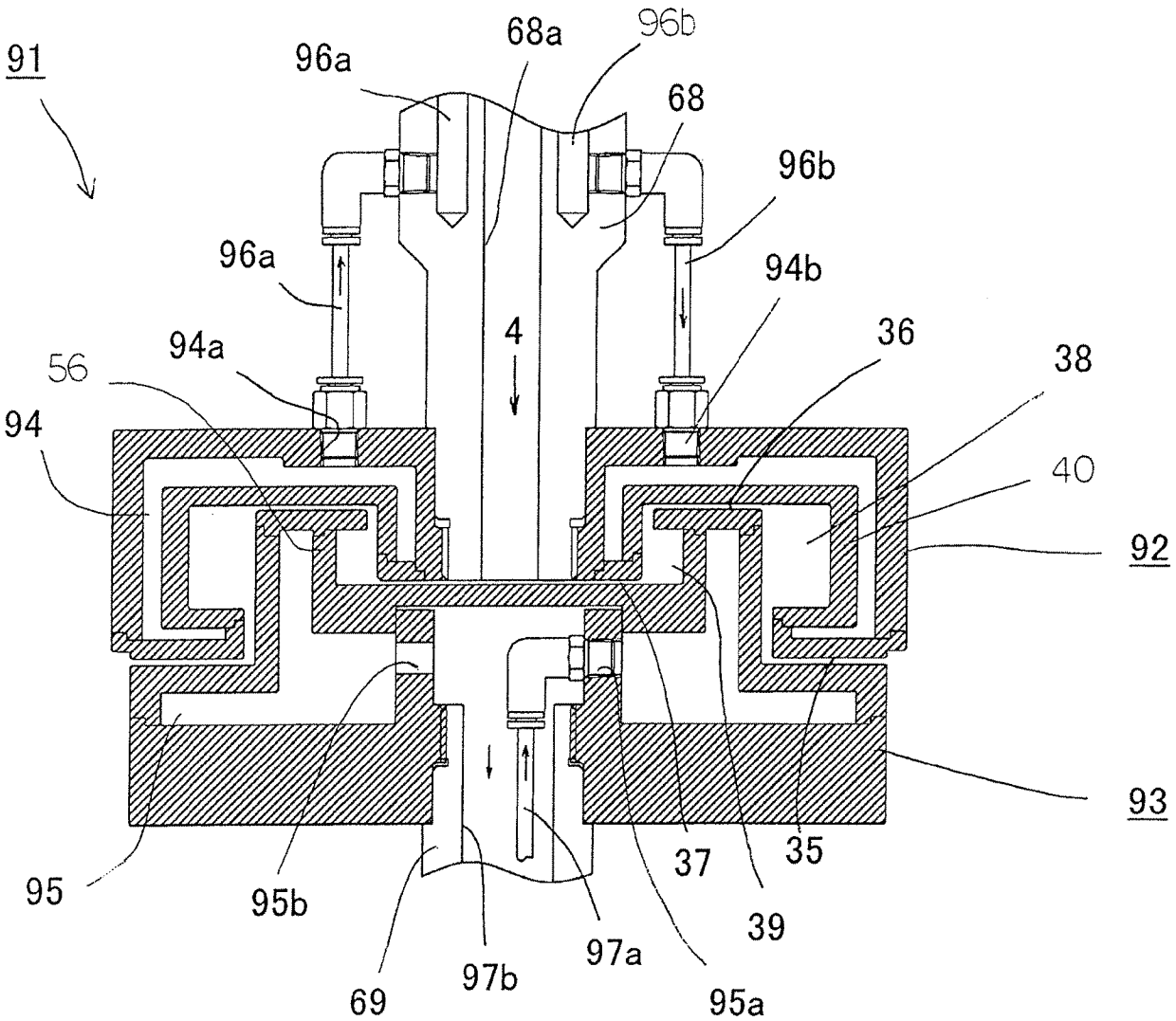
FIG. 5 is a schematic and sectional illustration of a variation of the shear-type dispersing device in FIG. 2.

Next, as examples for the configuration where the portion for flowing the refrigerant liquid is provided, a dispersing device 81 as in FIG. 4, which is a variation of the dispersing device as in FIG. 1, and a dispersing device 91 as in FIG. 5, which is a variation of the dispersing device as in FIG. 2, are discussed. Since the same configuration and function as in the description in relation to FIGS. 1 and 2 are used except for providing the portion for flowing the refrigerant liquid, the same reference numbers are used for the same elements, and so the description of them is omitted (the same applies to other figures).

The dispersing device 81 as in FIG. 4 has the rotor 82 and stator 83, which have the same configuration as the rotor 2 and the stator 3 as in FIG. 1, except that portions 84, 85 for flowing the refrigerant liquid are provided. A slurry or liquid mixture 4 is dispersed by having it pass between the rotor 82 and the member that faces the rotor (the stator 83) and toward the outer circumference by centrifugal force. That is, the first and second gaps 5, 6, the buffer 8, the wall 10, etc., are formed in the rotor 82 and stator 83.

The rotor 82 is equipped with a portion 84 for flowing the refrigerant liquid, a portion 84*a* for supplying the refrigerant liquid, and a portion 84*b* for discharging the refrigerant liquid. The portion 84*a* for supplying the refrigerant liquid and the portion 84*b* for discharging the refrigerant liquid are connected to a pipe 86*a* for supplying the refrigerant liquid and a pipe 86*b* for discharging the refrigerant liquid, respectively. The stator 83 is equipped with a portion 85 for flowing the refrigerant liquid, a portion 85*a* for supplying the refrigerant liquid, and a portion 85*b* for discharging the refrigerant liquid. The portion 85*a* for supplying the refrigerant liquid and the portion 85*b* for discharging the refrigerant liquid are connected to a pipe 87*a* for supplying the refrigerant liquid and a pipe 87*b* for discharging the refrigerant liquid, respectively.

Similarly, the dispersing device 91 as in FIG. 5 has the rotor 92 and stator 93, which have the same configuration as the rotor 32 and the stator 33 as in FIG. 2, except that portions 94, 95 for flowing the refrigerant liquid are provided. A slurry or liquid mixture 4 is dispersed by having it pass between the rotor 92 and the member that faces the rotor (the stator 93) toward the outer circumference by centrifugal force. That is, the first, second, and third gaps 35, 36, 37, the first and second buffers 38, 39, the wall 40, etc., are formed in the rotor 92 and stator 93.

The rotor 92 is equipped with a portion 94 for flowing the refrigerant liquid, a portion 94*a* for supplying the refrigerant liquid, and a portion 94*b* for discharging the refrigerant liquid. The portion 94*a* for supplying the refrigerant liquid and the portion 94*b* for discharging the refrigerant liquid are connected to a pipe 96*a* for supplying the refrigerant liquid and a pipe 96*b* for discharging the refrigerant liquid, respectively. The stator 93 is equipped with a portion 95 for flowing the refrigerant liquid, a portion 95*a* for supplying the refrigerant liquid, and a portion 95*b* for discharging the refrigerant liquid. The portion 95*a* for supplying the refrigerant liquid and the portion 95*b* for discharging the refrigerant liquid are connected to a pipe 97*a* for supplying the refrigerant liquid and a pipe 97*b* for discharging the refrigerant liquid, respectively.

The dispersing device 81 as in FIG. 4 and dispersing device 91 as in FIG. 5 have the same effects as the dispersing device 1 as in FIG. 1 and dispersing device 31 as in FIG. 3 do. They achieve a more efficient and proper dispersion. Further, since the portions 84, 85, 94, 95 for flowing the refrigerant liquid are provided, the heat that is generated by applying a shearing force to the mixture is cooled so as to prevent the mixture from being transformed.

With reference to FIGS. 6 and 7, a specific structure that includes the bearings of the dispersing devices, etc., is now described. For FIG. 6, a variation (the dispersing device 131) where the stator 33 of the dispersing device 31 as in FIG. 2 is replaced by a rotor 133 is discussed. The configuration and shape of all portions of the rotor 133 are the same as those of the stator 33. As in FIG. 6, in the dispersing device 131 two rotors 32, 133 that have concaves and convexes are disposed to have aligned central axes of rotation and vertically face each other. The dispersing device 131 has the first, second, and third gaps 35, 36, 37 and the first and second buffers 38, 39 that have a rectangular section by combining the concaves with the convexes, like the dispersing device 31.

The pair of rotors 32, 133 are connected to the rotating shafts 68, 169, respectively. The rotating shafts 68, 169 are supported via bearings 141 by a bearing box 142 that is firmly fixed (the method for fixing is not shown). They are driven by an electric motor (not shown) that is connected to a belt, a chain, a gear, etc. They rotate in opposite directions. Now, assume that the respective rotating shafts 68, 169 rotate clockwise when being viewed from ports 143, 144 for supplying the mixture. The speed of the rotation may be arbitrarily determined based on the raw material and intended degree of dispersion. The end of the hollow rotating shaft 169 is closed by an occlusion 145 so that no mixture flows into or from the inside of the shaft 169. The ports 143, 144 for supplying the mixture are connected to the rotating shafts 68, 169 via rotary joints 146.

The occlusion 145 of the hollow rotating shaft 169 may be removed so that a different material is supplied from the port 144 for supplying the mixture to be mixed between the rotors with the material that is supplied from the port 143 for supplying the mixture. In this case a pump is needed for the port 144. The two rotating shafts 68, 169 are driven by respective electric motors. However, they may be driven by one electric motor by using gears, etc., to share the power.

A variation (the dispersing device 191) where the stator 93 of the dispersing device 91 as in FIG. 5 is replaced by a rotor 193 is configured as shown in FIG. 7. The dispersing device 191 is an example where the rotating shafts of the rotors 92, 193 are horizontally disposed. The dispersing device 191 as in FIG. 7 has the bearings 141, the bearing box 142, the port 143 for supplying the mixture, and the rotary joints 146 like those in the device shown in FIG. 6. Further, in FIG. 7 a cover 197 for the rotor that leads the processed mixture to the next step, a base 198 for an entire device, and a motor 199 for driving the rotors 92, 193, are illustrated. Though the portion 94 for flowing the refrigerant liquid is not provided to the rotor 92 in FIG. 7, it may be provided in the same way as in FIG. 5.

Since the dispersing device 131 as in FIG. 6 and the dispersing device 191 as in FIG. 7, which are examples where the stator of the dispersing devices 31, 91 as in FIGS. 2 and 5 is replaced by a rotor, show the specific structures of the bearings, etc., they have the same effects as the dispersing devices 31, 91 do. The dispersing devices as in FIGS. 1, 3, and 4 have similar bearings. For a combination of a rotor and stator as in FIGS. 1 to 5, neither the bearing 141 nor the rotary joint 146 is needed for the stator. Thus the structure is simplified.

Figure 8:
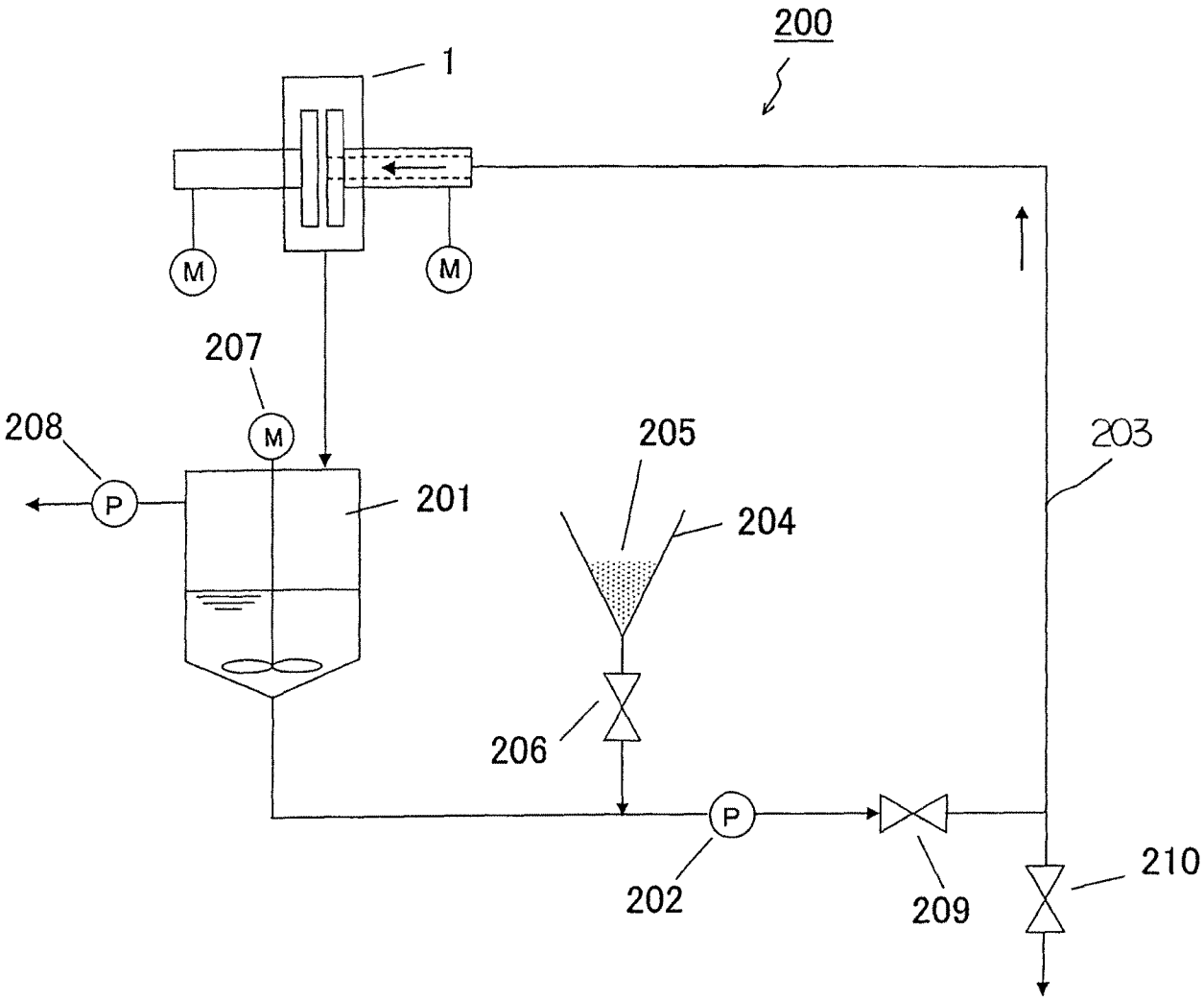
FIG. 8 is a schematic diagram illustrating the structure of the system for dispersing by circulating the mixture that uses the shear-type dispersing device as in FIG. 1, etc.

Next, with reference to FIG. 8, an embodiment of a system for dispersing by circulating the mixture that uses the dispersing device is discussed. The system 200 for dispersing by circulating the mixture as in FIG. 8 comprises a rotor-type and continuous dispersing device (any of the dispersing devices 1, 31, 71, 81, 91, 131, 191 as in FIGS. 1 to 7 that include a variation where the stator is replaced by a rotor, hereafter "dispersing device 1, etc.") that disperses the mixture 4. In the figure "M" denotes a motor. The dispersing device 1, where the stator is replaced by the rotor, is illustrated. The rotors are horizontally disposed. However, the dispersing device is not limited to this. The system 200 for dispersing by circulating the mixture also comprises a tank 201 that is connected to the outlet of the dispersing device 1, etc., a pump 202 for circulation that is connected to the outlet of the tank 201 to circulate the mixture 4, and a piping 203 that connects in series the dispersing device 1, etc., the tank 201, and the pump 202 for circulation.

The fluid that circulates in the tank 201, the dispersing device, and the piping 203 is a raw material at first. As it passes through the dispersing device, it becomes a mixture that is mixed with the additive material. Finally it becomes the mixture that has been dispersed. In this description, the "raw material" at first and the "mixture" during the process are also called the "mixture."

In the system 200 for dispersing by circulating the mixture a device 206 for supplying is provided on the piping. The device 206 for supplying injects (liquid or powdery) additives 205 that are stored in a hopper 204 into the mixture (a raw material at first) that circulates. The mixture that has been dispersed by the dispersing device 1, etc. is returned to the tank 201 by gravity. The mixture in the tank 201 is agitated by an agitator 207 so as not to segregate.

A vacuum pump 208 is connected to the tank 201. The vacuum pump 208 decompresses the inside of the tank 201 so as to assist discharging from the dispersing device 1, etc., if the amount to be discharged is little. Further, the decompression by the vacuum pump 208 acts as a defoaming action if air is mixed in the mixture.

In the system 200 for dispersing by circulating the mixture, during the operation the valve 209 is normally open and the valve 210 is normally closed. When the dispersion is finished, the valve 209 is closed and the valve 210 is opened. By so doing the processed mixture is discharged through the valve 210 and collected.

Since the system 200 for dispersing by circulating the mixture has the dispersing device 1, etc. as in FIGS. 1 to 7, an efficient and proper dispersion is carried out. Thus the dispersing function as a system as a whole is improved and the time for dispersion is shortened.

Next, an example for testing of the dispersing device is described. For this embodiment for testing the dispersion, a system 200 for dispersing by circulating a mixture is used. The system 200 uses the dispersing device 191 that has the pair of rotors 92, 193 as in FIG. 7 that are horizontally disposed. As in FIG. 8, the dispersing device 191 is connected to a tank 201, which acts as a buffer, and a pump 202 for circulating a liquid. The material for the rotor is SUS 304 (18Cr-8Ni stainless steel) as denoted by the Japanese Industrial Standards (JIS). The multistage-type rotor (hereafter, "a multistage rotor") as in FIGS. 2 and 5 is used. In the dispersing device of this example for testing, the three gaps of the rotors (the first, second, and third gaps 35, 36, 37) have the same specification, that is, the gap is about 0.39 mm. The area for shearing (the total area of the gaps) is about 271 $cm^2$. The dispersing device is installed in the system for dispersing by circulating the mixture as in FIG. 8 to repeatedly disperse the mixture. A sample of the mixture is made by adding Aerosil (a registered trademark) #200 (supplied by Aerosil Japan) to distilled water so that the weight ratio of the Aerosil is 10%. As the process for the experiment for dispersing, a predetermined amount of distilled water is poured in the tank for storing a raw material. The pump is activated to circulate the distilled water while the rotors remain stopped. Next, the tank for storing a raw material is evacuated by a vacuum pump so that the entire system is made a vacuum. The Aerosil is intermittently supplied by suctioning it into the pipe that is located between the tank for storing a raw material and the pump. When the supply of the Aerosil is completed, the raw material is considered to be in the initial state. Then, the rotor is activated, to disperse the mixture.

Figure 9:
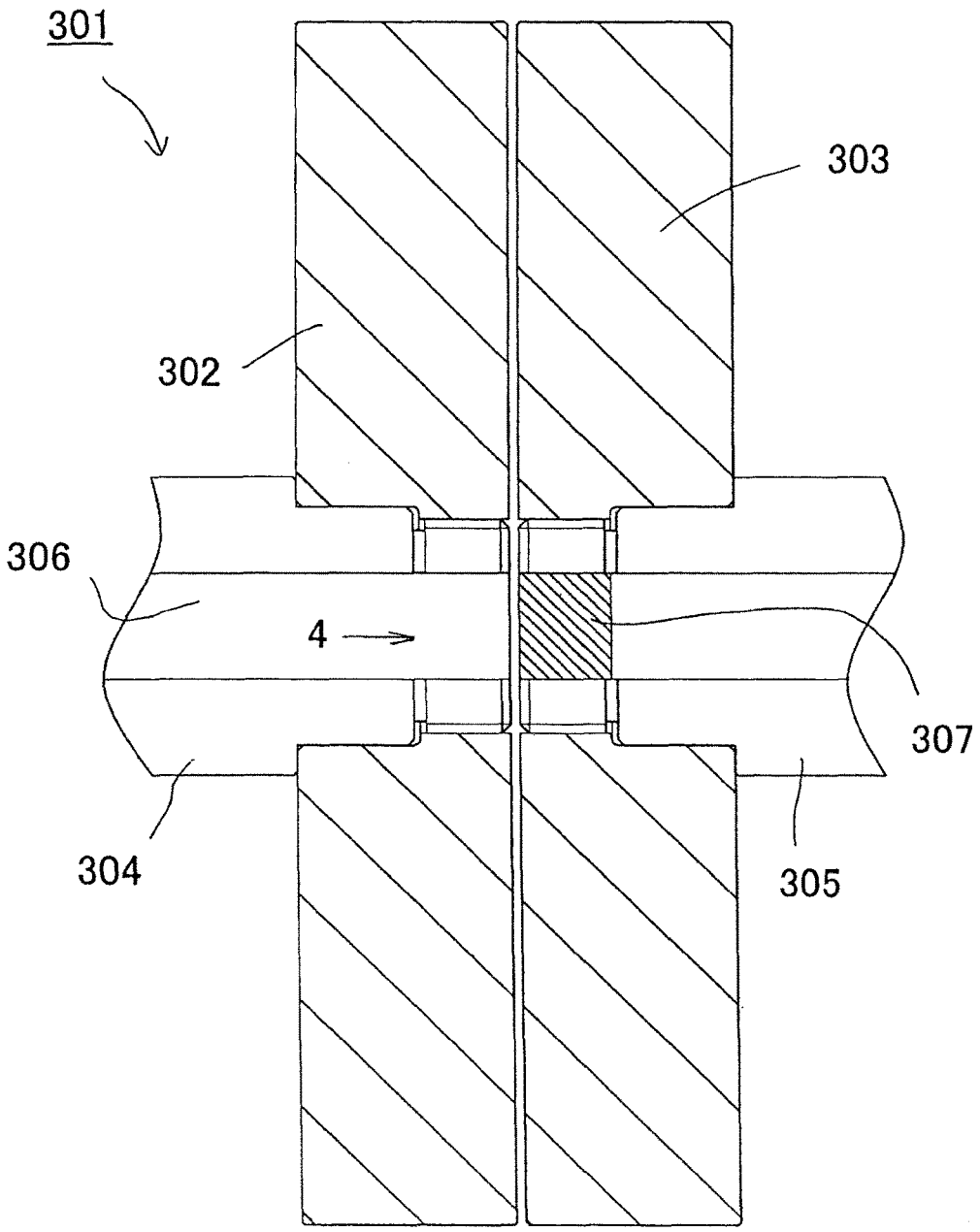
FIG. 9 is a schematic and sectional illustration of a dispersing device of a flat-rotor type, which is an example to be compared to a shear-type dispersing device of the example for testing.

For a comparative example to be compared with the example for testing, a test similar to that used in the example for testing was carried out by using a dispersing device (hereafter "a flat rotor") that has a flat shape as in FIG. 9. The flat rotor 301 has a pair of rotors 302, 303 and rotating shafts 304, 305 as in FIG. 9. A port 306 for supplying the mixture is provided to the rotating shaft 304. An occlusion 307 for closing the port is provided on the rotating shaft 305. The material for the flat rotor is SUS 304 (18Cr-8Ni stainless steel) as denoted by the JIS, as with the multistage rotor. The gap between the rotors is about 0.36 mm and the area for shearing is about 304 $cm^2$.

Figure 10:
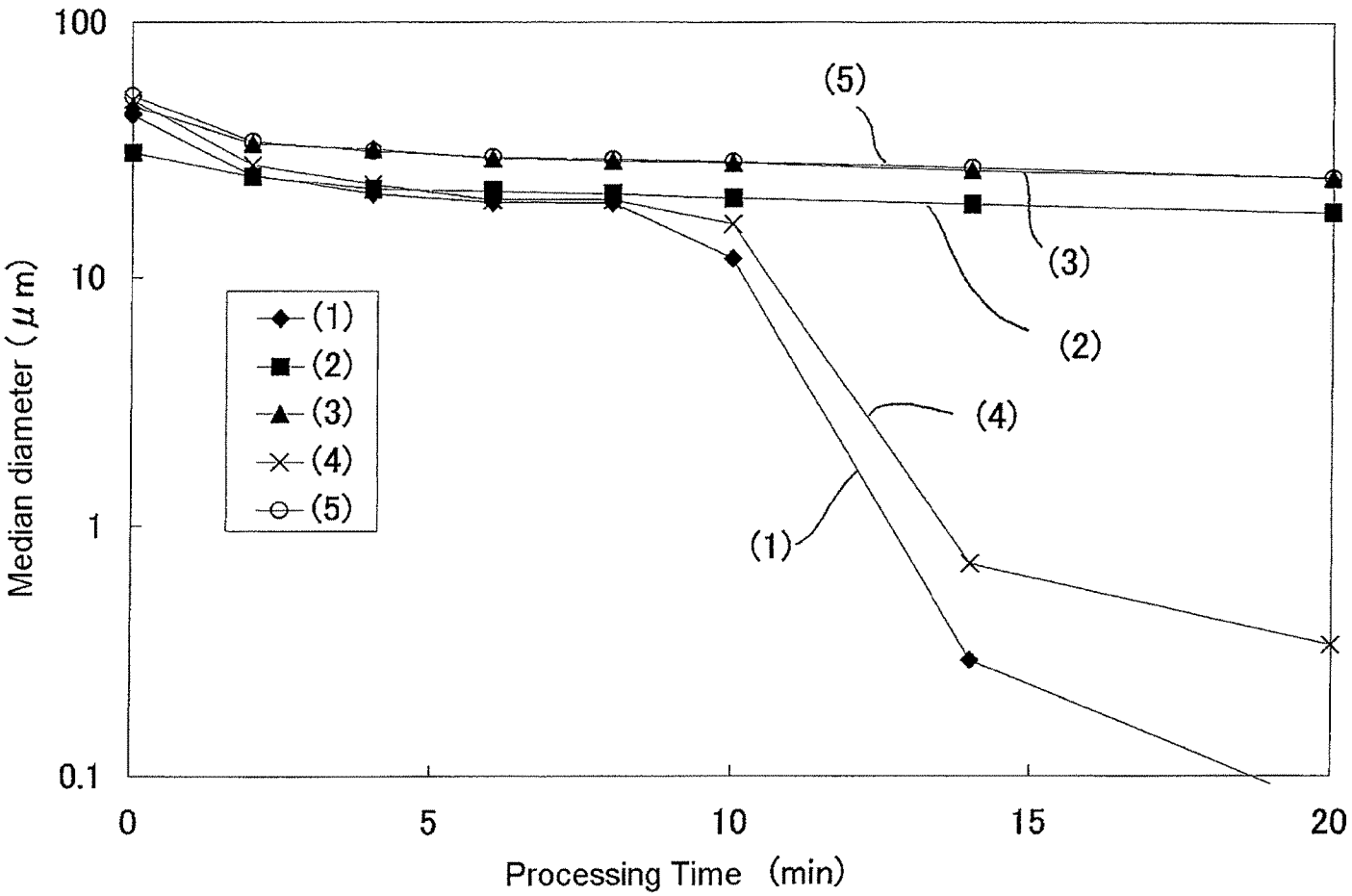
FIG. 10 is a graph showing the changes in median diameters in relation to the processing time by the dispersing devices for the example for testings and the comparative examples.

The operating specifications for the examples for testing (Experiment Nos. (1), (2), and (3)) that use the multistage rotor, and the comparative examples (Experiment Nos. (4) and (5)), that use the flat rotor, are as shown in Table 1. The change in the median diameters in relation to the processing time is shown in FIG. 10. The numbers (1) to (5) in FIG. 10 denote the numbers in Table 1. The wording "rotor for supplying a raw material" in the table means the rotor 92 in FIG. 7 or the rotor 302 in FIG. 9. The words "rotor for cooling" in the table mean the rotor 193 in FIG. 7 and the rotor 303 in FIG. 9.

TABLE 1

| Number | Kind of rotor | Speed of rotation of the rotor for supplying a raw material (rpm) | Speed of rotation of the rotor for cooling (rpm) |
|---|---|---|---|
| (1) | Multistage rotor | 3000 | 3000 |
| (2) | | 3600 | 0 |
| (3) | | 0 | 3600 |
| (4) | Flat rotor | 3000 | 3000 |
| (5) | | 3600 | 0 |

The median diameters are measured by using a laser diffraction particle size analyzer (SALD-2100, supplied by Shimadzu Corporation). In a comparison of the multistage rotor with the flat rotor at the same speed of rotation (Numbers (1) and (4)), where the pair of rotors rotate in opposite directions at 3,000 rpm, the median diameter of the multistage rotor, which has buffers, decreases faster. Thus the multistage rotor (Number (1)) more efficiently disperses the mixture than the flat rotor does. If only one rotor is rotated at the speed 3,600 rpm (Numbers (2), (3), and (5)), the multistage rotor (Number (2)), which has a larger buffer and so causes the centrifugal force to become strong, has its median diameter decrease faster than does the multistage rotor (Number (3)), which has a smaller buffer and so causes the centrifugal force to become weak. If only one rotor of the flat roller (Number (5)) is rotated, the performance for dispersing is the worst.

From the experiments, the inventors found the following. If one rotor is provided (i.e., a combination of a rotor and a stator), rotor Number (2) has a better performance for dispersing compared to rotor Numbers (5) and (3). Thus by disposing the outer wall (10, 40, etc.) at the outer circumference of the buffer (8, 38, etc.) in the rotor, the shearing function is found to be obtained. Further, if two rotors are provided (i.e., a pair of rotors), rotor Number (1) has a much greater performance for dispersing compared to rotor Number (4). In addition to local shearing processes in multiple buffers and dispersion by making the mixture uniform in the buffers, the centrifugal force and shearing function are found to be obtained at the walls of the buffers. Since the shear-type dispersing device, of the present invention, has a gap and a buffer as discussed above, it achieves an efficient and proper dispersion.

The process for dispersing by circulating the mixture that uses the system 200 that comprises any of the dispersing devices 1, 31, 71, 81, 91, 131, 191, a tank that is connected to the outlet of the dispersing device, a pump for circulating the mixture, and a piping for connecting in series the dispersing device, the tank and the pump for circulation, achieves an efficient and proper dispersion.

As described above, the feature of a shear-type dispersing device that has a rotor and a stator, or a pair of rotors, wherein at least one buffer is provided and a wall that forms the outer-circumferential side of the buffer is formed in the rotor, is described with reference to FIGS. 1 to 10. In other words, a shear-type dispersing device is described, of which both the rotor and the member that face the rotor (a stator or a rotor) have a concave and convex so that at least one buffer is formed and multiple gaps are formed at the inner-circumferential side and the outer-circumferential side of the buffer. The gap is a passage for the mixture to lead it from the inner circumference to the outer circumference between the rotor and the member that faces the rotor (for example, a small gap that is 2 mm or less to cause the shearing force to be generated). The buffer is formed by widening the gap (the distance between their faces) between the rotor and the member that faces the rotor along the gap so as to store the mixture. A wall that forms the outer-circumferential side of the buffer is formed in the rotor.

Next, with reference to FIGS. 11 to 18, a feature to adjust the gap is described, which feature is advantageous for the shear-type dispersing device that has a buffer, which is described with reference to FIGS. 1 to 10.

In the system 200 for dispersing by circulating the mixture or the dispersing device 1, 31, 71, 81, 91, 131, 191 that constitutes the system 200, either the rotor or the member that faces the rotor, or both, may be driven by a driving mechanism so as to be close to, or apart from, each other. The driving mechanism is provided in the system for dispersing by circulating the mixture, to prevent the device or piping from being damaged by an increased pressure when the mixture blocks the gap between the pair of rotors or the rotor and stator in the dispersing device. The specific structure, functions, and effects of the driving mechanism of the system 400 for dispersing by circulating the mixture in FIG. 11 are discussed below.

Figure 11:
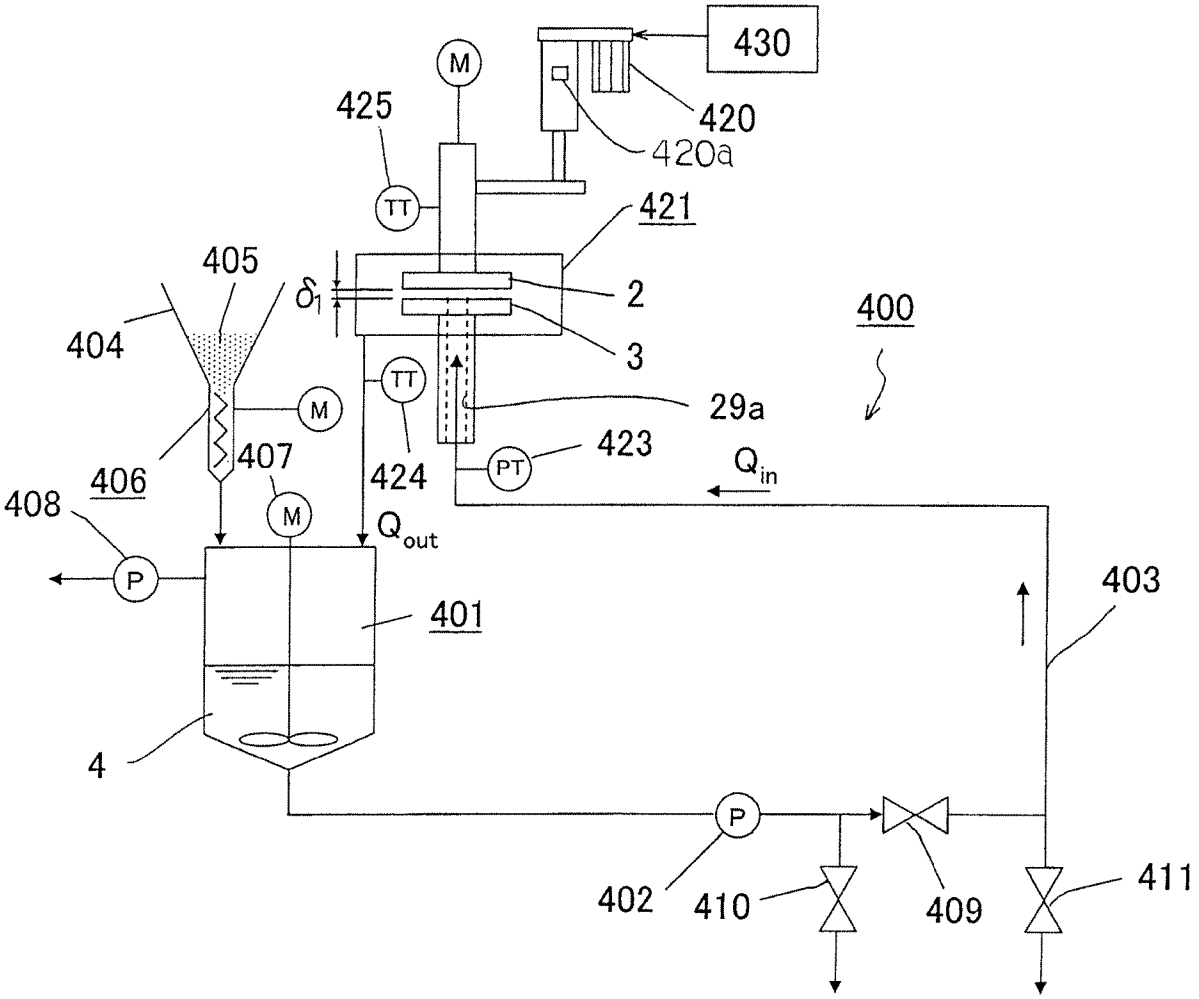
FIG. 11 is a schematic diagram illustrating the structure of another embodiment of the system for dispersing by circulating the mixture that uses the dispersing device that has a mechanism to adjust the distance between the rotor and the member that faces the rotor.
Figure 12:
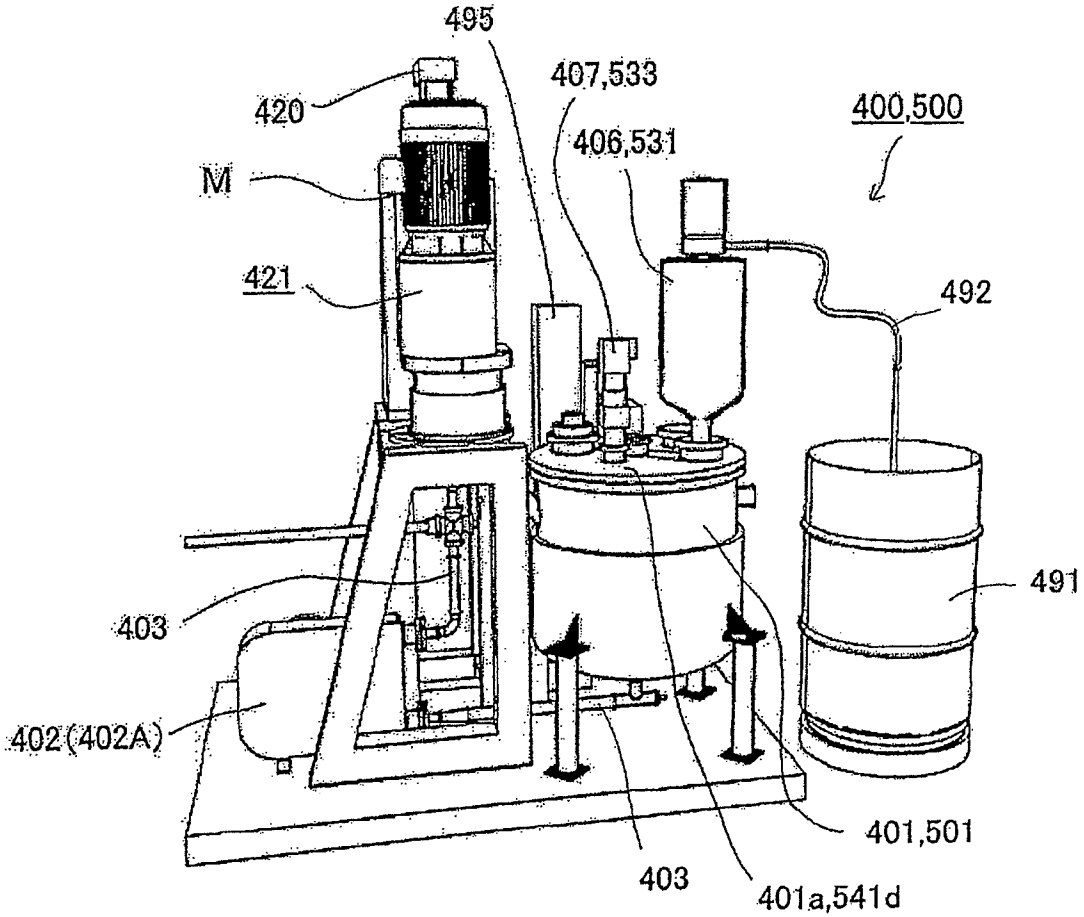
FIG. 12 is a perspective view illustrating the specific structure of the system for dispersing by circulating the mixture as in FIG. 11.

Next, with reference to FIGS. 11 and 12, the system 400 for dispersing by circulating the mixture is described. The system 400 for dispersing by circulating the mixture in FIG. 11 comprises a rotor-type and continuous dispersing device (all of the dispersing devices 1, 31, 71, 81, 91, 131, 191 that are discussed with reference to FIGS. 1 to 7 [they each include a variation where the stator is replaced by a rotor], and they each include a mechanism for adjusting the gap [the driving mechanism 420], wherein the dispersing device 421, which is the same as the dispersing device 1 beside it, comprises the driving mechanism 42) that disperses the mixture. In the figure, "M" denotes a motor. The rotating shaft of the rotor is vertically disposed. However, the dispersing device is not limited to this. The system 400 for dispersing by circulating the mixture comprises a tank 401 that is connected to the outlet of the dispersing device 421, etc., a pump 402 for circulation that is connected to the outlet of the tank 401 to circulate the mixture 4, and a piping 403 that connects in series the dispersing device 421, etc., the tank 401, and the pump 402 for circulation. The reference "Qin" in FIG. 11 denotes the flow of the mixture into the dispersing device 412 and the reference "Qout" denotes the flow of the mixture toward the tank 401 after being dispersed.

FIG. 12 illustrates an exemplary arrangement of the system 400 for dispersing by circulating the mixture as in FIG. 11 or a system 500 for dispersing by circulating the mixture as in FIG. 19, which is discussed below. The arrangement of the system for dispersing by circulating the mixture of the present invention is not limited to this. As in FIG. 12, a tank 491 for storing powdery additives is connected to the system 400 for dispersing by circulating the mixture via a piping 492 for supplying additives. The tank 491 for storing the powdery additives supplies the powdery additives to the device 406 for supplying via the piping 492 for supplying additives when a suction force is generated. A lift 495 for lifting the lid 401*a* of the tank 401 during the maintenance is provided to the system 400 for dispersing by circulating the mixture as in FIG. 12.

Figure 13:
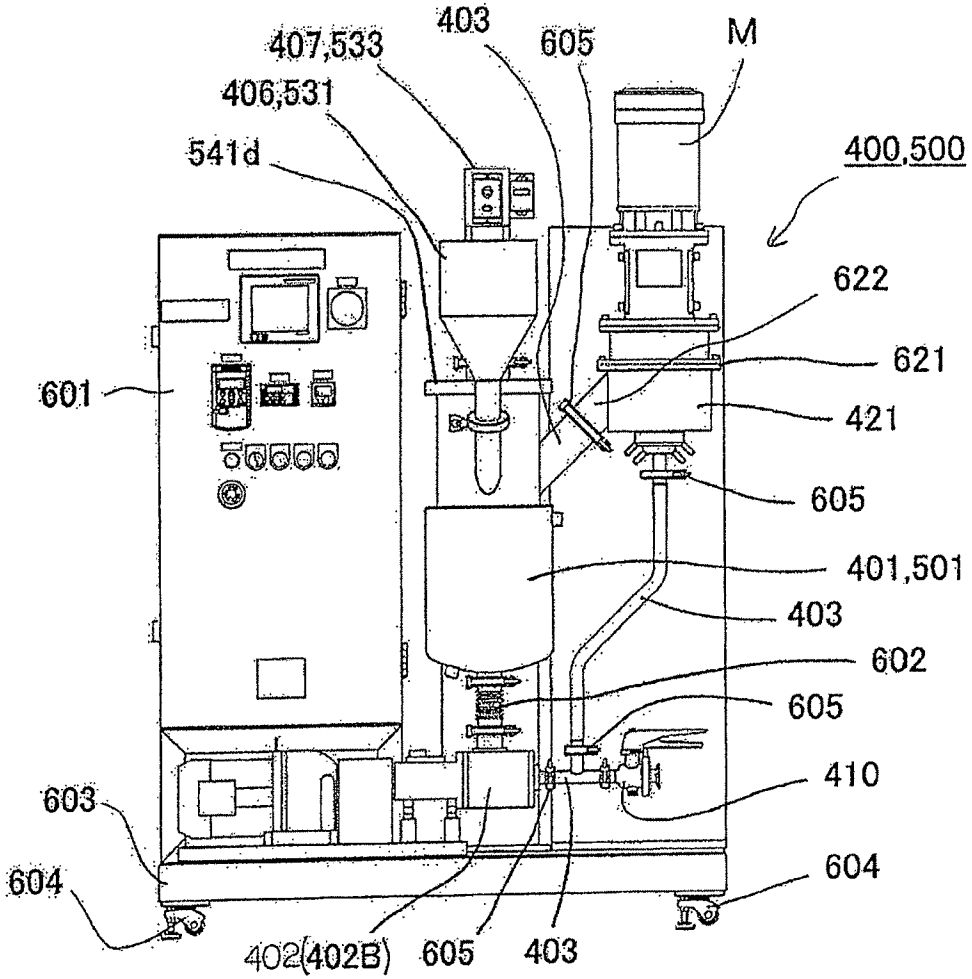
FIG. 13 is a front view illustrating the specific structure of another example of the system for dispersing by circulating the mixture as in FIG. 11.

Another example of the arrangement that differs from that in FIG. 12 is illustrated in FIG. 13. In the arrangement in FIG. 13, a control panel 601 that has a controller for controlling each component of the system 400, 500 for dispersing by circulating the mixture is provided. An expansion joint 602 is provided under the tank 401, 501 in the arrangement as in FIG. 13. Thereby, installing each component, and making any adjustment when installing each component, are facilitated. Casters 604, each with a stopper, are provided under the base plate 603 that has each component mounted on it. Thereby, transporting the system is facilitated. For the pump 402 for circulation that constitutes the system 400 for dispersing by circulating the mixture, for example, a peristaltic pump (or hose pump) 402A as in FIG. 12 or a screw pump 402B as in FIG. 13 may be used.

In the example in FIG. 13, a plurality of quick couplings (a joint for a piping that can be connected and disconnected without using a tool), such as ferrules 605, are used for the piping 403. This configuration is advantageous for attaching a device 610 for injecting the mixture to be processed as in FIG. 14 to the system 400, 500 for dispersing by circulating the mixture. The device 610 for injecting the mixture to be processed is connected to the dispersing device 421 to supply the mixture to be processed (for example, a raw material to which additives are added) to the dispersing device 421. That is, it is used when dispersing just a little amount of the mixture is carried out, prior to the full-scale dispersion, by circulating the mixture by using the system 400, 500 for dispersing by circulating the mixture.

Figure 14:
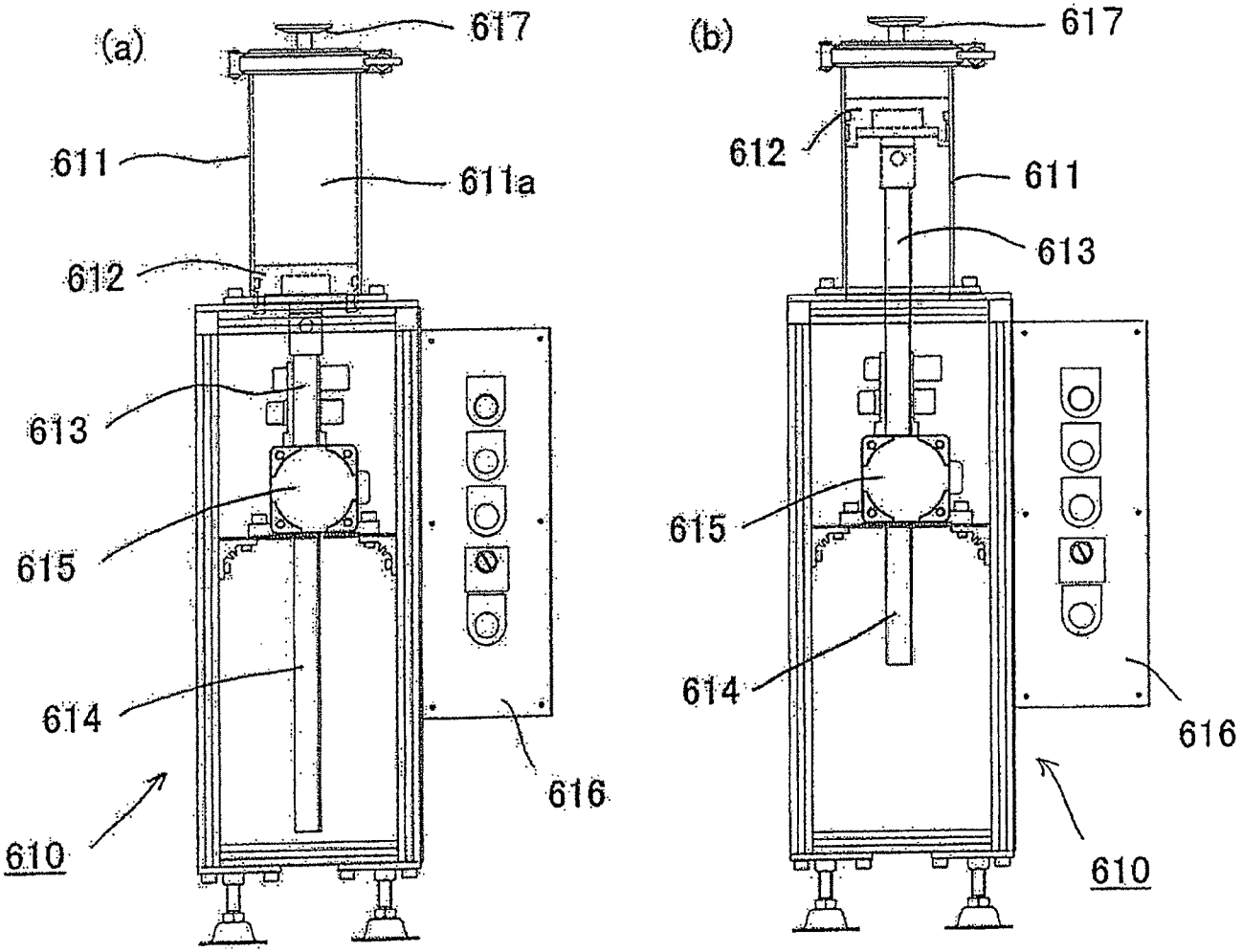
FIG. 14 illustrates a device for injecting a mixture to be processed that is attached to the system for dispersing by circulating the mixture as in FIG. 13. (a) is a front view of the device before injecting the mixture. (b) is a front view of the device when a piston is driven to inject the mixture.

If the device 610 for injecting a mixture to be processed as in FIG. 14 is attached to the dispersing device 421, dispersing a small amount of the mixture is facilitated. The device 610 has, for example, a cylinder 611 and a piston 612 that reciprocates within the cylinder 611. The rod 613 of the piston 612 is connected to, for example, a rack 614 of a rack and pinion. The device 610 is equipped with a motor 615 so that the piston 612 is driven via the rack and pinion. Further, a control panel 616 that has a controller for controlling the motor 615, etc., is provided. At the upper end of the cylinder 611, a connector 617 for connecting it to the dispersing device 421 or the ferrule 605 is provided.

Figure 15:
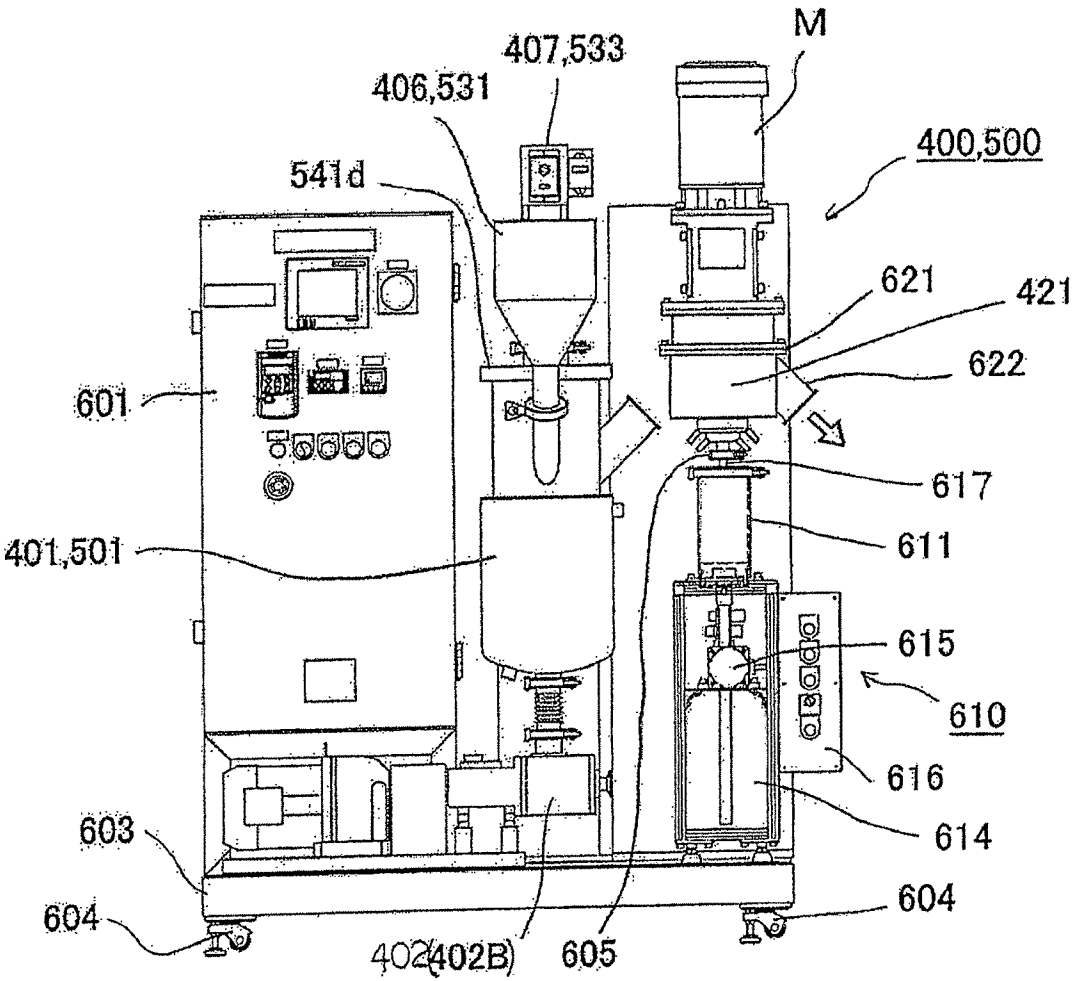
FIG. 15 is a front view of the device for injecting a mixture to be processed when it is connected to the system for dispersing by circulating the mixture as in FIG. 13.

The device 610 for injecting a mixture to be processed as in FIG. 14 is connected to the dispersing device 421 as shown in FIG. 15. When the device 610 for injecting a mixture to be processed is connected in the system 400, 500 for dispersing by circulating the mixture, the piping 403, located between the pump 402 (402A, 402B) for circulation and the dispersing device 421, is removed by means of the ferrule 605. In addition, the connection of the tank 401, 501 to the dispersing device 421 is released. A flange 621 of the dispersing device 421 is temporarily removed and it is again attached after being turned so that the nozzle 622 faces outward as in FIG. 15. In addition, the device 610 for injecting a mixture to be processed is attached to the dispersing device 421.

The mixture to be processed that is held in a space 611*a* in the cylinder 611 that is above the piston 612 as in FIG. 14(*a*) is poured into the dispersing device 421 via the connecting pipe by upwardly moving the piston 612 by the motor 615 as in FIG. 14(*b*). The "mixture to be processed" may be a mixture that is a raw material to which additives are added or a mixture that has been dispersed by the dispersing device 421 but will be further dispersed, which is discussed below (hereafter, simply the "mixture"). The mixture that has been poured into the dispersing device 421 is dispersed as discussed above. It is discharged through the nozzle 622 as depicted by an arrow in FIG. 15. The mixture that has been dispersed and is discharged through the nozzle 622 is collected in a container, which is not shown. The mixture in the container may be again poured into the dispersing device 421 through the device 610 for injecting a mixture to be processed to be dispersed.

As discussed above, by using quick couplings for the piping 403 that connects the dispersing device 421, the tank 401, 501, and the pump 402 for circulation in the system 400, 500 for dispersing by circulating the mixture and by attaching the device 610 for injecting a mixture to be processed, the following advantageous effects can be obtained. A large amount of mixture can be dispersed by the system 400, 500 for dispersing by circulating the mixture and a small amount of mixture can be dispersed by the device 610 for injecting a mixture to be processed. Thus a pilot dispersion prior to the dispersion for a large amount can be made.

The liquid that circulates through the tank 401, the dispersing device, and the piping 403 is a raw material at first. It becomes a mixture each time it passes through the dispersing device, where the additives are dispersed. It finally becomes a dispersed mixture. In this description, the "raw material" at first and the "mixture" during the process of dispersion are also called the "mixture."

The system 400 for dispersing by circulating the mixture comprises a driving mechanism 420 that drives either the rotor 2 or the stator 3 (the member that faces the rotor) of the dispersing device 421 in the direction of the axis of the rotary shaft (below, the rotor 2 is described as being driven, as an example) to have them to be close to, or apart from, each other. It also comprises a controller 430 that controls the driving mechanism 420. The driving mechanism 420 may be a servo cylinder, for example. It may drive a unit that includes the rotary shaft of the rotor 2 and the motor M that rotates them to vertically move them. Thus the gap 6*i* between the rotor 2 and the stator 3 can be widened or narrowed. In the following description, an electric servo cylinder that includes a load cell (the load transducer 420*a*), etc., is assumed to be used for the driving mechanism 420.

In the system 400 for dispersing by circulating the mixture, which comprises the driving mechanism 420, the gap 6*i* between the rotor 2 and the stator 3 can be widened to remove an occlusion there, to prevent the device or piping (especially a joint) from being damaged by an increased pressure when the mixture blocks the gap or there is a possibility that the mixture is blocking the gap.

The controller 430 controls the size of the gap between the rotor 2 and the stator 3 based on both the measurement by a pressure sensor 423 that measures the pressure of the mixture that exists between the rotor and the stator and the measurement by a temperature sensor 424 that measures the temperature of the mixture that is discharged from the gap between the rotor and the stator. The controller 430 may control it based on either the measurement by the pressure sensor 423 or the measurement by the temperature sensor 424.

The pressure sensor 423 is located at the position where the pressure rises to a peak in the piping 403. For example, it is located just before the point where the mixture is flowed into the dispersing device 421 as in FIG. 11. If a servo cylinder is used for the driving mechanism 420, the load cell (the load transducer 420*a*), which is provided at the tip of the cylinder, may be used for a pressure sensor or may be used in addition to the pressure sensor. A pressure sensor that is disposed inside the servo cylinder may be used for the pressure sensor.

The temperature sensor 424 is located at a point on the piping 403 that is located just after the outlet of the dispersing device 421 so as to measure the temperature of the mixture that is discharged from the dispersing device 421 as in FIG. 11. The system 400 for dispersing by circulating the mixture is equipped with a temperature sensor 425 that measures the temperature of the bearing of the rotor 2. The relationship between the measurement by the temperature sensor 425 and the change of the size of the gap 5*i* that is caused by the thermal expansion or contraction of each component is measured before the operation starts, so that the relationship is stored in the memory of the controller 430. Thus the controller 430 controls the driving mechanism 420 based on the measurement by the temperature sensor 425 so as to move the rotor 2 in the direction of the shaft. Thus the gap $\delta_1$ is adjusted so that the pressure is prevented from increasing or decreasing too much.

Below the feature to adjust the gap is more specifically described. As in FIG. 11, the outlet of the tank 401, which stores the mixture, is connected to the pump 402 for circulation. The pump 402 for circulation pumps the mixture so that the mixture circulates. The device 406 for supplying, which is located on the tank 401, adds the additives 405 (a liquid or powder) that is stored in a hopper 404 to the mixture (a raw material at first) that circulates. The mixture after the additives are added is supplied to the rotor-type and continuous dispersing device 421, which is located above the tank 401.

The dispersing device 421 has the rotor 2 and the stator 3, which vertically face each other. In the dispersing device 421 the shafts are provided vertically. The rotor 2 is located at the upper side and the stator 3 is located at the lower side. They may be replaced by a pair of rotors that rotate in opposite directions. Alternatively, the shafts may be disposed horizontally and the rotor and the stator may horizontally face each other. The rotor 2 and the stator 3 make the additives be uniformly dispersed in the raw material. The mixture that has been dispersed between the rotor 2 and the stator 3 of the dispersing device 421 returns to the tank 401 by gravity without accumulating in the cover for the rotor of the dispersing device 421. The mixture in the tank 401 is prevented from segregating by means of the agitation by the agitator 407.

A screw feeder, a rotary valve, or a plunger pump may be arbitrarily used for the device 406 for supplying the additives 405. The device 406 for supplying may be located along the piping 403 on the path for circulating the mixture. It may be located at any point on the piping 403.

The vacuum pump 408 is connected to the tank 401. The vacuum pump 408 decompresses the tank 401 to assist in discharging the mixture if the amount of the mixture being discharged from the dispersing device 421 is little. Further, the decompression by the vacuum pump 408 acts as a defoaming action if air is mixed in the mixture.

In the system 400 for dispersing by circulating the mixture the valve 409 is normally open and the valves 410, 411 are normally closed, during the operation. After the dispersing process is completed, the valve 409 is closed and the valve 410 is opened. Thus the processed mixture is discharged through the valve 410 and collected. The mixture that has remained in the dispersing device 421 or the piping 403 is discharged and collected by opening the valve 411. The valve for discharging or collecting the mixture may be provided anywhere on the tank or piping.

Since the system 400 for dispersing by circulating the mixture has the dispersing device 421 that has a structure, and functions and effects, similar to the dispersing device 1, etc., as shown in FIGS. 1 to 7, an efficient and proper dispersion is carried out. Thus the dispersing function as a system as a whole is improved and the time for dispersion is shortened.

The system 400 for dispersing by circulating the mixture is a batch system as a whole (hereafter, "batch system by circulation"). It discharges the mixture after sufficiently dispersing the mixture to make it uniform. Thus the dispersion for making the mixture uniform can be improved. Further, by using a batch system by circulation the traceability of the raw material can be ensured. That is, if the test of the processed mixture indicates that the desired quality is not obtained (the sizes of particles vary or the amount of impurities is great, etc.), finding the raw material the raw material that is liquid) or additives (a powdery material) that cause the trouble is easy. In other words, the raw material and additives that have been prepared in the same lot as the raw material and additives can be traced. This tracing is difficult if a continuous dispersing system, where the mixture passes through the dispersing device and the tank just one time, is used. Thus, that tracing is an advantage of a batch system. By using a batch system, a defoaming process can be carried out by the vacuum pump 408 or the like. Thus it has an advantage in shortening the time for defoaming. Further, by using a batch system, a system that works together with a preceding process, such as a tank for storing powdery additives, or a post process, such as a tank for storing a product that has been dispersed, can be easily constructed. That is, a tank 491 for storing powdery additives may be added to the system 400 for dispersing. Since the structure of the system 400 is simplified, it may be located adjacent to the tank for storing a product that has been dispersed. Since the system 400 for dispersing by circulating the mixture is a batch system by circulation and carries out an innovative manufacture of a slurry (dispersing process) as discussed above, a continuous operation can be carried out while a high dispersion and high traceability is maintained. The compact system that has a high performance and a high reliability meets the clients' requirements for simplifying, streamlining, upgrading, and making complex products. These merits can be obtained by the system 200 for dispersing by circulating the mixture, which is discussed above, and the system 500 for dispersing by circulating the mixture, which is discussed below.

Figure 16:
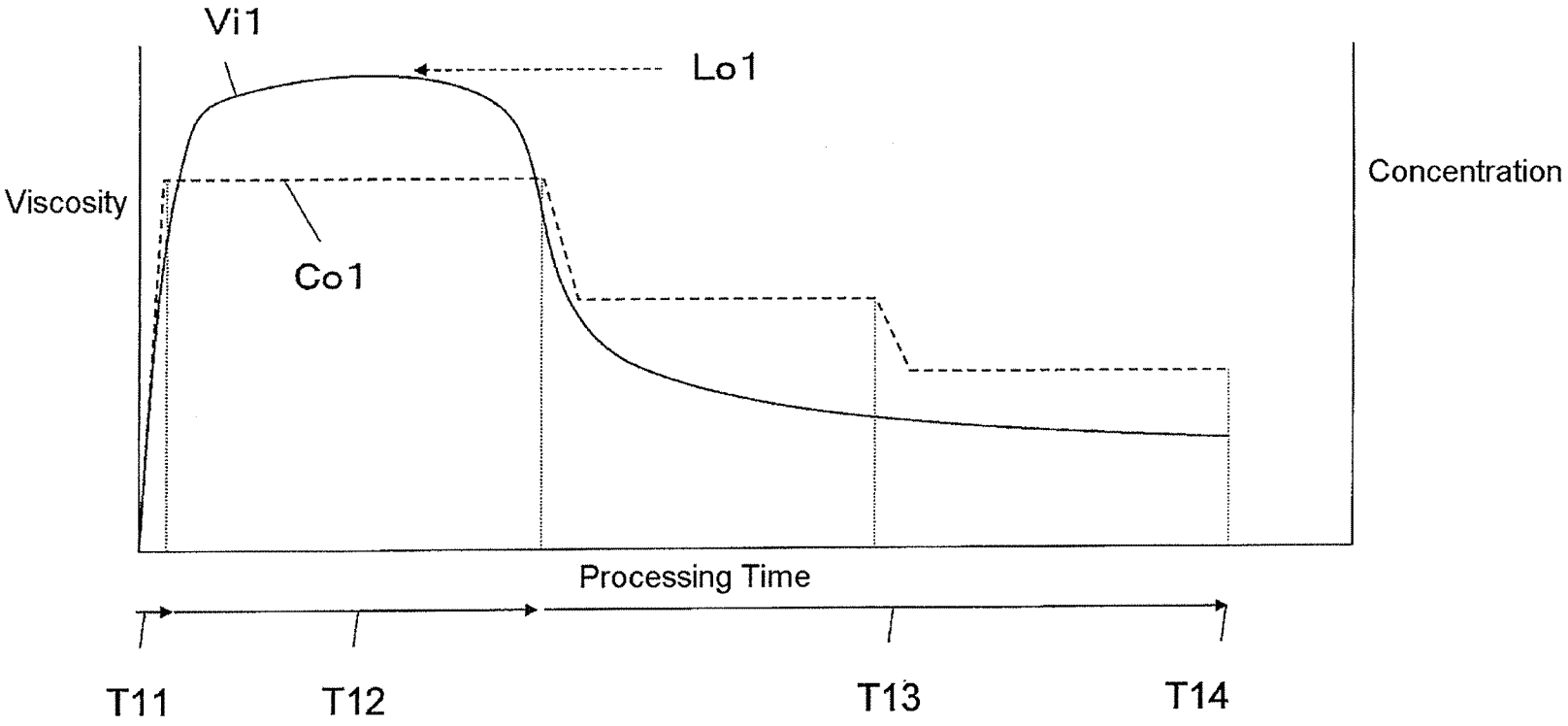
FIG. 16 illustrates the merits of the process by kneading a mixture in a low concentration and inspissating the mixture of the system for dispersing by circulating the mixture as in FIG. 11 by comparing the process by kneading a mixture in a high concentration and diluting the mixture. It shows the relationship between the processing time and the viscosity and the concentration of the mixture formed by the process by kneading a mixture in a high concentration and diluting the mixture.
Figure 17:
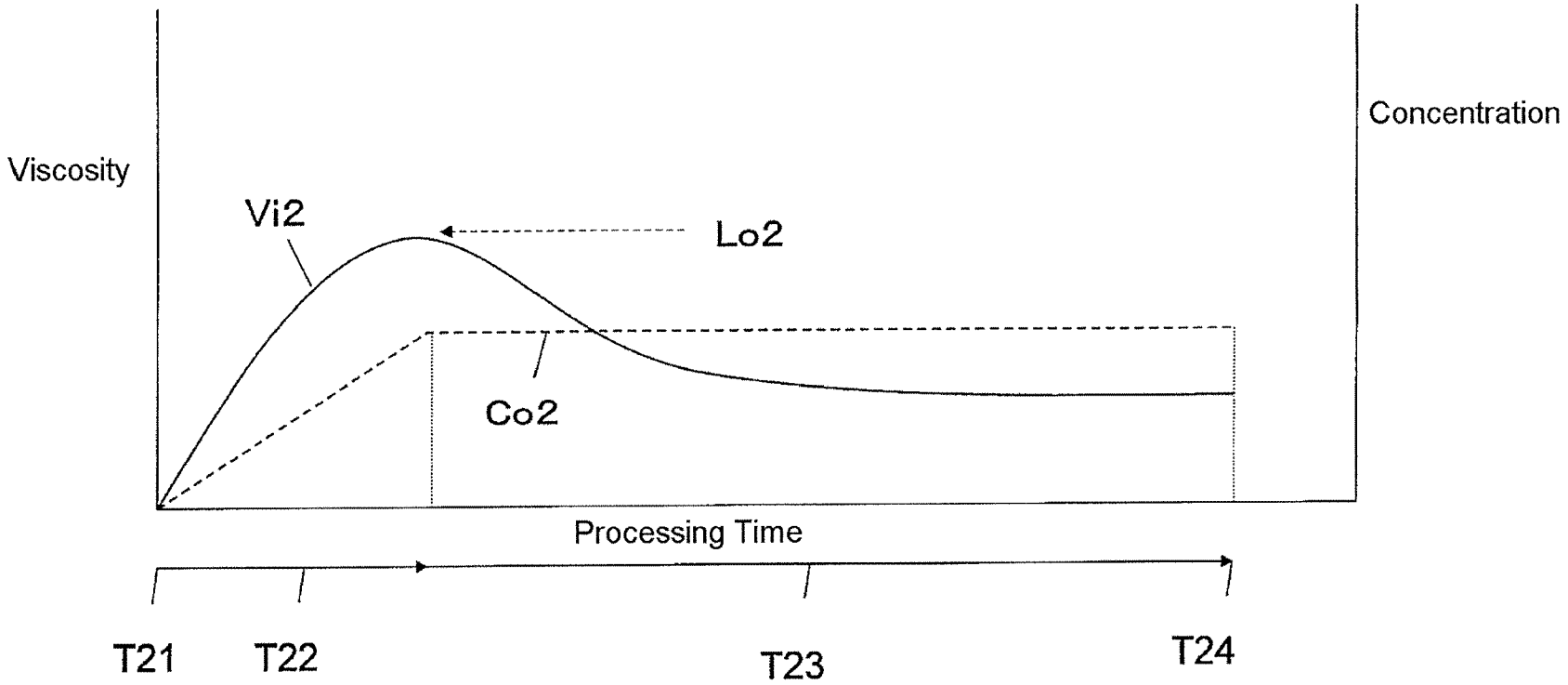
FIG. 17 shows the relationship between the processing time and the viscosity and concentration of the mixture in the process by kneading in a mixture in a low concentration and inspissating the mixture.

The system 400 for dispersing by circulating the mixture is characterized in that it disperses the mixture by a shear-type dispersing device while the raw material is circulated and the additives are added to the raw material. In other words, it is characterized in that it gradually inspissates the mixture which had a low viscosity (at the low content of the powdery additives) at first and has powdery additives mixed into it, i.e., "by kneading a mixture in a low concentration and inspissating the mixture." The merits of the process "by kneading a mixture in a low concentration and inspissating the mixture" is discussed below by being compared to the "process by kneading a mixture in a high concentration and diluting the mixture," where all the powdery additives are added to the raw material in the tank so that the mixture has a very high viscosity (at the high content of the powdery additives) at first, and they are then kneaded by a weak shearing force, and thereafter dispersed and inspissated to be uniform as a whole. The relationships between the viscosity and concentration and the processing time are shown in FIG. 16 for the "process by kneading a mixture in a high concentration and diluting the mixture" and in FIG. 17 for the "process by kneading a mixture in a low concentration and inspissating the mixture." In FIGS. 16 and 17, the abscissa denotes the processing time, the ordinate the viscosity and concentration, Vil and Vit the changes in the velocities, and Col and Cot the changes in the concentrations. T11 denotes the period for supplying additives and a solvent, T12 the period for kneading a mixture in a high concentration, T13 the period for inspissating and mixing the mixture, and T14 the time that the process ends. T21 denotes the time for supplying a solvent, T22 the period for supplying the additives and dispersing a mixture, T23 the period for kneading and dispersing the mixture, and T24 the time that the process ends. Lo1 and Lo2 denote loads for determining the motor capacity. The motor capacity must be determined in consideration of the maximum viscosity. Since the system for dispersing by circulating the mixture as discussed above employs the "process by kneading a mixture in a low concentration and inspissating the mixture," the maximum effect in dispersing the mixture can be obtained while the motor capacity of the motor for a rotor in the dispersing device 421 remains low. Since the motor capacity can be small, the structure of the entire device can be downsized. Since the change in the viscosities is small as in FIG. 17 compared to that as in FIG. 16, the dispersing process is carried out by effectively using the motor capacity, to thereby efficiently disperse the mixture.

Since the system 400 for dispersing by circulating the mixture has the driving mechanism 420, it has a particular effect. Before the particular effect achieved by the driving mechanism 420 is discussed, any problem that would be caused by the system 400 that has no driving mechanism 420 is discussed. A problem that is caused by such a system that has no driving mechanism would damage a device or piping that is generated by a pressure in it that increases too high. Anything that causes the internal pressure to increase too high may be most probably a portion where a resistance to flow is largest, i.e., a gap between the stator and the rotor (the gap $\delta_1$ in FIG. 11), or a gap between a pair of the rotors, where a solid clogs. To prevent that clogging, to thereby guard the device and system, the upper limit of the pressure may be predetermined. The pressure at a point where the maximum pressure is generated may be measured by a pressure sensor so that the operation is stopped if the measured pressure exceeds the upper limit. However, if the operation is stopped, some time to restart the operation is needed. Thus preventing the pressure from further increasing from just below the upper limit, i.e., removing any occlusion that is located between the rotor and stator or a pair of the rotors, is preferable.

A method to remove an occlusion between the rotor and the stator or the pair of rotors is, as a first method, to widen the gap, or as a second method, to increase the speed of the rotor, or, as a third method, to decrease the pumping rate. If the measured pressure exceeds the predetermined value, for example by the first method, the gap is widened so as to remove an occlusion of a solid. For the second method, the speed of the rotor is increased so as to strengthen the shearing force, to thereby destroy the solid that is occluded at the gap. For the third method, the pumping rate is decreased so as to lower the internal pressure to thereby extend the time so that the solid is destroyed by the shearing force that is generated by the current speed of the rotor, and removed. Among these methods, the first method is straightforward, in terms of removing an occlusion. Thus the system 400 for dispersing by circulating the mixture adopts it. The second and third are fundamental in terms of destroying a solid that is an occlusion. However, if the resistance of the solid against being destroyed is high, the solid is not always destroyed in a short time to then be removed. Though the functions and effects are discussed above or below assuming that the first method is used, the second or third method may be used instead of, or in addition to, the first method. That is, after resolving the increase in the pressure by widening the gap to remove an occlusion, if necessary the speed of the rotation is increased or the flow is decreased. Then, while the operation for circulation is carried out, the gap, the speed of the rotation, or the flow is returned to the normal value (the value during the normal operation). This is an efficient operation. The control of this operation is preferably done by the controller 430.

As discussed above, in the system 400 for dispersing by circulating the mixture and the dispersing device 421 that constitutes the system, the driving mechanism 420, such as a servo cylinder, is provided to adjust the gap $\delta_1$ between the stator 2 and the rotor 3. Further, the system 400 for dispersing by circulating the mixture enables the dispersion of a slurry mixture that has a high concentration and a high viscosity to be carried out. The rotor 2 is constructed by attaching the motor M to the upper disk-like member. An upper unit that includes the rotor 2 is vertically moved by the driving mechanism 420 (a servo cylinder), to thereby adjust the gap $\delta_1$ between the rotor 2 and the stator 3. A lower disk-like member is formed as the stator 3, which has no seal (since no part rotates, no seal is needed) to improve the durability against the slurry. The slurry mixture to be dispersed is supplied to a portion for dispersing (a space between the rotor 2 and the stator 3) through the shaft of the stator 3. Though the pressure is measured by the pressure sensor 423 that is located at the point where the maximum pressure in the piping occurs, it may be measured by a load cell (for example, the load transducer 420*a* as in FIG. 11), which is located in the driving mechanism 420 (a servo cylinder) or at the tip of the cylinder. Further, the speed of the rotation or the pumping rate may be controlled by the controller 430 via respective inverters that are connected to the driving motors.

For the dispersing process by the system 400 for dispersing by circulating the mixture, the efficiency of the dispersion may be improved by preparing a control program for the gap $\delta_1$ between the rotor 2 and the stator 3, the speed of the rotor, the flow, etc., if the properties of the mixture are predictable. For example, during the process for manufacturing a slurry mixture by circulating raw material and adding powdery additives to them, solids may tend to agglutinate at the initial operation, to thereby block the gap between the rotor and the stator. In this case the gap may be widened and the speed of the rotor may be increased at the initial operation. After supplying the powdery additives is finished, the agglutinated solids are destroyed while the mixture made of liquid raw material and powdery additives are circulated. When the mixture becomes stable and no clogging is expected, the gap and the speed of the rotor may be returned to the original values (the values for the normal operation) to perform the intended dispersion. In this operation the decrease of the flow results in the decrease in the number of times that the mixture passes through the shearing (dispersing) portion. Thus the processing time is extended. Therefore, possibly that decrease may not be carried out.

Further, the proper gap between the rotor and stator, the proper speed of the rotor, or the proper flow, may differ in respective stages when multiple kinds of powdery additives are serially supplied during the process of manufacturing slurry by the system 400 for dispersing by circulating the mixture. For this operation an efficient and proper dispersion can be carried out by preparing a control program for it.

For a process for discharging the mixture (a product) that has been processed after the dispersion is completed in the system 400 for dispersing by circulating the mixture, an efficient and proper dispersion can be carried out by controlling the process. The discharging process is continued after the dispersing process ends, without stopping the operation. By closing the valve 409 and opening the valves 410, 411 the mixture (the product) is discharged through the valves 410, 411 and collected. To prevent the mixture from being dispersed too much the dispersing device 421 is deactivated. That is, the rotor 2 is stopped. The mixture (the product) that is located between the rotor 2 and the stator 3 is not easily discharged, because the resistance to flow at the gap is great. Thus by widening the gap to decrease the resistance to flow the speed of discharging is improved. This method is effective if the mixture has a high viscosity or a buffer is formed in the stator or rotor of the dispersing device (such cases as were discussed with reference to FIGS. 1 to 7), since the amount of mixture to be discharged is large.

Since a disk-type dispersing device, such as the dispersing device 421 as discussed above, disperses the mixture by a strong shearing force that is generated by a rapid rotation, the faces of the rotor 2 and the stator 3, i.e., the disk-like members, that face each other, generate heat by friction. Thus because of the thermal expansion of the members that face each other, of the shafts or the related parts, the gap between the rotor 2 and the stator 3 may become smaller.

If the gap between the rotor 2 and the stator 3 becomes smaller, the resistance to flow increases, to thereby cause a too high pressure to be generated. Thus, by measuring the temperature of the raw material in addition to the pressure and using the measurements for predicting and preventing the increase of the pressure, the safety of the system can be improved. The portion where the temperature of the raw material most increases would be the space between the rotor 2 and the stator 3. Since that portion rotates at a high speed, measuring the temperature of the portion is difficult. However, by placing the temperature sensor 424 at the point of the piping that is located just after that portion, the temperature that is almost the same as that of that portion can be measured. The temperature sensor can be placed on the stator 3 in a relatively simple way. Thus the temperature sensor may be placed on the stator 3 instead of the piping.

Further, if necessary, the temperature sensor 425 may measure the temperature of the bearing. By examining the relationship between the temperature and the gap between the rotor 2 and the stator 3, the decrease of the gap that is caused by the increase in the temperature can be adjusted by means of the servo cylinder, etc. (the driving mechanism 420). Thus the gap can be adjusted to be a proper size so as to prevent the pressure from increasing too much. This adjustment is carried out to prevent any increase in the pressure, but it also prevents any increase in the temperature.

Further, the control that is based on the measured temperature can be used for the two following objects. The first object relates to the fact that the decrease in the size of the gap caused by the thermal expansion may cause the rotor 2 to contact the stator 3 (the same applies to the pair of rotors), which may result in an overload, an abnormal noise (a loud noise), or damage to the members that face each other (the disk-like members). That is, the first object is to properly adjust the size of the gap to prevent these troubles. The second object relates to the control of the operation to more aggressively adjust the temperature so that any change of properties that is caused by the increase of the temperature of the raw material is prevented. That is, if the measured temperature of the mixture exceeds the predetermined value the gap between the rotor 2 and the stator 3 is widened or the speed of the rotor 2 is decreased, regardless of the pressure, so that the friction heat of the mixture can be suppressed.

As discussed above, the system 400 for dispersing by circulating the mixture, which has the driving mechanism 420, prevents an occlusion from occluding the gap $\delta_1$ between the rotor 2 and the stator 3 of the dispersing device 421 so as to prevent the device or piping from being damaged by an increased pressure in the piping. Thus an efficient and proper dispersion can be carried out. The driving mechanism 420 is not limited to a dispersing device of the rotor and stator type. A device of a pair of rotors type may be used. The system prevents an occlusion form occluding the between the pair of rotors so as to prevent the device or piping from being damaged by an increased pressure in the piping.

In the system 400 for dispersing by circulating the mixture the controller 430 adjusts the distance (the gap $\delta_1$) between the rotor 2 and the stator 3 based on either the measurement by the pressure sensor 423 or the measurement by the temperature sensor 424 or both. Thus it predicts that the mixture will be occluded and prevents it from clogging the gap. Thus it securely prevents the device or piping from being damaged.

Further, in the system 400 for dispersing by circulating the mixture the controller 430 gradually increases the speed of rotation when the viscosity is high. While the viscosity is high, it also widens the gap if the gap (the distance) is too small so that the load becomes too large, and it narrows the gap so as to increase the shearing force after the viscosity becomes normal. Thus a proper dispersion can be carried out to achieve the relationship between the viscosity and concentration and the processing time as in FIG. 17, for example.

The system 400 for dispersing by circulating the mixture disperses the mixture for a short time by using the effect caused by the strong shearing force that is generated by the high speed of the rotor of the dispersing device 421. The shearing force $\tau$ that is generated in the mixture by the dispersing device 421 is expressed by $\tau=\mu x(dv/dx)$. Here, $\mu$ denotes the viscosity and dv/dx denotes the gradient of the velocity of the mixture at the gap between the rotor and the member that faces the rotor. Assume that the gradient of the velocity is a constant. Then the shearing force $\tau$ is expressed by $\tau=\mu x(v/x)$. Here, v denotes the speed of the rotor and x denotes the gap (the distance) between the rotor and the member that faces the rotor. The dispersing device 421 controls the driving mechanism 420 so as to have the gap x enable the intended shearing force to be obtained. Thus a high effect by the shearing force is achieved, to thereby disperse the mixture for a short time. Further, the distance between the rotor and the member that faces the rotor, the flow by the pump 402 for circulation, and the speed of the rotor 2, can all be controlled by the controller 430 so that the dispersion can be flexibly carried out under the best conditions. For example, the distance between the faces, the flow to be circulated, and the speed of the rotation are properly controlled to maintain the relationship between the viscosity and concentration and the processing time as in FIG. 17. Thus the dispersion is carried out by maximizing the motor capacity. In other words, the device is downsized and the processing time is shortened.

The system 400 for dispersing by circulating the mixture improves the efficiency of the cleaning and the maintenance because of its structure and specifications. The system 400 for dispersing by circulating the mixture can remove stuck materials by circulating a liquid for cleaning after the dispersion process is completed. The system 400 for dispersing by circulating the mixture is constructed by using parts that can be easily disassembled. For example, in the dispersing device 421 the rotor 2 and the stator 3 are disassembled by the driving mechanism 420. Since the piping 403 is connected by a coupling, such as ferrule, it can be easily detached. Further, since the lid 401*a* of the tank 401 is vertically moved by the lift 495, it is easily lifted up by the lift 495 when connecting members such as bolts are taken out. Thus the system 400 for dispersing by circulating the mixture improves the efficiency of the cleaning and the maintenance.

The dispersing device 421, which has the driving mechanism 420, prevents an occlusion of the mixture from being generating at the gap $\delta_1$ between the rotor 2 and the stator 3 to prevent the device or piping from being damaged by the increase of the pressure in the piping. An example where the driving mechanism 420 is added to the dispersing device 1 is discussed above. However, the driving mechanism 420 may be added to the dispersing devices 31, 71, 81, 91, 131, and 191, which are discussed with reference to FIGS. 2 to 7. By adding it to them (these dispersing devices and the driving mechanism 420 are also called "the dispersing device 421, etc.") the same effect as that of the dispersing device 421 can be obtained.

Further, the dispersing device 421, etc., which has the driving mechanism 420, and the system 400 for dispersing by circulating the mixture, etc., which uses that device, have the following advantages. The dispersing device 421, which has the driving mechanism 420, can carry out the dispersion by two steps, i.e., a first dispersion and a second dispersion. The first dispersion is to disperse first additives in the raw material. The second dispersion is to disperse second additives in a first mixture, which is obtained by the first dispersion. The dispersing device 421, etc., has a feature wherein the driving mechanism 420 can change the distance between the rotor 2 and the stator 3 when the second dispersion starts after the first dispersion is completed.

The dispersing device 421, etc., can be used for manufacturing, for example, a material for a battery, a material for paint, inorganic chemical products, and so on. For manufacturing a material for a battery, the raw material is, for example, water (distilled water or ion-exchanged water) or NMP (1-methyl-2-pyrrolidone). The first additives are, for example, a thickener, such as powder of carboxymethylcellulose (hereafter, "CMC") or powder of polyvinyl alcohol (hereafter, "PVA"). The second additives are a cathode-active material for a lithium-ion battery (a $LiCoO_2$-based compound, a $LiNiO_2$-based compound, a $LiMn_2O_4$-based compound, a Co—Ni—Mn-based compound, a $LiFePO_4$/$LiCoPO_4$-based compound, etc.), an anode-active material for a lithium-ion battery, a carbon-based material such as a cathode- or anode-active material for a lithium-ion capacitor or a conductive agent (graphite, coke, carbon black, acetylene black, graphite, ketjen black, etc.), an anode-active material for a lithium-ion battery (an antimony-based compound [SbSn, InSb, $CoSb_3$, $Ni_2MnSb$], a tin-based compound [$Sn_2Co$, $V_2Sn_3$, $Sn/Cu_6Sn_5$, $Sn/Ag_3Sn$], a Si-based compound), a cathode-active material for a nickel-hydrogen battery ($Ni(OH)_2$), an anode-active material for a nickel-hydrogen battery, i.e., a hydrogen-storing alloy (TiFe, $ZrMn_2$, $ZrV_2$, $ZrNi_2$, $CaNi_5$, $LaNi_5$, MmN is, $Mg_2Ni$, $Mg_2Cu$, etc.), a binder (a fluorine-based resin [PTFE, or polytetrafluoroethylene, PVDF, or polyvinylidene fluoride], a fluorine-containing rubber [vinylidene fluoride], SBR [a styrene-butadiene rubber], NBR [a nitrile rubber], BR [a butadiene rubber], polyacrylonitrile, an ethylene-vinyl alcohol copolymer, an ethylene-propylene rubber, a polyurethane, a polyacrylic, a polyamide, a polyacrylate, a polyvinyl ether, a polyimide, etc.). In addition, a variety of inks, paints, pigments, ceramic powder, metallic powder, magnetized powder, pharmaceutical products, cosmetics, foods, agricultural chemicals, plastics (resin) powder, wood powder, a natural or synthetic rubber, an adhesive, a thermosetting, or a thermoplastic resin, may be used for the raw material.

In the first dispersion, the distance may be set to be great at the initial operation. As the process progresses, the distance may be gradually decreased. In addition, the distance may be further decreased when the first dispersion is completed and the second dispersion starts.

In the dispersing device 421, which has the driving mechanism 420, the system 400 for dispersing by circulating the mixture alone carries out the first dispersion and the second dispersion. Thus the device can be simplified and the total processing time can be shortened. Next, the advantageous effects are discussed with reference to an embodiment.

Now, the advantageous effects obtained by carrying out the first and second dispersions by the dispersing device 421, which has the driving mechanism 420, are discussed by using an example where the system 400 for dispersing by circulating the mixture having the dispersing device 421 is used for manufacturing a paste for a lithium-ion battery. In this dispersing device 421 and system 400 for dispersing by circulating the mixture, the first mixture is obtained by dispersing CMC powder as the first additives, in water as the raw material. Then by dispersing an active material as the second additives in the first mixture, the second mixture (a product), which has been processed, is obtained. The distance between the rotor and stator of the dispersing device 421 is set to be great so that no occlusion is generated in the first dispersion, and is decreased so as to exert the intended shearing force for dispersing in the second dispersion.

In the system 400 for dispersing by circulating the mixture, CMC powder are little by little supplied to the water that is circulated, to thereby obtain an aqueous solution of the CMC. Since the aqueous solution of the CMC tends to clump (to make a "lump"), the distance (gap) between the rotor 2 and the stator 3 of the dispersing device 421 is initially increased so as to prevent the occlusion of the gap, to thereby prevent the pressure from increasing. As the dispersion is carried out, the gap is gradually made smaller to strengthen the shearing force so that the CMC is uniformly dispersed in the water. The lump is solidified powder that has not been dissolved in the water, which lump is a mixture of liquid and powder that has a high viscosity. Then in the system 400 for dispersing by circulating the mixture, the controller 430 automatically adjusts the size of the gap of the dispersing device 421 to be decreased to a predetermined value (about 2 mm or less). Without stopping the operation, the active material (powdery additives) is supplied to be dispersed in the aqueous solution of the CMC, to thereby manufacture a slurry product, i.e., the second mixture.

As discussed above, by using the system 400 for dispersing by circulating the mixture and the dispersing device 421, which carry out the two stages of the dispersion, no device for preparing the aqueous solution of the CMC is needed. Thus transporting or supplying the aqueous solution of the CMC is not required. Further, the cleaning or maintenance of the device for preparing the aqueous solution of the CMC can be eliminated. Though in the system 400 for dispersing by circulating the mixture and in the dispersing device 421 the time for manufacturing the water solution by adding little by little the CMC is extended, the dispersing process is continued without being stopped, by automatically adjusting the size of the gap. Thus the total processing time is shortened. Therefore, an efficient and proper dispersion can be carried out. In other words, if the dispersing device does not have the driving mechanism 420, the aqueous solution of the CMC must be manufactured by another device and the active material is added to the manufactured aqueous solution of the CMC, i.e., the raw material, to be dispersed in it. In contrast, the dispersing device 421, etc., can carry out the two stages of the dispersion by just adjusting the distance between the faces. That is, the same effects as the system having the other device can be obtained by the process of one device.

Figure 18:
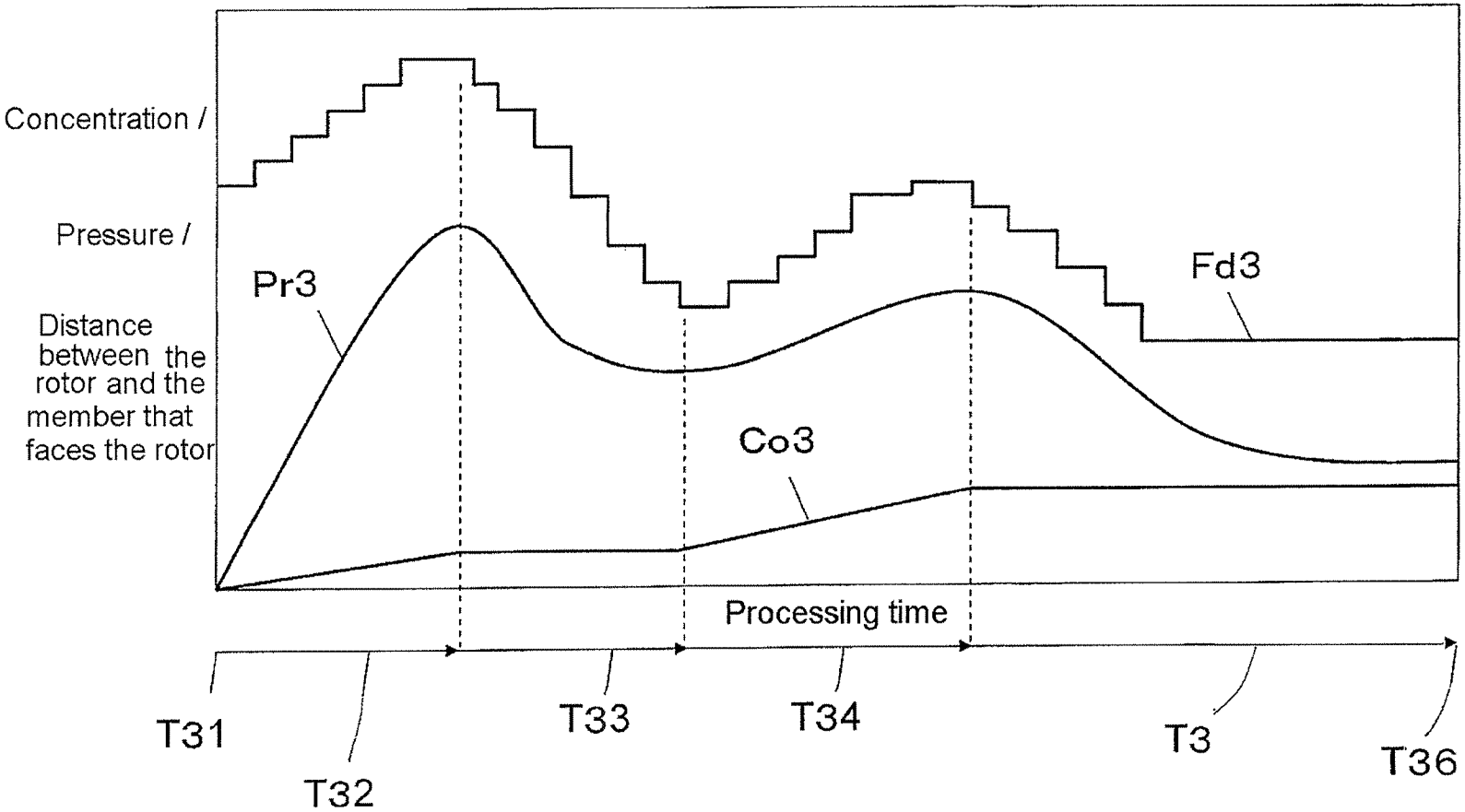
FIG. 18 shows an example of the relationship between the processing time and the concentration and the pressure of the mixture, and the distance between the rotor and the member that faces the rotor when two mixing processes are continuously carried out by the system for dispersing by circulating the mixture as in FIG. 11.

Now, with reference to FIG. 18, an example of the changes in the concentrations, pressures (the measurements of the pressure sensor 423), and distances (the possible sizes of the gap between the rotor and the stator) in regard to the processing time in the two-stage and continuous dispersing process is discussed. In FIG. 18, the abscissa denotes the processing time and the ordinate denotes the concentrations, pressures, and distances. Co3 denotes the changes in the concentrations, Pr3 the changes in the pressures, and Fd3 the changes in the distances. T31 denotes the time that the solvent is supplied, T32 the period during which the first additives (powdery additives) are supplied, T33 the duration of the period for dispersing and mixing, T34 the period during which the second additives are supplied, T35 the duration of the period for dispersing and mixing, and T36 the time that the process ends.

As in FIG. 18, when the two-stage dispersion is carried out by the system 400 for dispersing by circulating the mixture and the dispersing device 421, the step of supplying the first additives, the step of dispersing and mixing the first additives, the step of supplying the second additives, and the step of dispersing and mixing the second additives, are carried out in this order. In the step of supplying the first additives (T32), the distance between the rotor and the stator is increased in a step-wise manner. In the step of dispersing and mixing the first additives (T33) the distance is decreased in a step-wise manner. In the step of supplying the second additives (T34) the distance is increased in a step-wise manner. In the step of dispersing and mixing the second additives (T35) the distance is decreased in a step-wise manner. Though the distance is increased or decreased in a step-wise manner in this embodiment, it may be changed in a continuous manner. The control of the distance is as follows: "the distance is little by little increased during the period when the powdery additives are supplied and is little by little decreased during the period when the powdery additives are dispersed and mixed after the period when the powdery additives are supplied is completed." This control is effective for a process for mixing that has just one stage. The embodiment that is discussed here is repeated twice. The distance when the step of supplying the second additives (T34) is completed is less than the distance when the step of supplying the first additives (T32) is completed. The distance when the step of supplying the second additives (T34) starts is less than the distance when the step of supplying the first additives (T32) starts. The distance when the step of supplying the second additives (T36) ends is less than the distance when it starts (T34). In other words, the dispersion is carried out by the following control: "the distance is little by little increased during the period when the powdery additives are supplied and is little by little decreased during the period when the powdery additives are dispersed and mixed after the period when the powdery additives are supplied is completed." This control incorporates the control whereby "the distance is gradually decreased so as to generate the maximum shearing force at the end of the process." By controlling the distance that is distinctive as in FIG. 18 as discussed above, the two-stage dispersion is properly carried out and pressure fluctuations are suppressed so that a proper dispersion is carried out by the process of one device.

Since the dispersing device 421 and the system 400 for dispersing by circulating the mixture have the distinctive buffer that is discussed with reference to FIGS. 1-10, an efficient and proper dispersion can be carried out. Further, since the device has the mechanism (the driving mechanism 420) for adjusting the distance that is discussed with reference to FIG. 11, generating an occlusion at the gap $\delta_1$ between the rotor and the stator or damaging the device or piping by the internal pressure being too high, can be prevented. Since the device has the driving mechanism 420, the rotor can be spaced far apart from the spacer so that the cleaning or maintenance can be made efficient. Further, since the device has the driving mechanism 420, a dispersion of two or more stages can be achieved to reduce the total processing time, to eliminate devices that might be additionally required, and to downsize the whole system.

The method for dispersing by circulating the mixture that uses the system 400 for dispersing by circulating the mixture, which comprises the dispersing device 421, etc., a tank that is connected to the outlet of the dispersing device, a pump for circulating the mixture, and the piping for connecting in series the dispersing device, the tank, and the pump for circulation, achieves an efficient and proper dispersion.

The method for dispersing by circulating the mixture that uses the system 400 for dispersing by circulating the mixture is characterized in that the dispersing device 421 includes the driving mechanism 420, which drives either the rotor 2 or the member that faces the rotor 2 (the stator 3) or both, to be close to, or separate from, each other, and in that the mixture is dispersed while the distance between the rotor 2 and the member that faces the rotor 2 is adjusted, based on the measurements by either the pressure sensor 423 for measuring the pressure of the mixture between the rotor 2 and the member that faces the rotor 2 (the stator 3) or the temperature sensor 424 for measuring the temperature of the mixture that is discharged from the gap between the rotor 2 and the member that faces the rotor 2 (the stator 3) or both. This method prevents an occlusion from being generated by predicting it, to thereby securely prevent any damage to the device or piping.

The method for dispersion comprises the step of mixing a first mixture for circulating raw material, adding first additives to the raw material, and dispersing the additives in the raw material to obtain the first mixture, and the step of mixing a second mixture for circulating the first mixture, which has been obtained by the step of mixing the first mixture, adding second additives to the first mixture, and dispersing the additives in the first mixture to obtain the second mixture. By this method, mixing the first mixture and mixing the second mixture can be carried out by just the system 400 for dispersing by circulating the mixture. Thus the device is simplified. The total processing time is shortened.

Further, by this method, the distance between the rotor 2 and the member that faces the rotor 2 (the stator 3) is changed when the step of mixing the first mixture ends and the step of mixing the second mixture starts. Thus the best shearing force can be applied to the mixture in the respective steps so that a proper and effective dispersion can be achieved. Further, this method is very effective for dispersing the active material while a thickener is added to water, for example, manufacturing a material for a battery.

By using the method for dispersing, the dispersing device 421, or the system 400 for dispersing by circulating the mixture as discussed above, a proper and efficient dispersing process can be carried out by preventing the device or piping from being damaged by the increased internal pressure that is caused by an occlusion of the mixture between the pair of rotors or the rotor and stator of the dispersing device. Further, it enables the two-stage dispersion, to thereby achieve a further proper and efficient dispersion.

The feature of the driving mechanism 420 that is discussed with reference to FIG. 11 and the feature of the two-stage dispersion that is obtained by that feature are combined with the feature of the buffer as in FIGS. 1-10 to improve the performances of the dispersing device and the system for dispersing by circulating the mixture by the advantageous effects as discussed above. Further, the driving mechanism 420 can be used for a dispersing device (for example, where a dispersing device that has a stator and a rotor or a pair of rotors that face each other are made of a circular plate, etc.) that has a rotor and a stator or a pair of rotors that have no buffer as discussed with reference to FIGS. 1-10. In such a case, the device has advantageous effects by using a driving mechanism and a two-stage dispersion.

Next, the feature of the buffer that is discussed with reference to FIGS. 1-10, the feature of the driving mechanism for adjusting the distance that is discussed with reference to FIG. 11, and the feature of a screw-type device for supplying powdery additives that is suitably used for the two-stage dispersion and is attached to the tank that is discussed with reference to FIG. 11, are now discussed with reference to FIGS. 19-25.

In the system 200, 400 for dispersing by circulating the mixture a tank apparatus 501, which is distinctive, may be installed instead of the tank 201, 401. The tank apparatus 501 has a distinctive structure, i.e., a screw-type device 531 for supplying powdery additives. The device 531 is installed so that the tip 532 of the part for supplying powdery additives is inserted into the mixture in the tank. This tank apparatus 501 is installed in the system for dispersing by circulating the mixture to prevent a powdery material from adhering to the inner surface of the tank, to prevent the powdery material from scattering in the tank, and to prevent powdery additives from drifting on the surface of the liquid or agglutinating, to thereby achieve a proper and effective dispersion. The specific structure of its driving mechanism and the functions and effects are below discussed by using a specific example of the system 500 for dispersing by circulating the mixture as in FIG. 19.

Since the system 500 for dispersing by circulating the mixture has the same structure as the system 400 for dispersing by circulating the mixture has, except that is has the tank apparatus 501 having a screw-type device for supplying powdery additives, etc., instead of the tank 401 and the device 406 for supplying that is attached to the tank 401, the corresponding elements are denoted by the same reference numbers and the detailed explanations for them are omitted.

Figure 19:
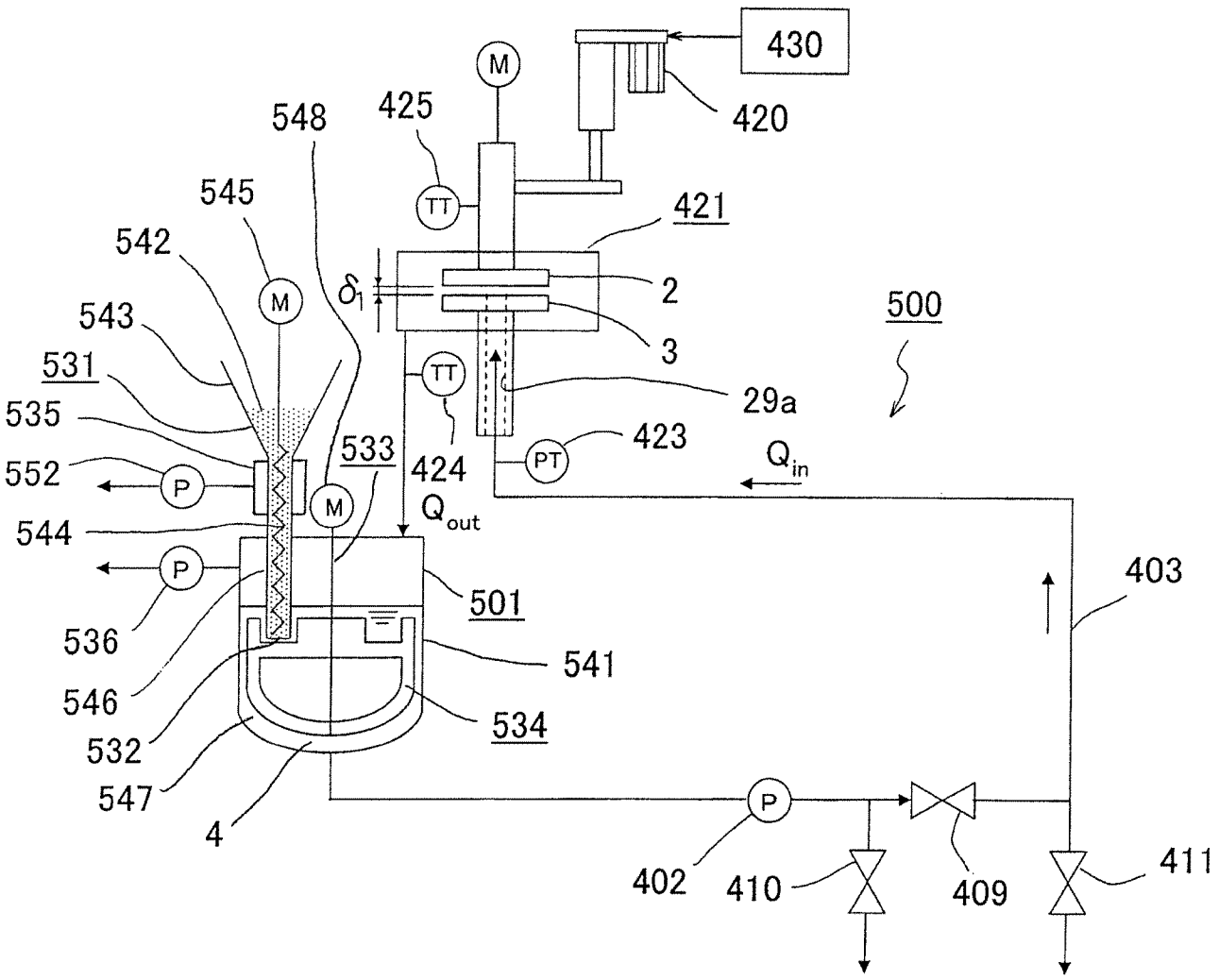
FIG. 19 is a schematic diagram illustrating the structure of another embodiment of the system for dispersing by circulating the mixture that uses the dispersing device that has a tank apparatus that has a distinctive screw-type device for supplying powdery additives.
Figure 20:
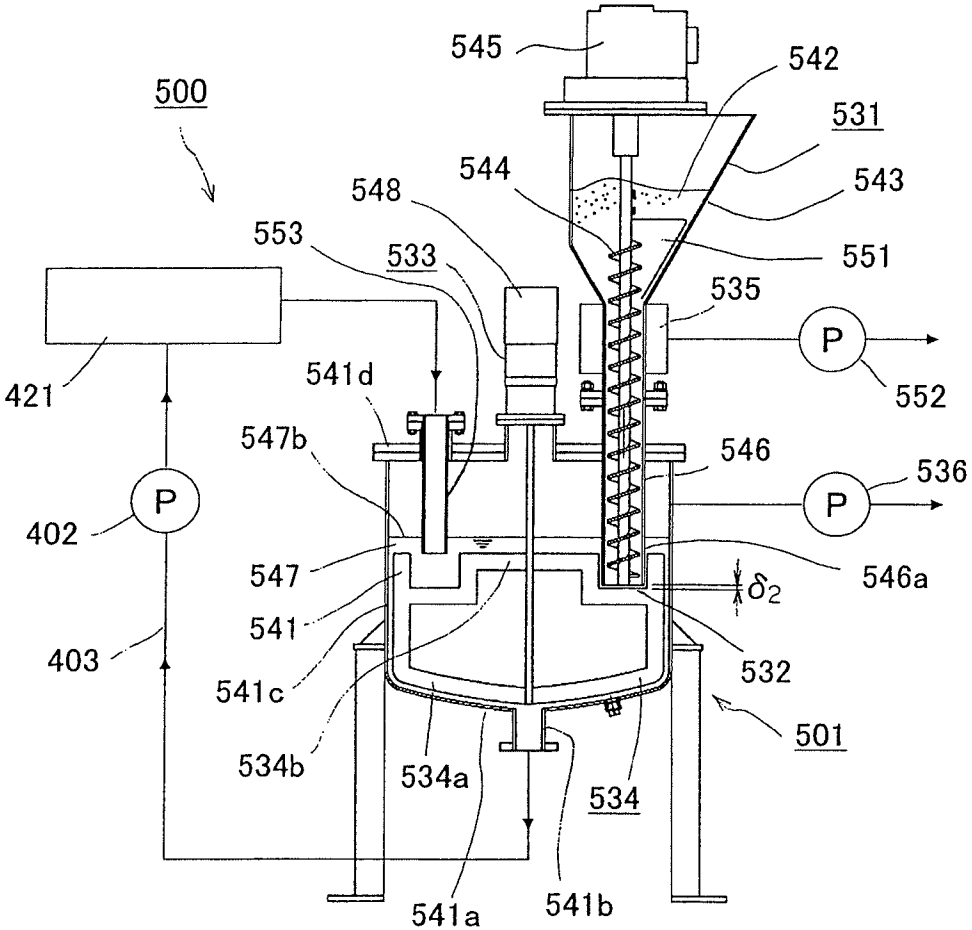
FIG. 20 is a schematic and sectional illustration showing the structure of the tank apparatus that constitutes the system for dispersing by circulating the mixture as in FIG. 19.

Next, with reference to FIGS. 19 and 20, the system 500 for dispersing by circulating the mixture, which adopts this invention, is discussed. The system 500 for dispersing by circulating the mixture as in FIG. 19 includes a rotor-type and continuous dispersing device 421 for dispersing the mixture. In the figure, "M" denotes a motor. The rotating shaft of the rotor is vertically disposed. However, the structure is not limited to that as in the figure, as discussed above. The system 500 for dispersing by circulating the mixture comprises the tank apparatus 501 that is connected to the outlet of the dispersing device 421, etc., the pump 402 for circulation that is connected to the outlet of the tank apparatus 501 and circulates the mixture 4, and the piping 403 that connects the dispersing device 421, etc., the tank apparatus 501, and the pump 402 for circulation in series. The dispersing device that constitutes the system 500 for dispersing by circulating the mixture is not limited to the dispersing device 421. It may be any of the dispersing devices 1, 31, 71, 81, 91, 131, 191 (that include a variation where the stator is replaced by a rotor) or any of these devices to which the driving mechanism 420 is added.

The system 500 for dispersing by circulating the mixture may be arranged like the system 400 for dispersing by circulating the mixture as in FIG. 12, for example. If necessary, the tank 491 for storing the powdery additives may be connected to it via the piping 492 for supplying additives. The lift 495 for vertically moving the lid 541*d* may be provided to the tank apparatus 501.

The fluid that circulates in the tank apparatus 501, the dispersing device 421, and the piping 403 is a raw material (a raw material that is slurry or liquid) at first. As it passes through the dispersing device, it becomes a mixture that is mixed with the additive material (powdery additives in the system 500 for dispersing by circulating the mixture). Finally it becomes the mixture that has been dispersed. In this description, the "raw material" at first and the "mixture" during the process are also called the "mixture." The "liquid" in the description includes slurry, unless otherwise noted.

The system 500 for dispersing by circulating the mixture includes the driving mechanism 420, which is disposed in the dispersing device 421, the controller 430, the pressure sensor 423, the temperature sensors 424, 425, the valves 409, 410, 411, etc., like the system 400 for dispersing by circulating the mixture.

The system 500 for dispersing by circulating the mixture circulates a raw material. While it circulates the raw material, it adds additives to the raw material and disperses them by a shear-type dispersing device. The raw material is supplied to the dispersing device 421 through a passage for supplying (a port 29*a* for supplying) that is provided to the member that faces the rotor (the stator 3).

A screw-type device 531 for supplying powdery additives, which supplies the additives to the raw material in the tank apparatus 501, is provided to the tank apparatus 501. The tip 532 of the part for supplying powdery additives of the screw-type device 531 for supplying powdery additives is inserted in the mixture 4 in the tank apparatus 501.

The tank apparatus 501 has an agitator 533 for agitating the mixture 4 in the tank apparatus 501. A blade 534 for agitation of the agitator 533 scrapes the powdery additives from the area surrounding the outlet of the tip 532 of the part for supplying powdery additives. The powdery additives have been supplied to the raw material in the tank apparatus 501 through the tip 532 of the part for supplying powdery additives. Thus the powdery additives are dispersed in the raw material in the tank apparatus 501.

The screw-type device 531 for supplying powdery additives has a deaerator 535 for expelling air from the powdery additives. But no deaerator 535 need be provided to the tank apparatus 501. If the deaerator 535 is provided, air in the powdery additives can be expelled before they are supplied to the liquid.

A pump 536 for decompression that decompresses the inside of the tank apparatus 501 is provided to the tank apparatus 501. No pump 536 for decompression need be provided to the tank apparatus 501. The effects that are caused by providing the pump for decompression 536 are discussed below.

Below further details are discussed. As in FIGS. 19 and 20, the screw-type 531 device for supplying powdery additives, i.e., a screw feeder, is located above the tank apparatus 501, which stores the liquid, so that the tip (546*a*) of the pipe 546 for guiding of the screw feeder is inserted into the liquid (the mixture 4 [a liquid raw material 547 at first]). The blade 534 for agitation acts so as to mix the powdery additives 542 that are supplied from the screw feeder to the liquid with the liquid, and the blade 534 agitates the liquid in the tank apparatus 501.

The tank apparatus 501 supplies the powdery additives to the liquid and disperses them (because of these functions, it is also called a dispersing device). The tank apparatus 501 comprises a tank 541 for storing the liquid, the screw-type device 531 for supplying powdery additives, and the agitator 533. The screw-type device 531 for supplying powdery additives has a hopper 543 for storing the powdery additives 542, a screw 544 for supplying the powdery additives 542 from the hopper 543 to the tank 541, a motor unit 545 for driving the screw 544, and the pipe 546 for guiding the screw 544 into the liquid. The agitator 533 has the blade 534 for agitation, which disperses the powdery material 542 in the liquid raw material 547, and a motor unit 548 for driving the blade 534 for agitation. The tank 541 has, for example, a cylindrical side wall 541*c*, a curved bottom cover 541*a*, and a lid 541*d*, which is a flat top cover. A discharging port 541*b* is provided near the center of the bottom cover 541*a* of the tank 541. In a horizontal plane the agitator 533 is provided at the center of the tank 541 and the screw-type device 531 for supplying powdery additives is attached at a position that deviates from that center.

The screw 544 and the pipe 546 for guiding are located so that their tips are inserted into the liquid raw material 547 that is stored in the tank 541. As in FIG. 20, the blade 534 for agitation has a shape that enables it to scrape the powdery additives 542 by maintaining a gap $\delta_2$ (0.5-10 mm) between it and the pipe 546 for guiding the screw. The powdery additives 542 have been supplied from the pipe 546 to the liquid.

Figure 21:
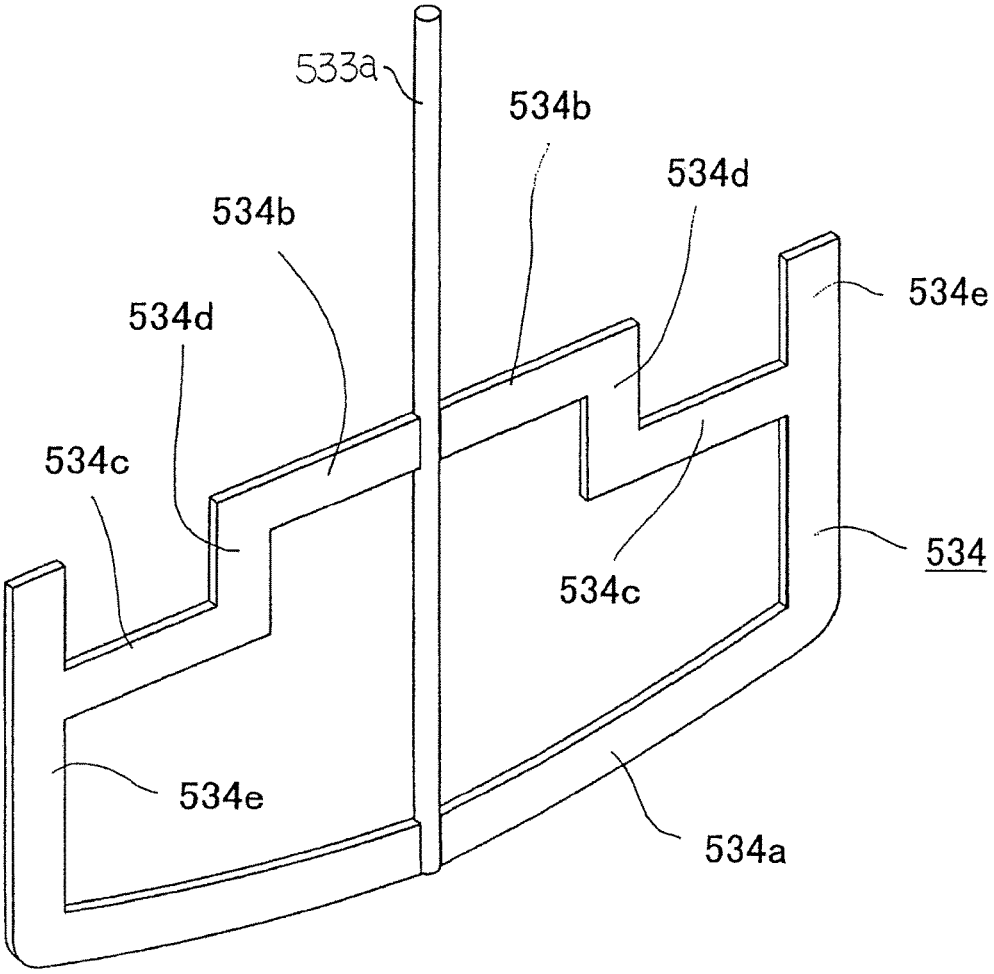
FIG. 21 is a perspective view showing the structure of a blade for agitation that constitutes the tank apparatus in FIG. 20.

More specifically, as in FIGS. 20 and 21, the blade 534 for agitation has a portion 534*a* for agitating the liquid near the bottom plate 541 that is located so as to have a predetermined gap (1-50 mm) between the portion 534*a* for agitating the bottom liquid and the bottom plate 541*a* of the tank 541, and a portion 534*b* for agitating the liquid near the surface 547*b* of the liquid that is located so as to have a predetermined gap (10-200 mm) between the portion 534*b* for agitating the surface liquid and the surface 547*b* of the liquid in the tank 541. The portion 534*a* for agitating the bottom liquid and the portion 534*b* for agitating the surface liquid are connected by the rotating shaft 533*a* of the agitator 533 so as to be rotated.

The blade 534 for agitation has a portion 534*c* for scraping the powdery additives, a connecting portion 534*d*, and a connecting portion 534*e*. The portion 534*c* for scraping the powdery additives is located in parallel to the portion 534*b* for agitating the surface liquid and at a position that is lower than the position of the portion 534*b* for agitating the surface liquid (near the portion 534*a* for agitating the bottom liquid), so as to maintain the predetermined gap $\delta_2$ (0.5-10 mm) between the portion 534*c* for scraping the powdery additives and the tip 532 of the part for supplying powdery additives of the screw-type device 531 for supplying powdery additives.

The connecting portion 534*d* is formed to have a vertical shape so that the portion 534*b* for agitating the surface liquid is connected to the portion 534*c* for scraping the powdery additives at both ends of the connecting portion 534*d*. The connecting portion 534*e* is parallel to the connecting portion 534*d* and connects the portion 534*a* for agitating the bottom liquid to the portion 534*c* for scraping the powdery additives. It extends to the same height as the portion 534*b* for agitating the surface liquid. Both the connecting portion 534*d* and the connecting portion 534*e* are configured to be distant from the pipe 546 for guiding the screw at the gap $\delta_2$ when the respective blades 534 for agitation revolve under the pipe 546 for guiding the screw.

The blade 534 for agitation as discussed above is formed to have a plate-like shape as a whole. Blades for agitation may be made by combining two or more plates as discussed above at constant angles between them in the direction of rotation so as to improve the performance for agitation. The powdery additives 542 in the hopper 543 are prevented from adhering to the inner face of the hopper or bridging, by means of a scraper 551 that is attached to the screw 544.

If the powdery additives 542 are fine and contain much air, the deaerator 535, which is connected along the screw 544 as in FIG. 20, expels air from the powdery additives before they are supplied to the liquid. The deaerator 535 is a filter made of metal or a ceramic and suctions air from the powdery additives, at the position where it is connected to the pipe for guiding, by means of a vacuum pump 552. Thus, since air in the powdery additives is expelled (deaerated), the mixture of air into the liquid is supressed. This has an advantageous effect, namely, to shorten the time for deaeration that is to be carried out at a later step, especially for a liquid that has a high viscosity. Further, since the apparent density (also called "bulk density") of the powdery additives increases, the rate for supplying them can be increased. The bulk density is obtained in the following way. The powdery additives are filled in a container of a known weight. The weight of the powdery additives is measured and the weight is divided by the volume, to obtain the bulk density.

Since the tank apparatus 501 has the screw-type device 531 for supplying powdery additives and the agitator 533, the powdery material is prevented from adhering to the inner face of the tank, from scattering within the tank, from drifting on the surface of the liquid, or from agglutinating. Thus a proper and efficient dispersion can be achieved.

The tank apparatus 501 has a function to disperse the mixture by itself. However, as in FIGS. 19 and 20, by connecting it to the dispersing device 421, etc., by the piping 403, which dispersing device has a high dispersing ability by imparting shearing energy to all the mixture, so as to circulate the liquid in the tank by the pump 402 and to repeat the dispersion by the dispersing device 421 the dispersing ability can be significantly improved.

Since the mixture is circulated by the system 500 for dispersing by circulating the mixture, which system 500 includes the tank apparatus 501, the powdery additives are prevented from both drifting on the surface of the liquid and from piling up on the bottom of the tank, when the differences in the specific weights of the powdery additives and liquid are great. Thus any uneven dispersion can be avoided. Providing the dispersing device 421 to the system for dispersing by circulating the mixture is effective especially for a liquid that has a high viscosity. If the liquid does have a high viscosity, generating a flow in the mixture by the blade for agitation of the tank apparatus 501 may be difficult, resulting in a decrease in the dispersing ability. However, the dispersing device achieves a high degree of dispersion by imparting shearing energy to all of the mixture to any mixture that has a high viscosity.

The pipe 553 for guiding is provided to the tank apparatus 501 so that the mixture 4 that has been dispersed by the dispersing device 421 is returned to the tank (the mixture is supplied to the tank) by the piping 403 in the system 500 for dispersing by circulating the mixture. The tip of the pipe 553 for guiding is configured to be inserted in the liquid in the tank. By means of the pipe 553 for guiding, the mixture 4 that is returned to the tank is prevented from dropping to the surface of the liquid, so as not to cause the droplets to adhere to the inner face of the tank.

The pump 536 for decompression, which is connected to the tank 541, acts for deaerating the mixture 4.

In the system 500 for dispersing by circulating the mixture, during the operation the valve 409 is normally open and the valves 410, 411 are normally closed. When the dispersion process is completed, the valve 409 is closed and the valve 410 is opened. Thus the processed mixture can be discharged through the valve 410 and collected. The mixture that remains in the dispersing device 421 and the piping 403 is discharged and collected by opening the valve 411. The valves for discharging and collecting the mixture can be located at any position on the tank and piping. However, they are preferably located at a lower position so that the mixture can be discharged by the force of gravity.

Since, as discussed above, the system 500 for dispersing by circulating the mixture includes the dispersing device 421, it achieves an effective and proper dispersion. Thus the dispersing ability functioning as an entire system is improved and the processing time for the dispersion can be shortened. If the system 500 for dispersing by circulating the mixture includes the driving mechanism 420, it has the same effects as the system 400 for dispersing by circulating the mixture does. Since the function and effects are the same as those of the system 400 for dispersing by circulating the mixture, their details are omitted.

Since the system 500 for dispersing by circulating the mixture includes the tank apparatus 501, the powdery material is prevented from adhering to the inner face of the tank, from scattering within the tank, from drifting on the surface of the liquid, and from agglutinating, so that a proper and effective dispersion is achieved. Further, any occlusion in the hopper for storing the powdery additives and the piping is prevented.

Mixing air into the liquid is minimized. The rate for supplying the powdery additives can be increased even for fine powder, to enable a continuous supply of the powdery additives. Thus the system 500 for dispersing by circulating the mixture achieves a proper dispersion.

Specifically, the tank apparatus 501, and the system 500 for dispersing by circulating the mixture, which uses it, can prevent the powdery material from scattering in the tank by inserting the tip of the screw feeder into the liquid. Thus problems such as the powdery material being scattered to adhere to the inner face of the tank, and the droplets spreading, when the powdery additives drop on the surface of the liquid, to adhere to the inner face of the tank, can be resolved.

The tank apparatus 501, and the system 500 for dispersing by circulating the mixture, which uses it, carry out a batch process for the dispersion. The blade for agitation in the tank is configured to mix the powdery additives that have been supplied from the screw feeder to the liquid with the liquid such that the powdery additives are immediately mixed with the liquid. Thereby the powdery additives are prevented from drifting on the surface of the liquid and from agglutinating. Thus the powdery additives are properly dispersed in the liquid.

The tank apparatus 501, and the system 500 for dispersing by circulating the mixture, which uses it, minimize the inclusion of air in the liquid by a deaeration taking place along the screw feeder. In addition, since the bulk density of the powdery additives is increased, the rate of supplying the powdery additives can be increased and any floating of the powdery additives in the liquid can be suppressed.

Figure 22:
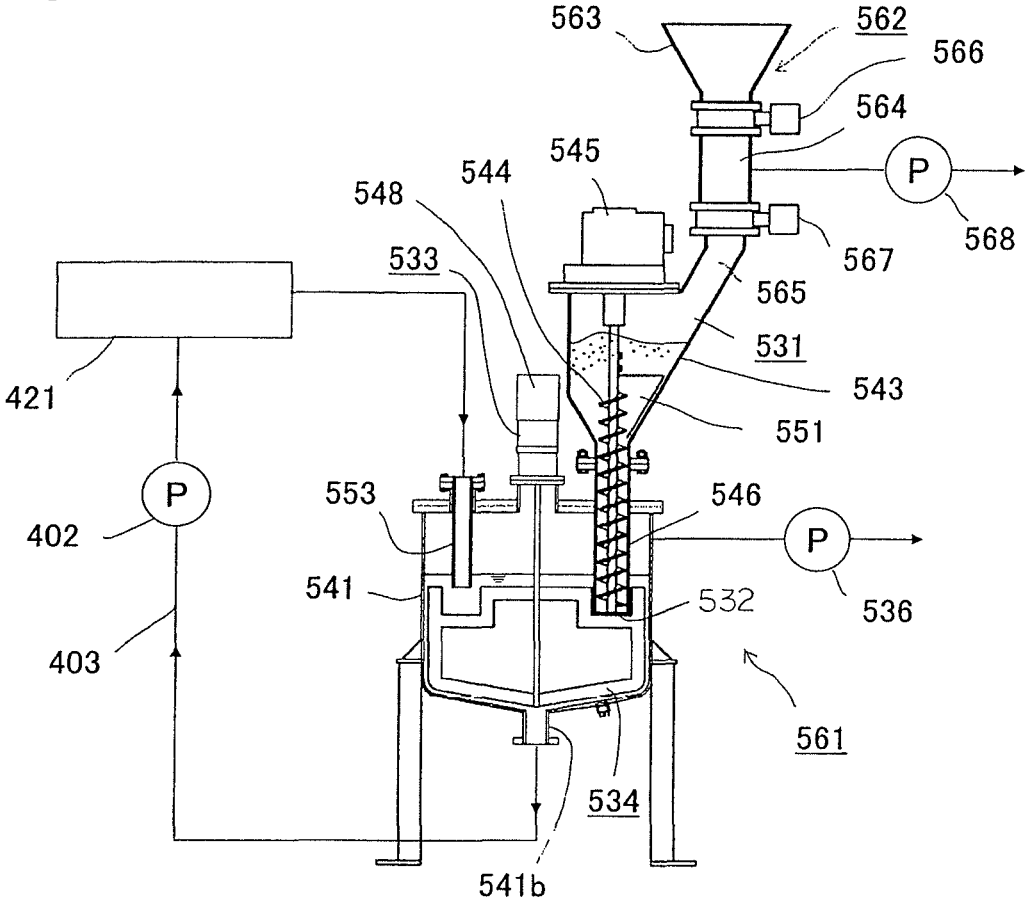
FIG. 22 is a schematic and sectional illustration showing the structure of another embodiment of the tank apparatus that constitutes the system for dispersing by circulating the mixture as in FIG. 19, wherein the apparatus has a mechanism for decompression.

A tank apparatus that can be used for the system 500 for dispersing by circulating the mixture is not limited to the tank apparatus 501. For example, a tank apparatus 561 as in FIG. 22 can be also used. The tank apparatus 561 as in FIG. 22 is a variation of the tank apparatus 501. It has the same structure as the tank apparatus 501 does except that a mechanism 562 for decompression is added to the hopper 543 of the screw-type device 531 for supplying powdery additives. Thus the corresponding elements are denoted by the same reference numbers and the detailed descriptions for them are omitted.

As in FIG. 22, the tank apparatus 561 comprises the screw-type device 531 for supplying powdery additives, the agitator 533, the blade 534 for agitation, the pump 536 for decompression, the hopper 543, the screw 544, the motor unit 545, the pipe 546 for guiding, the motor unit 548, and the scraper 551. Though the tank apparatus 561 is described as having no deaerator 535, it may have the deaerator 535, like the tank apparatus 501 does. Thereby a further proper dispersion can be achieved by the effects of the deaerator.

In addition, the tank apparatus 561 has a mechanism 562 for decompression. The mechanism 562 for decompression has a receptacle 563 for a supply that is provided above the hopper 543, a pipe 564 for decompression, and a pipe 565 for a connection that connects the receptacle 563 for a supply to the hopper 543, valves 566, 567, and a pump 568 for decompression. The valves 566, 567 are normally closed.

For supplying powdery additives to the screw-type device 531 for supplying powdery additives, the valve 566 is opened so that the powdery additives are supplied from the receptacle 563 for a supply to the pipe 564 for decompression. Next, the valve 566 is closed and the inside of the pipe 564 for decompression is decompressed by the pump 568 for decompression. After it is decompressed, the valve 567 is opened to enable the pipe 564 for decompression to continue to be decompressed by the pump 568 for decompression, so that the powdery additives in the pipe 564 for decompression, which powdery additives have been deaerated, are introduced into the hopper 543 via the pipe 565 for a connection. When the introduction is completed, the valve 567 is closed. Then the pump 568 for decompression is deactivated. The pump 568 for decompression may be deactivated before the valve 567 is closed.

The mechanism 562 for decompression causes the inside of the screw-type device 531 for supplying powdery additives to be normally decompressed so that the air in the powdery additives is expelled. Thus the deaerating process can be quickly completed. In addition, the pump 536 for decompression can act at its maximum performance.

Figure 23:
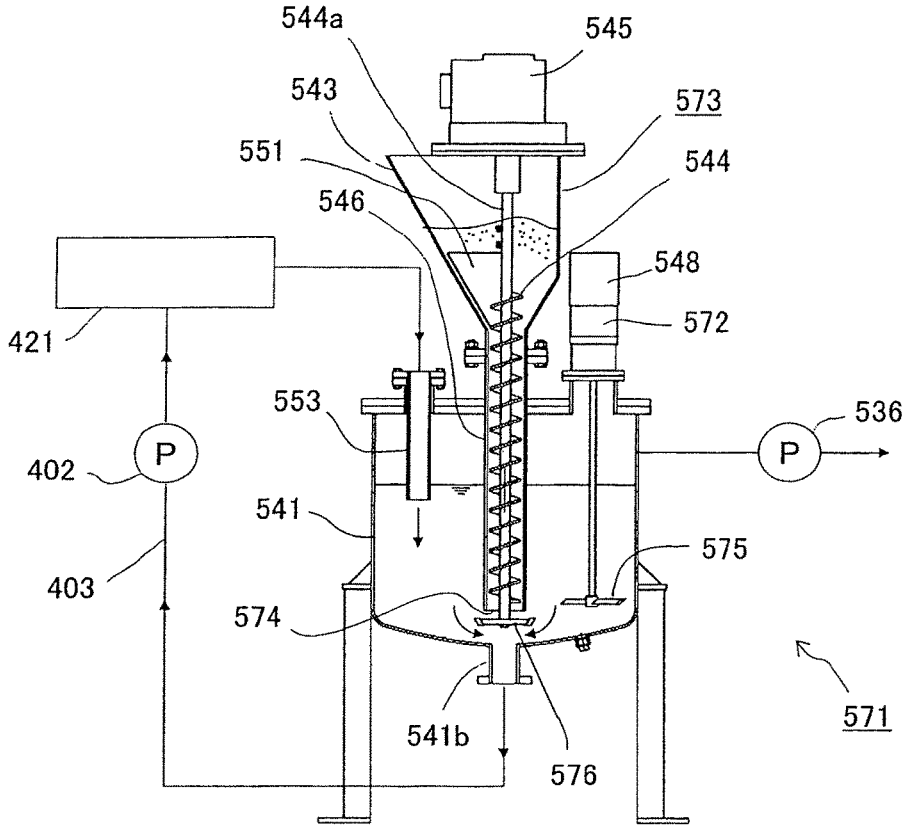
FIG. 23 is a schematic and sectional illustration showing the structure of another embodiment of the tank apparatus that constitutes the system for dispersing by circulating the mixture as in FIG. 19, wherein the positions of the screw-type device for supplying powdery additives and the agitator are changed.

A tank apparatus that can be used for the system 500 for dispersing by circulating the mixture is not limited to the tank apparatuses 501, 561. For example, a tank apparatus 571 as in FIG. 23 may be used. The tank apparatus 571 as in FIG. 23 is a variation of the tank apparatus 501. It has the same structure as the tank apparatus 501 does, except for the position where the screw-type device for supplying powdery additives is provided, for the position and the structure of the agitator, and for the structure that is added to strengthen the agitation. Thus the corresponding elements are denoted by the same reference numbers and the detailed descriptions for them are omitted.

As in FIG. 23, the tank apparatus 571 comprises a screw-type device 573 for supplying powdery additives, which has the same structure as the screw-type device 531 for supplying powdery additives does, the hopper 543, the screw 544, the motor unit 545, the pipe 546 for guiding, the motor unit 548, and the scraper 551. The tip 574 of the part for supplying powdery additives of the screw-type device 573 for supplying powdery additives is inserted in the mixture 4 in the tank apparatus 571. Though the tank apparatus 571 is described as having no deaerator 535, it may have the deaerator 535, like the tank apparatus 501 does. Thereby a further proper dispersion can be achieved by the effects of the devices. Further, the mechanism 562 for decompression that is discussed with reference to FIG. 22 may be added. Thereby a further proper dispersion can be achieved by the effects of the mechanism 562 for decompression.

The tank apparatus 571 has an agitator 572 for agitating the mixture 4 in the tank apparatus 501. In a horizontal plane the screw-type device 573 for supplying powdery additives is provided at the center of the tank 541 and the agitator 572 is attached at a position that deviates from that center. The tip 574 of the part for supplying powdery additives is located near the discharging port 541*b* of the tank 541 in relation to the position where the agitator 572 agitates (the position of the blade 575 for agitation).

In the tank apparatus 571 the end of the pipe for guiding of the screw feeder is located near the discharging port of the tank. Thus the powdery additives discharged from the screw feeder are mixed in the liquid by means of the flow in which the powdery material is circulated. Thereby the powdery additives are prevented from drifting on the surface of the liquid and agglutinating even when the liquid has a high viscosity. Therefore the powdery additives can be dispersed in the liquid.

A blade 576 at the tip of the screw is attached to the tip 574 of the part for supplying powdery additives. The blade 576 at the tip of the screw is rotated together with the shaft 544*a* of the screw 544 of the screw-type device 573 for supplying powdery additives.

In the tank apparatus 571 the screw 544 and the motor unit 545 are located at the center of the tank. The tip of the screw 544 and the end of the pipe 546 for guiding (the tip 574 of the part for supplying powdery additives) are disposed near the discharging port 541*b* of the tank. Since the liquid in the tank is forced to flow out through the discharging port 541*b*, the powdery additives that have been supplied from the screw 544 to the liquid are mixed in that flow, to thereby be transported by the liquid to the dispersing device 421 via the piping 403. If the specific weight of the powdery additives were to be less than that of the liquid, the powdery additives would move upward by their buoyancy, so that they might emerge without being dispersed in the liquid and might spread in the space in the tank. This is a problem. However, the tank apparatus 571 has an advantageous effect that avoids that problem. The blade 575 for agitation has a propeller-type or a turbine-type blade. Since it is located so as to deviate from the center of the tank and operates there, a convection flow is generated in the liquid by the agitation that is caused by the blade 575 for agitation. Thereby the powdery additives are prevented from segregating.

Figure 24:
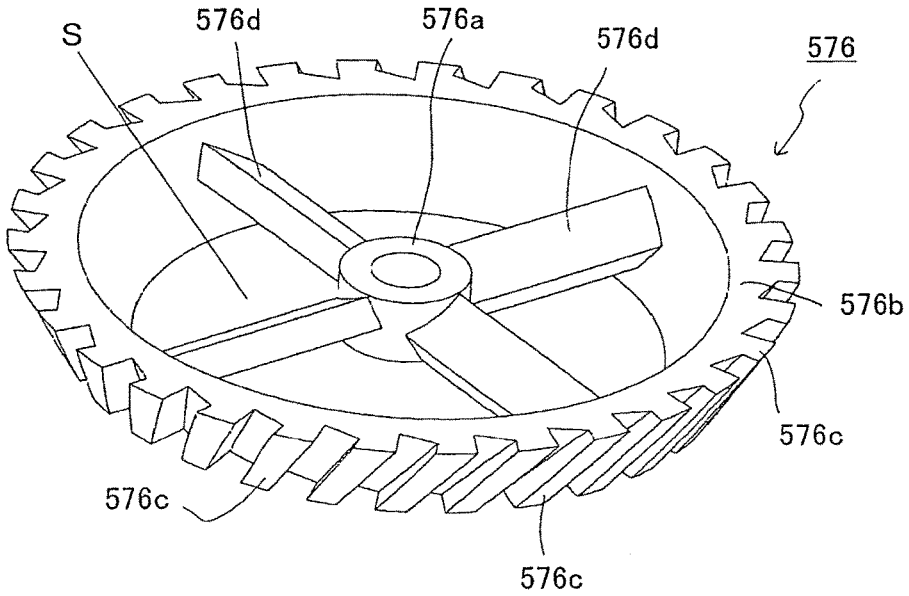
FIG. 24 is a perspective view showing a blade at the tip of the screw that constitutes the tank apparatus as in FIG. 23.

As in FIG. 24, the blade 576 at the tip of the screw comprises a portion 576*a* for fixing, which fixes it to the shaft 544*a* of the screw 544, a portion 576*b* for fixing the blades, which is provided at the outer-circumferential side of the portion 576*a* for fixing the shaft, a plurality of blades 576*c* that are formed all around the portion 576*b* for fixing the blades, and a portion 576*d* for a connection, which connects the portion 576*b* for fixing the blades to the portion 576*a* for fixing the shaft. The portion 576*d* for a connection inclines in relation to a horizontal plane.

The blade 576 at the tip of the screw having the structure as discussed above has an inside space S that is wide so as not to disturb the flow of the powdery additives, since the portion 576*b* for fixing the blades is connected to the portion 576*a* for fixing the shaft by the portion 576*d* for a connection. In addition, it has the following advantageous effects. The portion 576*d* for a connection, which is a structural member inside it, is inclined in the blade 576 at the tip of the screw. Thus when it rotates it agitates the mixture and generates a flow toward the discharging port 541*b*.

The portion 576*b* for fixing the blades, and the blades 576*c*, which are structural members at the outer circumference, have many grooves, which are all inclined. Thus when they rotate they generate a flow toward the discharging port 541*b*. Thereby in addition to dispersing the powdery additives in the liquid, the blade 576 at the tip of the screw generates the flow toward the discharging port so as to prevent the powdery additives from moving upward by their buoyancy.

The tank apparatus 571, which has the blade 576 at the tip of the screw, prevents the powdery additives that have been supplied from the screw from agglutinating and from clogging the piping at some point after being discharged from the tank. Further, it prevents the pump or dispersing device from being operated under an overload.

If the tank apparatus 571 is used for the system 500 for dispersing by circulating the mixture, a dispersing system that repeats the dispersion by returning to the tank the liquid that has been discharged from the tank after being processed is obtained. By locating the screw 544 and the pipe 546 for guiding near the discharging port 541*b*, the powdery additives are mixed with the liquid by means of the flow of the liquid. Thereby an efficient dispersion process can be achieved.

As discussed above, the tank apparatuses 561, 571 as in FIGS. 22 and 23 have specific effects because of their specific structure. Further, if they have the screw-type devices 531, 571 for supplying powdery additives, respectively, and the agitators 533, 572, respectively, like the tank apparatus 501, the powdery material is prevented from adhering to the inner face of the tank, from scattering in the tank, from drifting on the surface of the liquid, and from agglutinating. Thus a proper and efficient dispersion is achieved. If the tank apparatuses 561, 571 have the same structure as that discussed for the tank apparatus 501, they enjoy the effects that are obtained by that structure.

The system 500 for dispersing by circulating the mixture, which uses the tank apparatus 561, 571, can suppress the mixing of air with the liquid, in addition to having the functions and effects obtained by the tank apparatus 561, 571 by itself. Thus the rate for supplying the fine powdery additives can be increased, to thereby enable the powdery additives to be continuously supplied. Therefore a proper dispersion is achieved.

The tank apparatuses 501, 561, 571, which can be used for the system 500 for dispersing by circulating the mixture, are discussed above with reference to FIGS. 19-24. Though they function best when they are used for the system 500 for dispersing by circulating the mixture, they alone have the dispersing functions.

Figure 25:
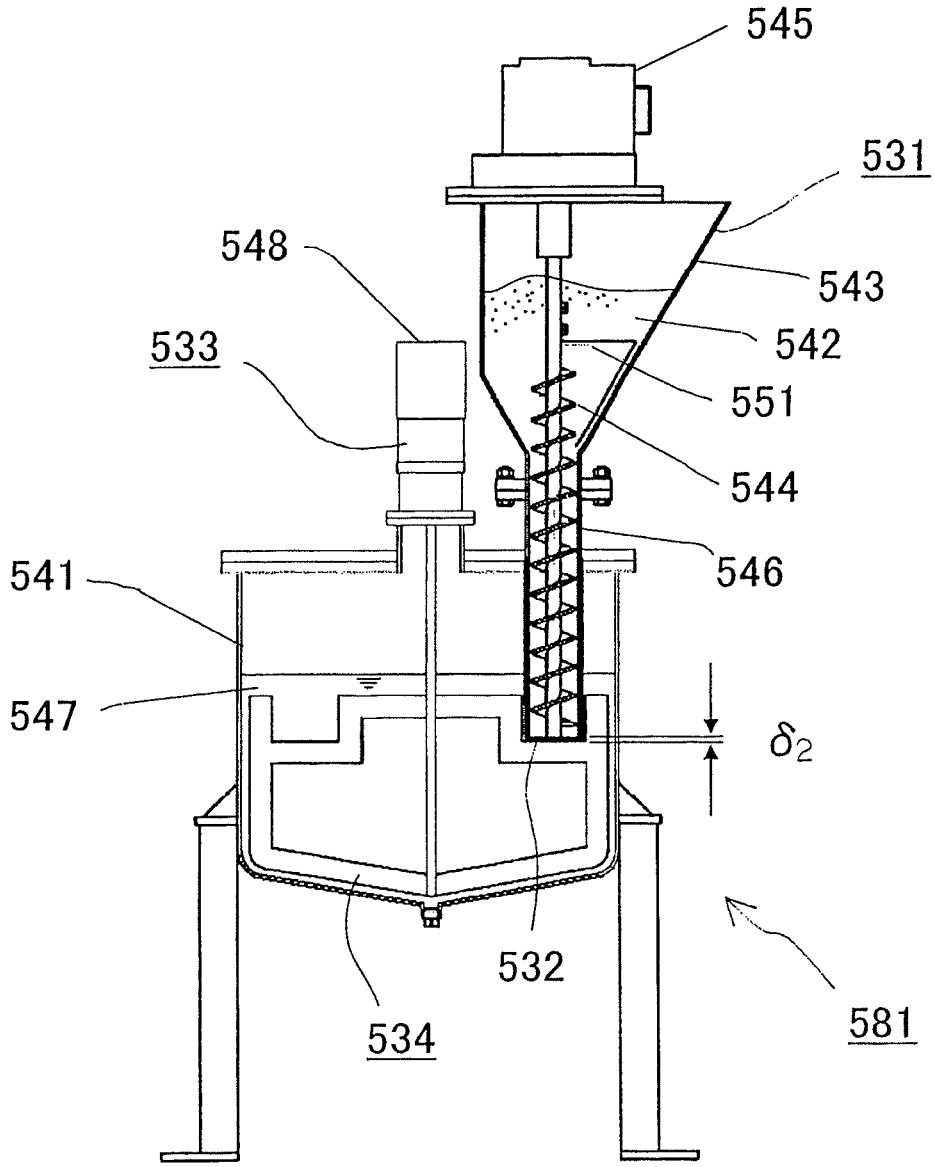
FIG. 25 is a schematic and sectional illustration showing a variation of the tank apparatus in FIG. 19, wherein one tank apparatus is used.

That is, a tank apparatus may be configured to be the tank apparatus 581 as in FIG. 25. The tank apparatus 581 is the same as the tank apparatus 501 as in FIG. 20 except that it has no component for circulation (the pipe 553 for guiding and the discharging port 541*b*). Thus the corresponding elements are denoted by the same reference numbers, and so the detailed descriptions for them are omitted.

As in FIG. 25, the tank apparatus 581 comprises the screw-type device 531 for supplying powdery additives, the agitator 533, the blade 534 for agitation, the hopper 543, the screw 544, the motor unit 545, the pipe 546 for guiding, the motor unit 548, and the scraper 551. Though the tank apparatus 581 is described as having no deaerator 535 or pump 536 for decompression, it may have both the deaerator 535 and the pump 536 for decompression, like the tank apparatus 501 does. Thereby a further proper dispersion can be achieved by the effects of these devices.

Since the tank apparatus 581 has the screw-type device 531 for supplying powdery additives and the agitator 533, the powdery material is prevented from adhering to the inner face of the tank, from scattering in the tank, from drifting on the surface of the liquid, and from agglutinating. Thus a proper and efficient dispersion can be achieved. Though the tank apparatus 581, which is a variation of the tank apparatus 501 that is to be used alone, is discussed, the tank apparatuses 561, 571 have the same effect when they are used alone.

Next, the method for dispersing that uses the tank apparatus 501, 561, 571, 581 is discussed. By the method, a raw material that is slurry or liquid is stored in a tank 541 of the tank apparatus 501, 561, 571, 581 (hereafter, "the tank apparatus 501, etc.,") and powdery additives are supplied to the raw material to be dispersed in it. While the tip 532, 574 of the portion for supplying the powdery additives of the screw-type device 531, 573 for supplying powdery additives, which is provided to, and integral with, the tank 541, is inserted in the mixture in the tank, the additives are supplied to the raw material in the tank, to be dispersed in it. This is a feature of this method.

By the method for dispersing that uses the system 500 for dispersing by circulating the mixture, which has the tank apparatus 501, 561, 571, the mixture is circulated through the tank apparatus 501, 561, 571, the dispersing device 421, etc., and the piping 403, by the pump 402 for circulation, to be dispersed. While the tip 532, 574 of the part for supplying powdery additives of the screw-type device 531, 573 for supplying powdery additives, which is provided to, and integral with, the tank 541, is inserted in the mixture in the tank, the additives are supplied to the raw material in the tank, to be dispersed in it. This is a feature of this method.

In these methods for dispersing, when the additives are supplied to be dispersed, the agitator 533, which is provided to the tank apparatus 501, etc., agitates the mixture of the raw material and the additives in the tank, and the blade 534 for the agitation of the agitator 533 scrapes the powdery additives that have been supplied from the tip of the part for supplying powdery additives to the raw material that is liquid in the tank. This is another feature of the methods.

In these methods for dispersing, when the additives are supplied, air that is contained in the powdery additives is expelled by the deaerator 535, which is provided to the tank apparatus. This is another feature of the methods.

In these methods for dispersing, when the additives are supplied to be dispersed, then the agitator 572, which is provided to the tank apparatus, agitates the mixture of the raw material and the additives in the tank. The tip 574 is located near the discharging port in relation to the agitator 572. These are other features of the methods.

In these methods for dispersing, when the additives are supplied to be dispersed, the mixture is agitated by the blade 576 at the tip of the screw, which blade 576 is provided to the tip 574 of the part for supplying powdery additives, and which blade 576 rotates together with the shaft 544*a* of the screw of the screw-type device 573 for supplying powdery additives, so as to be dispersed. This is another feature of the methods.

In these methods for dispersing, when the additives are supplied to be dispersed, the inside of the tank is decompressed by the pump 536 for decompression, which is provided to the tank apparatus. This is also another feature of the methods.

As discussed above, by the methods, by means of the tank apparatus 501, 561, 571, 581, or by means of the system 500 for dispersing by circulating the mixture, the powdery material can be prevented from adhering to the inner face of the tank, from scattering in the tank, from drifting on the surface of the liquid, and from agglutinating. Thus a proper and efficient dispersion is achieved.

Figure 26:
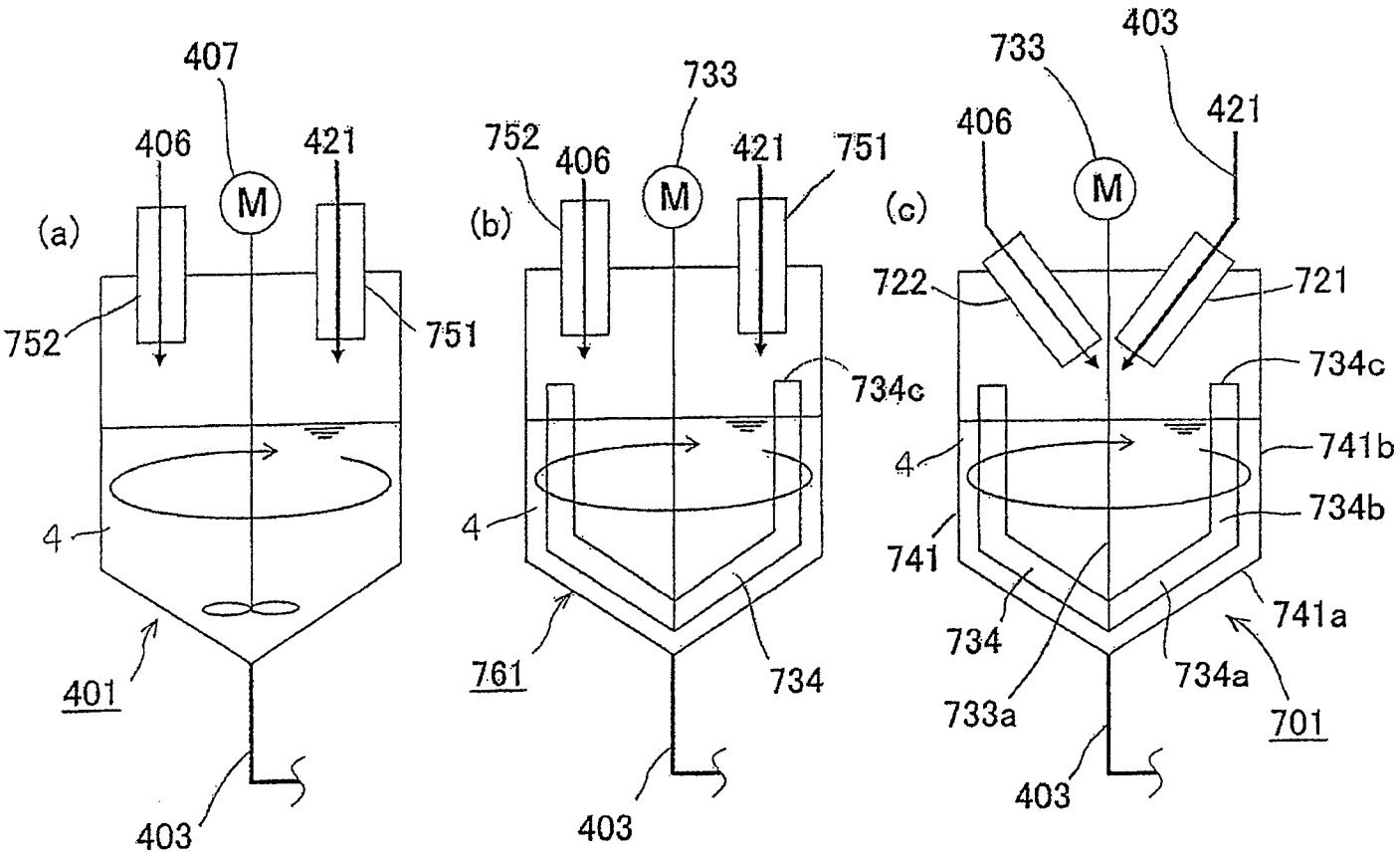
FIG. 26 illustrates other examples of the tank apparatus that are suitable for the system for dispersing by circulating the mixture. (a) is a sectional view showing an example of the tank apparatus that is installed in the system for dispersing by circulating the mixture as in FIG. 11. (b) is a sectional view showing an example wherein the agitator is a different one. (c) is a sectional view of an example wherein a nozzle for conducting is changed from one used in the apparatus in (b).

Next, with reference to FIGS. 26, 27, and 28, a tank apparatus 701 that achieves a proper and efficient dispersion by preventing the powdery material from adhering to the inner face of the tank by a different method from that of the tank apparatus 501, which is discussed with reference to FIGS. 19-25, is discussed. The technical features that are discussed with reference to FIGS. 26, 27, and 28 are added to the features of the buffer that are discussed with reference to FIGS. 1-10, to the features of the driving mechanism for adjusting the distance that are discussed with reference to FIG. 11, and to the features of the two-stage dispersion that are discussed with reference to FIG. 11.

In the system 200, 400 for dispersing by circulating the mixture as discussed above, a tank apparatus 701 may be installed instead of the tank 201, 401. The characteristic structure of the tank apparatus 701 is to include a blade 734 for agitation, which is located so that its upper end is located above the surface of the mixture 4 as in FIG. 26(*c*). Further, the characteristic structure of the tank apparatus 701 is to include portions for conducting (nozzles 721, 722 for conducting). Those portions conduct the additives from the outer-circumferential side toward the inner-circumferential side, since they are inclined in relation to the vertical direction.

The system 700 for dispersing by circulating the mixture has the same structure as the system 400 for dispersing by circulating the mixture does, except for the structures of the tank apparatus 701 and a nozzle for conducting that is attached to it. Thus the corresponding elements are denoted by the same reference numbers and the detailed descriptions for them are omitted.

Figure 27:
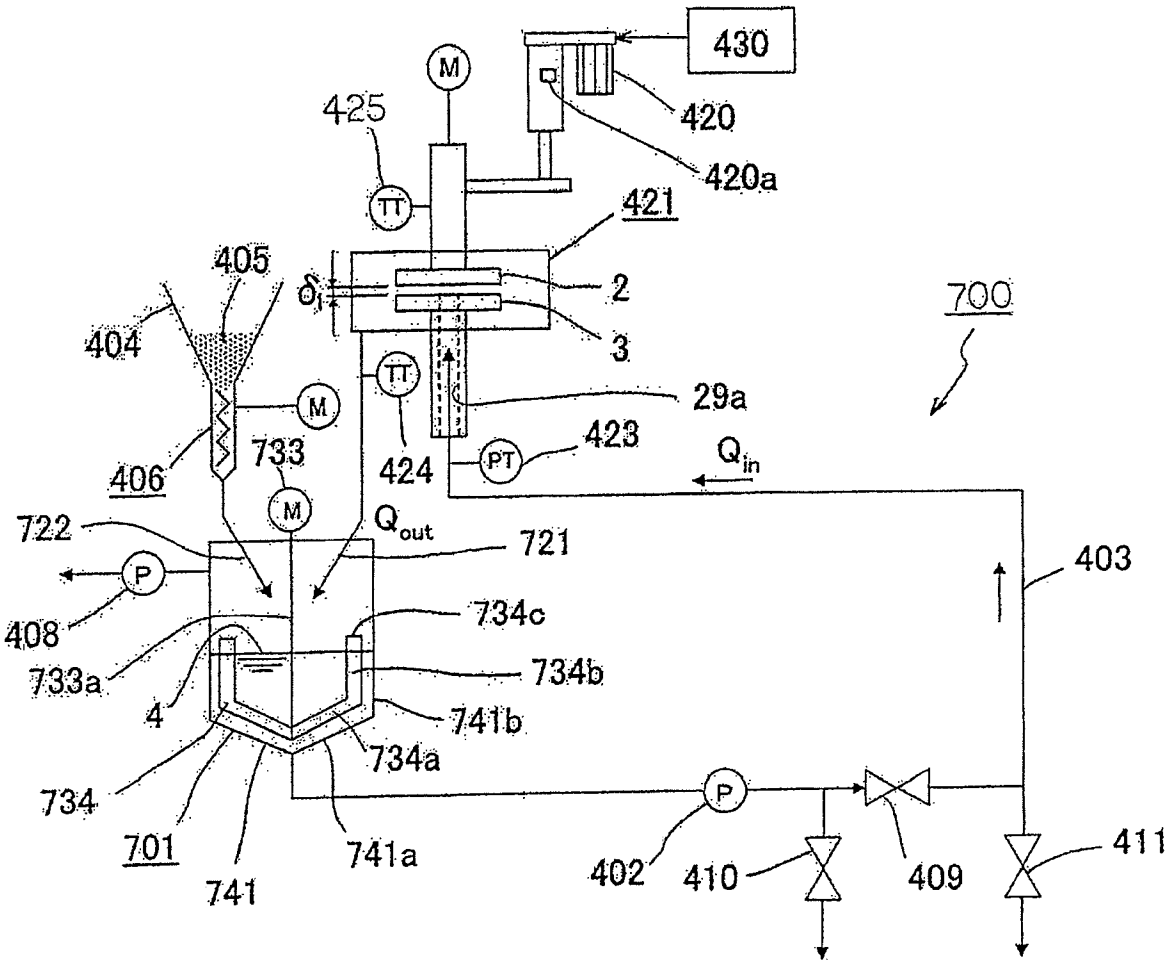
FIG. 27 is a schematic illustration showing the structure of the system for dispersing by circulating the mixture that has the tank apparatus as in FIG. 26(*c*).
Figure 28:
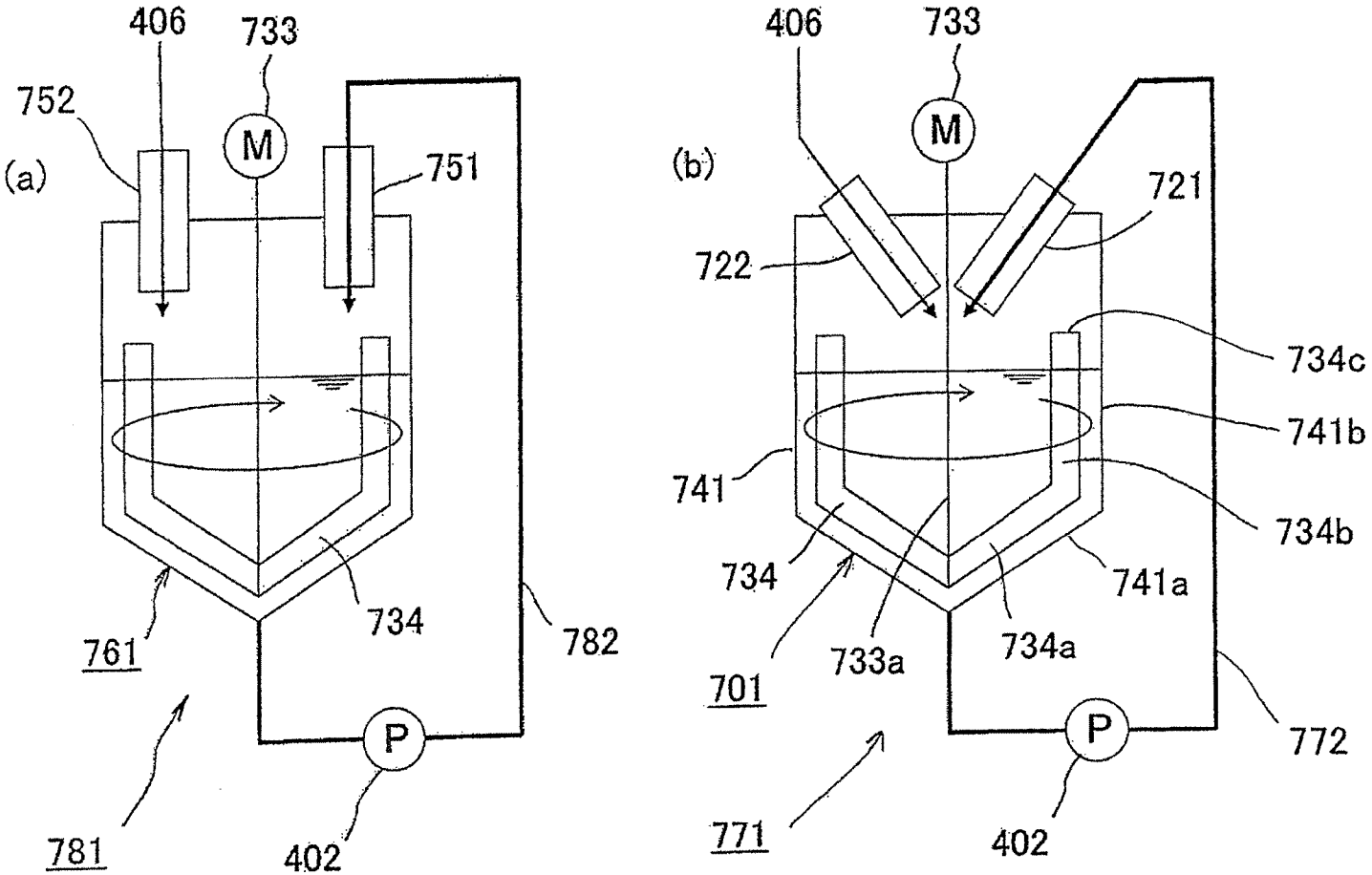
FIG. 28 illustrates examples that combine the tank apparatuses in FIGS. 26(*b*) and (*c*) and the pump for circulation. (a) is a schematic illustration showing the system that has the tank apparatus in FIG. 26(*b*). (b) is a schematic illustration showing the system that has the tank apparatus in FIG. 26(*c*).

The system 700 for dispersing by circulating the mixture as in FIG. 27 comprises the dispersing device 421. It also comprises the tank apparatus 701, which is connected to the outlet of the dispersing device 421, etc., the pump 402 for circulation, which is connected to the outlet of the tank apparatus 701 and circulates the mixture 4, and the piping 403, which connects in series the dispersing device 421, etc., the tank apparatus 701, and the pump 402 for circulation. A dispersing device that constitutes the system 700 for dispersing by circulating the mixture is not limited to the dispersing device 421. Any of the dispersing devices 1, 31, 71, 81, 91, 131, 191 as discussed above (they each include a variation where the stator is replaced by a rotor) or any of those devices to which the driving mechanism 420 is added, may be used.

The system 700 for dispersing by circulating the mixture is arranged as in FIG. 12, namely, like the systems 400, 500 for dispersing by circulating the mixture. If necessary, it may be connected to the tank 491 for storing powdery additives via the piping 492 for supplying additives. It may include a lift 495 for vertically moving the lid 541*d* of the tank apparatus 501. The device 406 for supplying is provided above the tank apparatus 701.

The tank apparatus 701 has an agitator 733 for agitating the mixture 4 in it. The blade 734 for agitation of the agitator 733 is disposed so that the upper face 734*c* of an outer-circumferential portion 734*b* for agitating is located above the surface of the liquid. The outer-circumferential portion 734*b* for agitating just has to project upward by a predetermined length (1-10 mm) from the surface of the liquid when supplying the additives is completed. If the projection were over that range, the additives or the mixture that is slurry would adhere to the upper or side faces. If the projection were below that range, the agitating function would deteriorate. The blade 734 for agitation is located at a predetermined distance (5-10 mm) from the bottom plate 741*a* of the tank 741. It has a portion 734*a* for agitating the mixture near the bottom plate 741*a*. It also has an outer circumferential portion 734*b* for agitating, which is located at a predetermined distance (5-10 mm) from the side plate 741*b* of the tank 741 and agitates the mixture near the side plate 741*b*. The portion 734*a* for agitating the bottom portion is connected to the rotating shaft 733*a* of the agitator 733, to be rotated.

The blade 734 for agitation as discussed above is, as a whole, formed in a plate-like shape. A blade for agitation that is formed by using two or more plate-like members as discussed above and combining them at a constant angle in the direction of rotation may be used. By using it, the agitating performance is improved.

The tank apparatus 701 has a nozzle 721 for conducting. Since the nozzle 721 is disposed to be inclined in relation to the vertical direction, it conducts the mixture 4 from the outer-circumferential side toward the inner-circumferential side. Further, the tank apparatus 701 has a nozzle 722 for conducting. Since the nozzle 722 is disposed to be inclined in relation to the vertical direction, it conducts the additives 405 from the outer-circumferential side toward the inner-circumferential side.

The nozzle 721 for conducting is connected to the piping 403 from the dispersing device 421. When the mixture 4 that has been dispersed by the dispersing device 421 is conducted to the tank apparatus 701, it is introduced near the rotating shaft 733*a* of the agitator 733. Thereby, if the additives 405 adhere to the portion of the rotating shaft 733*a* above the surface of the liquid due to the effects by a vortex flow, they are flown by the mixture 4 that is conducted by the nozzle 721 for conducting so as to be returned into the liquid. The nozzle 722 for conducting is connected to the device 406 for supplying. When the additives 405 that have been supplied from the device 406 for supplying are conducted to the tank apparatus 701, they are introduced near the rotating shaft 733*a* of the agitator 733. Thereby the additives are prevented from being placed on the upper face 734*c*, which projects upward from the surface of the liquid.

Since the tank apparatus 701 comprises the blade 734 for agitation and the nozzles 721, 722 for conducting, the powdery material can be prevented from adhering to the inner face of the tank and from adhering to the portion of the rotating shaft that is above the surface of the liquid, so that the dispersing performance is improved. Thus the entire processing time for the dispersion can be shortened. A proper and efficient dispersion can be achieved.

The tank apparatus 401 as in FIG. 11, for example, includes nozzles 751, 752 that are vertically disposed as in FIG. 26(*a*). The tank apparatus 401 may include the nozzles 721, 722 for conducting. Thereby an efficient and proper dispersion can be carried out.

In the tank apparatus 701 as in FIG. 26(*c*), both the agitator and the nozzles for conducting are modified from the tank apparatus 401 as in FIGS. 11 and 26(*a*). By modifying only the agitator as in FIG. 26(*b*) the effects can be obtained. That is, the mixture is prevented by the blade 734 for agitation of the agitator 733 from adhering to the inner face of the tank in the tank apparatus 761 as in FIG. 26(*b*), so that the dispersing performance is improved. The tank apparatuses 701, 761, which are discussed with reference to FIGS. 26 (*b*) and (*c*), may be constructed as systems 771, 781 of a tank apparatus, respectively, as in FIG. 28, by incorporating the pump 402 for circulation and piping 772, 782.

By using the tank apparatus 701, 761 as in FIG. 26, the system 771, 781 of a tank apparatus that uses that tank apparatus as in FIG. 28, the system 700 for dispersing by circulating the mixture as in FIG. 27, or the method that uses them, the powdery material is prevented from adhering to the inner face of the tank. Thus a proper and efficient dispersion is achieved.

The invention claimed is:

1. A tank apparatus that stores a raw material that is slurry or liquid and supplies powdery additives to the raw material to mix them with the raw material, the tank apparatus comprising:

a tank for storing the raw material;

a screw-type device for supplying powdery additives that is integral with the tank and downwardly supplies the powdery additives to the raw material in the tank;

and an agitator that agitates a mixture of the raw material and the additives in the tank;

wherein a tip of a part for supplying powdery additives of the screw-type device for supplying powdery additives is inserted into the mixture in the tank, and wherein a blade for agitation of the agitator has a portion for agitating the raw material near a bottom that is located so as to have a predetermined gap between the portion for agitating the raw material near the bottom and a bottom plate of the tank, has a portion for agitating the raw material near a surface that is located so as to have a predetermined gap between the portion for agitating the raw material near the surface and the surface of the raw material in the tank and wherein said portion for agitating the raw material near the surface extends through a central portion of the tank, wherein the screw-type device for supplying powdery additives nests with said portion near the surface of the blade, and has a portion for scraping the powdery additives that is located at a position that is lower than a position of the portion for agitating the raw material near the surface and that maintains a predetermined gap between the portion for scraping the powdery additives and the tip of the part for supplying the powdery additives so as to cause the powdery additives at the tip of the part for supplying the powdery additives to flow into the tank.

2. The tank apparatus of claim 1, wherein the screw-type device for supplying powdery additives includes a deaerator that expels air from the powdery additives.

3. The tank apparatus of claim 1, wherein a blade at the tip of the screw is provided to the tip of the part for supplying powdery additives; and wherein the blade at the tip of the screw is rotated together with a shaft of a screw of the screw-type device for supplying powdery additives.

4. The tank apparatus of claim 1, further comprising a pump for decompression that decompresses an inside of the tank.

5. A system for dispersing by circulating the mixture comprising:

a tank apparatus as in any one of claim 1, 2, 3 or 4;

a continuous dispersing device for dispersing the mixture, wherein an outlet of the continuous dispersing device is connected to the tank apparatus;

a pump for circulating the mixture; and a piping for connecting in series the dispersing device, the tank apparatus, and the pump for circulation;

wherein the mixture is circulated to be dispersed.

6. The system for dispersing by circulating the mixture of claim 5, further comprising:

a device for injecting a mixture to be processed that injects the mixture to be processed into the continuous dispersing device;

wherein the continuing dispersing device is configured to detach the tank apparatus from the pump for circulation by means of a joint for a piping that is provided in the piping, and to be connected to the device for injecting the mixture to be processed; and wherein the device for injecting the mixture to be processed injects the mixture to be processed into the dispersing device when the device for injecting a mixture to be processed is connected to the continuous dispersing device.

* * * * *